US006235441B1

(12) United States Patent
Tanikawa et al.

(10) Patent No.: US 6,235,441 B1
(45) Date of Patent: May 22, 2001

(54) POSITIVELY CHARGEABLE TONER, IMAGE FORMING METHOD AND IMAGE FORMING APPARATUS

(75) Inventors: Hirohide Tanikawa; Masami Fujimoto, both of Shizuoka-ken; Takakuni Kobori, Susono; Hiroyuki Fujikawa, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/465,836

(22) Filed: Dec. 17, 1999

(30) Foreign Application Priority Data

| | | |
|---|---|---|
| Dec. 17, 1998 | (JP) | 10-358322 |
| Dec. 17, 1998 | (JP) | 10-358327 |
| Dec. 17, 1998 | (JP) | 10-358335 |
| Dec. 14, 1999 | (JP) | 11-354191 |

(51) Int. Cl.[7] ..... G03G 9/00

(52) U.S. Cl. ..... 430/106; 430/110; 399/222

(58) Field of Search ..... 430/106, 109, 430/110, 111; 399/222

(56) References Cited

U.S. PATENT DOCUMENTS

| | | | | |
|---|---|---|---|---|
| 2,297,691 | | 10/1942 | Carlson | 430/55 |
| 3,666,363 | | 5/1972 | Tanaka et al. | 430/55 |
| 4,071,361 | | 1/1978 | Marushima | 430/54 |
| 5,098,811 | | 3/1992 | Anno et al. | 430/110 |
| 5,169,738 | | 12/1992 | Tanikawa et al. | 430/106.6 |
| 5,565,292 | * | 10/1996 | Nakadera et al. | 430/109 |
| 5,665,510 | * | 9/1997 | Hattori | 430/109 |
| 5,712,073 | | 1/1998 | Katada et al. | 430/110 |
| 5,851,718 | * | 12/1998 | Ohwada et al. | 430/110 |
| 5,968,701 | | 10/1999 | Onuma et al. | 430/110 |
| 6,020,102 | | 2/2000 | Fujimoto et al. | 430/110 |

FOREIGN PATENT DOCUMENTS

| | | |
|---|---|---|
| 0340928 | 11/1989 | (EP) . |
| 0555022 | 8/1993 | (EP) . |
| 0889368 | 1/1999 | (EP) . |
| 0926565 | 6/1999 | (EP) . |
| 51-23354 | 7/1976 | (JP) . |
| 55-90509 | 7/1980 | (JP) . |
| 57-178249 | 11/1982 | (JP) . |
| 57-178250 | 11/1982 | (JP) . |
| 60-4946 | 1/1985 | (JP) . |
| 61-110155 | 5/1986 | (JP) . |
| 61-110156 | 5/1986 | (JP) . |
| 62-9256 | 1/1987 | (JP) . |
| 62-194260 | 8/1987 | (JP) . |
| 63-214760 | 9/1988 | (JP) . |
| 63-217362 | 9/1988 | (JP) . |
| 63-217363 | 9/1988 | (JP) . |
| 63-217364 | 9/1988 | (JP) . |
| 2-168264 | 6/1990 | (JP) . |
| 2-235069 | 9/1990 | (JP) . |
| 3-063661 | 3/1991 | (JP) . |
| 3-063662 | 3/1991 | (JP) . |
| 3-063663 | 3/1991 | (JP) . |
| 3-118552 | 5/1991 | (JP) . |
| 3-202856 | 9/1991 | (JP) . |
| 5-113692 | 5/1993 | (JP) . |
| 5-173363 | 7/1993 | (JP) . |
| 5-173366 | 7/1993 | (JP) . |
| 5-241731 | 9/1993 | (JP) . |
| 6-11890 | 1/1994 | (JP) . |
| 6-222612 | 8/1994 | (JP) . |
| 4-20654 | 1/1995 | (JP) . |
| 8-184996 | 7/1996 | (JP) . |
| 9-185182 | 7/1997 | (JP) . |
| 9-244295 | 9/1997 | (JP) . |
| 9-319410 | 12/1997 | (JP) . |
| 9-325523 | 12/1997 | (JP) . |
| 10-087837 | 4/1998 | (JP) . |
| 10-090943 | 4/1998 | (JP) . |
| 11-072970 | 3/1999 | (JP) . |
| 11-282198 | 10/1999 | (JP) . |

* cited by examiner

*Primary Examiner*—John Goodrow
(74) *Attorney, Agent, or Firm*—Fitzpatrick, Cella, Harper & Scinto

(57) ABSTRACT

A positively chargeable toner suitable to be carried on a cylindrical developer-carrying member having a resinous surface for developing an electrostatic latent image is formed from a composition including a binder resin, an imidazole compound and a colorant. The binder resin comprises at least one member selected from the group consisting of (i) a mixture of vinyl resin having a carboxyl group and a vinyl resin having a glycidyl group, (ii) a vinyl resin having both a carboxyl group and a glycidyl group, and (iii) a vinyl resin having a carboxyl group and a glycidyl group in a form reacted with each other. The imidazole compound is a compound having an imidazo unit represented by formula (1) below:

(1)

wherein $R_1$–$R_4$ independently denote hydrogen or a substituent as specified. In some cases, two or more such imidazole units can be included in a combined form to provide the imidazole compound. The imidazole compound is effective for promoting a crosslinking reaction between the carboxyl group and the glycidyl group to provide the toner with improved fixability and anti-offset property in combination.

87 Claims, 4 Drawing Sheets

POSITIVELY CHARGEABLE TONER, IMAGE FORMING METHOD AND IMAGE FORMING APPARATUS

FIELD OF THE INVENTION AND RELATED ART

The present invention relates to a positively chargeable toner for use in a recording method, such as electrophotography, electrostatic recording, magnetic recording and jet recording, and an image forming method and an image forming apparatus including development of an electrostatic latent image with the toner.

Hitherto, a large number of electrophotographic processes have been known, inclusive of those disclosed in U.S. Pat. Nos. 2,297,691; 3,666,363; and 4,071,361. In these processes, in general, an electrical or electrostatic latent image is formed on a photosensitive member comprising a photoconductive material by various means, then the latent image is developed with a toner, and the resultant toner image is, after being transferred onto a transfer material such as paper etc., via or without via an intermediate transfer member, as desired, fixed by heating, pressing, or heating and pressing, or with solvent vapor to obtain a copy or print carrying a fixed toner image. According to necessity, residual toner remaining on the photosensitive member without transfer is cleaned by various methods. The above steps are repeated for successive image formation.

For complying with varying market demands in recent years, such as complex functions and personal use, such an image forming system or apparatus is severely required to be smaller in size and lighter in weight, and exhibit higher speed and higher reliability. As a result, a toner used therein is required to exhibit further higher performances.

For example, as means for fixing a toner image onto a transfer(-receiving) sheet such as paper, various systems or devices have been developed including a heat-pressure fixing system using heating rollers as a currently most popular one. In the heat-pressure fixing system using hot rollers, a fixation sheet carrying a toner image is caused to pass over and in contact with a heating roller surfaced with a material exhibiting a releasability to a toner thereby fixing the toner image onto the fixation sheet. In this fixation scheme, as the heating roller surface and the toner image on the fixation sheet contact each other, a very good heat efficiency is attained for malt-attaching the toner image onto the fixation sheet to afford quick fixation.

In the heating roller fixation scheme frequently used heretofore, however, in order to obviate a fixation failure caused by a temperature change of the heating roller due to passage of fixation sheets and other external factors and also the so-called offset phenomenon of the toner being transferred onto the heating roller, it is necessary to maintain the heating roller within an optimum temperature range, thus requiring an increased heat capacity of the heating roller which leads to a larger power consumption, an increase in size of image forming apparatus and a temperature increase in the apparatus.

Accordingly, various means have been proposed heretofore for the purpose of preventing toner attachment onto the fixing roller surface or improving the low-temperature fixing performance. For example, it has been practiced to form a roller surface of a material exhibiting good releasability to a toner, such as silicone rubber or fluorine-containing resin and coat the roller surface with a liquid (offset preventing liquid) exhibiting good releasability, such as silicone oil, for the purpose of preventing offset and fatigue of the roller surface material. This method is very effective for the prevention of toner offset but requires a device for supplying the offset-preventing liquid, thus still involving a problem of requiring a complicated fixing device leading to an increase in size of the entire apparatus.

Accordingly, the realization of an effective fixing method which can also accomplish good fixation of toner image onto transfer sheets and offset prevention, owes very much to improvement in toner performances in addition to improvements in fixing devices as mentioned above.

In other words, for the purpose of offset prevention, it is desired to develop a toner exhibiting a broad fixable temperature range and good anti-offset characteristic rather than relying on the supply of an offset-preventing liquid. From this viewpoint, it has been practiced to increase the releasability of the toner per se by adding a waxy material, such as low-molecular weight polyethylene or low-molecular weight polypropylene, capable of sufficiently melting under heating. This is effective for offset prevention but on the other hand results in increased agglomeratability and unstable chargeability of the toner, thus being liable to cause a lowering in developing performance during continuous image formation. Accordingly, various trials have been made in order to improve the binder resin performances as another approach.

For example, it is known to increase the glass transition temperature (Tg) or molecular weight of the binder resin in the toner so as to increase the melt viscoelasticities of the toner in order to prevent the offset. In the case of improving the anti-offset characteristic according to this method, however, the fixability is liable to be lowered while the developing performance is not so much adversely affected, thus resulting in lowering in fixability at low temperatures as required in high-speed fixation or economization of energy consumption, i.e., inferior low-temperature fixability.

In order to improve the. low-temperature fixability of a toner, it is necessary to lower the melt-viscosity of the toner thereby increasing the contact area with the fixation sheet, so that the binder resin used for this purpose is required to have a lower Tg or lower molecular weight.

As is understood from the above, the low-temperature fixability and the anti-offset characteristic are contradictory in some respects, so that it is difficult to develop a toner simultaneously satisfying these properties.

For solving the above problem, Japanese Patent Publication (JP-B) 51-23354 has disclosed a toner comprising a moderately crosslinked vinyl polymer through use of a crosslinking agent and a molecular weight-adjusting agent. In addition, there have been proposed many toners comprising blends of vinyl polymers having various Tg, molecular weights and gel contents.

Such a toner comprising a crosslinked vinyl polymer or gel content exhibits excellent anti-offset characteristic. However, in the case of using a crosslinked vinyl polymer as a starting material for providing a toner containing such a component, the polymer causes a very large internal friction and receives a large shearing force during the melt-kneading stop for toner production. For this reason, the molecular chains are severed in many cases to result in a toner having a lower melt-viscosity, which adversely affects the anti-offset performance.

For solving the above problem, Japanese Laid-Open Patent Application (JP-A) 55-90509, JP-A 57-178249, JP-A 57-178250 and JP-A 60-4946 have proposed toners containing a crosslinked polymer formed by using a carboxyl acid-containing group and a metal as toner starting materials and reacting these materials under heating during the melt-kneading JP-A 61-110155 and JP-A 61-110156 have disclosed a reaction of a binder comprising a vinyl resin monomer and a special monoerter compound as essential components with a polyvalent metal compound to form crosslinkages via the metal.

JP-A 63-214760, JP-A 63-217362, JP-A 63-217363 and JP-A 63-217364 disclose a toner composition comprising a binder resin including a low-molecular weight fraction containing a carboxyl group, a high-molecular weight fraction and a polyvalent metal ion forming a crosslinkage with the carboxylic group formed by adding a dispersion liquid of a metal compound to a solution product of solution polymerization to cause the crosslinking reaction under heating.

JP-A 2-168264, JP-A 2-235069, JP-A 5-173363, JP-A 5-173366 and JP-A 5-241731 disclose a toner binder composition containing a low-molecular weight component and a high-molecular weight component having specified molecular weights, mixing proportions, acid values and ratios thereof to provide a toner having improved fixability and anti-offset characteristic.

JP-A 62-9256 discloses a toner binder comprising two types of vinyl polymers having mutually different molecular weights and acid values.

JP-A 3-63661, JP-A 3-63662, JP-A 3-63663, JP-A 3-118552 and JP-A 11-282198 (corr. to EP-A 0926565) disclose a crosslinked composition formed by reacting a carboxyl group-containing vinyl copolymer, a glycidyl group-containing vinyl copolymer and a metal compound.

JP-A 62-194260, JF-A 6-11890, JP-A 6-222612, JP-A 7-20654, JP-A 9-185182, JP-A 9-244295, JP-A 9-319410, JP-A 10-87837 and JP-A 10-90943 disclose a resin composition comprising a glycidyl group-containing resin as a crosslinking agent and a carboxyl group-containing resin having controlled molecular weight distribution, gel content, acid value and epoxy value to provide a toner having improved fixability and anti-offset characteristic.

The above proposals are actually effective for improving the anti-offset characteristic while they have own advantages and disadvantages. However, these proposals disclose binder resins into which an acid group has been introduced, so that they impart a negative chargeability while they are different in degree. As a result, if these proposals are applied to production of a positively chargeable toner, the chargeability of the toner is liable to be impaired at the time of startup or continuous operation or in a high-humidity or low-humidity environment, thus inviting lowering in developing performance leading to lower image density and fog. Further, the agglomeratability is liable to be increased due to difficulty in stably retaining appropriate charges, thus causing difficulties, such as melt-sticking, cleaning failure and plugging in the cleaning step, and leakage spots. Thus, they have not yet provided satisfactory results.

Further, the above proposals are effective in remarkably improving the balance among fixability, anti-offset characteristic and anti-blocking property, but the developing performance and the mechanical strength of the resultant toners are yet insufficient, and a room for improvement in continuous image forming performance, anti-offset property and anti-blocking property, has been left, when used in an electrophotographic apparatus of a large printing volume. Further, a room for improvement is also left in anti-offset characteristic for use in a fixing device not equipped with cleaning web or in a high-speed machine.

On the other hand, a toner is required to have a charge of a positive or negative polarity corresponding to the charge polarity of electrostatic latent image to be developed, and it has been known to add a dye, pigment or charge control agent for this purpose. As examples of positive charge control agent among these, there have been known quaternary ammonium salts and lake pigments thereof, polymers having a tertiary amino group or quaternary ammonium salt group in their side chains, triphenylmethane dyes and lake pigments thereof, nigrosine and modified products thereof with fatty acid metal salts, etc.

However, these positive charge control agents are liable to have difficulties, such as insufficient chargeability to toner, or excessive or ununiform chargeability to toner leading to occurrence of blotches or increased toner agglomeratability, and lowering in developing performance such as image density lowering and fog, even if a sufficient charge can be provided to the toner. This tendency is noticeable especially in a positively chargeable toner having an acid value. Another difficulty is the occurrence of sleeve soiling caused by sticking of the charge control agent liberated from the toner onto a sleeve as a developer-carrying member.

On the other hand, there is a problem as to how to stably retain an appropriate level of charge for a long period in the case of triboelectrically charging a toner in contact with a sleeve as a developer-carrying member.

As a developing sleeve in an image forming apparatus according to electrophotography, one of a cylindrical form of a metal, alloy or metal compound with a surface roughness by a treatment, such as electrolytic etching, blasting, filing, etc. As sleeve materials, stainless steel, aluminum and nickel have been used generally and frequently.

However, in the case of using such a sleeve for triboelectrically charging a conventional positively chargeable toner using a charge control agent, it is difficult to affect a toner charge control. For example, in the case of using a stainless steel-made sleeve having a strong charge-imparting ability, a portion of toner in proximity to the sleeve surface is caused to have a very high charge to be strongly attracted to the sleeve surface by the image force, thus forming an immobile layer. As a result, the opportunity of contact between the toner and the sleeve is decreased as a whole, so that appropriate charging is hindered, whereby there are liable to occur difficulties such as ununiform charges or excessive charge of toner resulting in blotches, thus naturally lowering the developing performances.

In the case of using an aluminum-made sleeve, a high charge-imparting ability to a positively chargeable toner is exhibited, but the sleeve is liable to be insufficient in durability because of the softness of the material and result in image deterioration due to surface wearing. Accordingly, it has been also practiced to coat the aluminum sleeve surface with a metal as by plating. This provides a better durability due to an increased surface hardness, but such coated aluminum sleeve have a lower charge-imparting ability to a positively chargeable toner in many cases than a stainless steel-made sleeve, thus being liable to cause toner charging failure.

A resin-coated sleeve is also known and exhibits good durability, but the charge-imparting ability thereof to toners is restricted. More specifically, it is widely applicable for imparting negative charges but is liable to provide only insufficient level of positive charges, especially for a toner comprising an acid group-containing binder resin.

For solving the problem, JP-A 11-72970 (corr. to EP-A 0889368) has proposed a positively chargeable toner including a binder resin comprising a styrene copolymer and an acid value of 0.5–50 mgKOH/g, and also a specific imidazole derivative as a charge control agent. However, the toner has left a room for further improvement in fixing performances.

SUMMARY OF THE INVENTION

A generic object of the present invention is to provide a positively chargeable toner having solved the above-mentioned problems.

A more specific object of the present invention is to provide a positively chargeable toner with further improved fixability, anti-offset property and anti-blocking property.

Another object of the present invention is to provide a positively chargeable toner capable of forming a blotch-free uniform toner coating layer and exhibiting stable cleanability.

Another object of the present invention is to provide a positively chargeable toner exhibiting high continuous image performances including capability of providing stably high image densities and low fog, and thus capable of stably providing good image characteristics for a long period.

According to the present invention, there is provided a positively chargeable toner, comprising: a binder resin, an imidazole compound and a colorant; wherein the binder resin comprises at least one member selected from the group consisting of (i) a mixture of a vinyl resin having a carboxyl group and a vinyl resin having a glycidyl group, (ii) a vinyl resin having both a carboxyl group and a glycidyl group, and (iii) a vinyl resin (or vinyl resins) having a carboxyl group and a glycidyl group in a form reacted with each other, and the imidazole compound is a compound having an imidazole unit represented by formula (1) below:

(1)

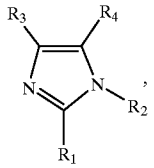

wherein $R_1$, $R_3$ and $R_4$ independently denote hydrogen, an alkyl group capable of having a substituent, an aryl group capable of having a substituent, an aralkyl group capable of having a substituent, an amino group capable of having a substituent; and $R_2$ denotes hydrogen, an alkyl group capable of having a substituent, or a heterocyclic group capable of having a substituent with the proviso that two or more imidazole units can be combined with each other via two of the groups $R_1$, $R_2$, $R_3$ and $R_4$ and an intervening bonding group selected from the group consisting of phenylene group, propenylene group, vinylene group, alkenylene group and alkylene group each capable of having a substituent; and that $R_3$ and $R_4$ can be bonded to each other to form a saturated aliphatic ring, an unsaturated aliphatic ring, an aromatic ring or a heterocyclic ring.

The present invention also provides an image forming method, comprising the steps of:

forming an electrostatic latent image on an image-bearing member, and developing the electrostatic latent image with a mono-component developer comprising the above-mentioned positively chargeable toner carried on and conveyed by a developer-carrying member; and an image forming apparatus, comprising:

an image-bearing member, a latent image forming means for forming an electrostatic latent image on the image-bearing member, and a developing means comprising a developer-carrying member for carrying and conveying thereon a mono-component developer comprising the above-mentioned positively chargeable toner to develop the electrostatic latent image.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
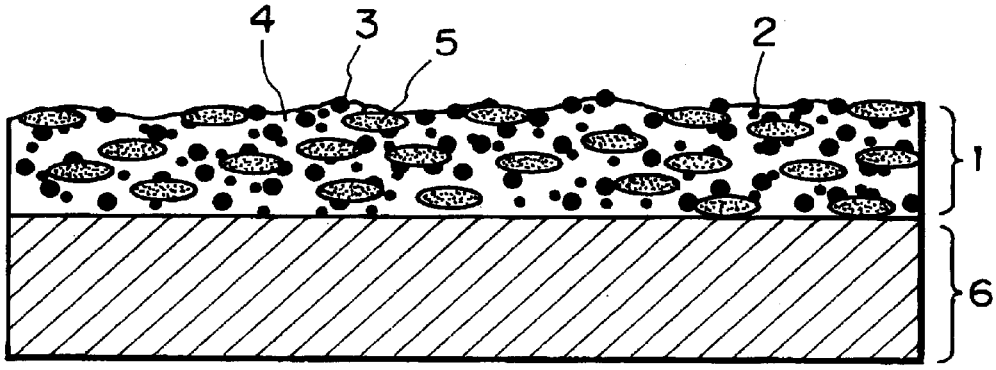
FIG. 1 is a partial sectional view of a developer-carrying member used in the invention.

According to our study, it has become clear that a positively chargeable toner comprising at least a binder resin and an imidazole compound is provided with good anti-offset property and anti-blocking property without adversely affecting the chargeability and powder characteristics of the toner if a specific imidazole compound is selected and the binder resin comprises at least one member selected from the group consisting of a mixture of a vinyl resin having a carboxyl group and a vinyl resin having a glycidyl group, a vinyl resin having both a carboxyl group and a glycidyl group, and a vinyl resin (in a sense of including plural vinyl resins) having a carboxyl group and a glycidyl group in a form reacted with each other. The toner exhibits an excellent level of chargeability and thus developing performance stably or a long period when used in combination with a resin-surfaced developing sleeve for triboelectrically charging the toner. Further, as the positively chargeable toner exhibits excellent chargeability and powder characteristics, the cleaning step using the toner can be free from difficulties, such as melt-sticking onto the photosensitive member and occurrence of leakage spots attributable to excessive toner charge, and melt-sticking, cleaning failure and toner plugging during conveyance due to agglomeratability and deterioration in flowability of toner due to agglomeratability and deterioration in flowability of the toner.

The above effects are enhanced especially when the toner binder resin component has a specific range of acid value, when the binder resin contains a THF (tetrahydrofuran)-soluble content having a specific molecular weight distribution according to GPC (gel permeation chromatography) or when the binder resin contains a specific level of THF-insoluble content.

As mentioned above, a toner comprising the above-mentioned specific vinyl resin and an imidazole compound of the formula (1) has been found to exhibit an excellent positive triboelectric chargeability while suppressing an excessive charge thereof.

The mechanism of excessive toner charge suppression according to the present invention has not been fully clarified as yet, but may be attributable to some interaction of the imidazole compound with a resin having a carboxyl group and a glycidyl group possibly in a mutually reacted form or a hydroxyl group occurring as a result of the reaction between the carboxyl group and the glycidyl group. Such a stable chargeability is attained even when a stainless steel-made sleeve is used, thus suppressing the occurrence of blotches. In the cleaning step, it becomes possible to obviate difficulties, such as melt-sticking onto the photosensitive member and occurrence of leakage spots attributable to excessive toner charge, and melt-sticking, cleaning failure and toner plugging during conveyance due to agglomeratability and deterioration in flowability of toner due to agglomeratability and deterioration in flowability of the toner, and also plugging due to deterioration of conveyability.

The toner according to the present invention containing an imidazole compound represented by the formula (1) causes little fluctuation in chargeability over a wide range of environmental conditions ranging from a high humidity environment to a low humidity environment, thus retaining stable developing performances. Moreover, the imidazole compound is less liable to be liberated from the toner due to the use of the binder resin having a glycidyl group and a carboxyl group possibly in a mutually reacted form, thus suppressing the sleeve soiling. More specifically, this may be attributable to a mutual interaction between a secondary amine group in the imidazole compound, and carboxyl, epoxide and hydroxyl groups contained in the binder resin.

The toner according to the present invention exhibits good triboelectric chargeability when used in combination with a developer-carrying member comprising an ordinary material, such as stainless steel, aluminum or metal-plated body, but exhibits especially excellent chargeability when used together with a surface resin-coated developer-carrying member.

A toner containing a conventional positive charge control agent, such as nigrosine, is known to exhibit good positive chargeability in contact with stainless steel. The toner however shows somewhat lower positive chargeability in contact with a developer carrying member having a resinous surface layer (e.g., a carbon black-dispersed resin layer) and shows a further lower chargeability when the binder resin has a carboxyl group. Moreover, the toner is liable to cause the liberation of the charge control agent, which sticks onto the surface of a sleeve as a developer-carrying member, thus causing sleeve soiling.

In contact thereto, the toner containing a specific imidazole compound of the present invention though exhibits good chargeability even in contact with stainless steel but exhibits better chargeability in contact with a resin-surfaced developer-carrying member. This tendency is enhanced when the binder resin has a carboxyl group, and the resultant toner exhibits much higher chargeability than in contact with a stainless steel-surfaced developer-carrying member.

Thus, the toner according to the present invention exhibits improved developing performances and provides high-quality images having high image density and little fog.

The toner according to the present invention exhibits the above-mentioned effects when produced through a toner production process including a kneading step wherein the binder resin causes a crosslinking reaction when malt-kneaded under heating. Due to the copresence of a copolymer having a carboxyl group unit, a copolymer having a glycidyl group unit and an imidazole compound in the binder resin, the imidazole compound is caused to function as a crosslinking catalyst to promote a crosslinking reaction between the carboxyl group unit and the glycidyl group unit in the binder resin under melt kneading to generate a crosslinked resin component exhibiting the anti-offset effect. As the crosslinking reaction between the carboxyl group unit and the glycidyl group unit is caused from a low temperature range, the kneading temperature in the hot-melt-kneading step in toner production can be set at a broad latitude, whereby the degree of the crosslinking can be controlled so as to provide the toner with optimum visco-elasticity characteristics.

Further, as a result of the reaction or mutual interaction among the imidazole unit, carboxyl unit, epoxide unit and hydroxy unit, the entire chargeability of the resultant toner can be stabilized. Further, as the charge-stabilizing effect of the imidazole unit is stabilized, the positively chargeable toner can be provided with a good positive chargeability when the imidazole compound is added in an amount sufficient to function as a positive charge control agent. Further, it has become possible to obviate adverse chargeability effects, such as excessive charge or charge liberation, of the carboxyl unit, epoxide unit and hydroxide unit, especially in a positively chargeable toner.

As a result of reaction between only a copolymer having a carboxyl group unit and a copolymer having a glycidyl group unit, the anti-offset property and anti-blocking property are exhibited effectively without adversely affecting the fixability. Improved effects are also attained in the fixing step, such that even a toner fraction transferred onto the fixing roller can be easily removed with a cleaning member, such as a web, and the re-transfer of the cleaned toner onto the fixing roller is less liable to occur. As the toner offset onto the fixing roller is less liable to occur, the cleaning member, such as a web, can be omitted in some cases. Securely fixed images are formed, thus preventing the separation of toner images or a fraction thereof from the fixation sheet.

It has been conventionally performed to effect a crosslinking reaction by using a carboxyl group unit and a metal compound as crosslinking agents, but the resultant crosslinked unit exhibits negative chargeability, thus obstructing the positive chargeability when used in a positively chargeable toner. In the present invention, however, the crosslinked unit formed by crosslinking of a carboxyl group unit in the presence of an imidazole compound provides desired properties due to the crosslinkage without obstructing the positive chargeability. Further, the imidazole compound can be also used as a positive charge control agent so as to provide both good developing performance based on a positive chargeability and fixing performance-improving effects owing to the crosslinking.

Thus, compared with a reaction between only a carboxyl group-containing resin and a glycidyl group-containing resin, or such a reaction with further use of a metal compound, the reaction used in the present invention provides a better balance between the fixability and anti-offset property more effectively.

The THF-soluble content of the toner according to the present invention may preferably have an acid value of 0.1–50 mgKOH/g, more preferably 0.5–50 mgKOH/g, particularly preferably 0.5–40 mgKOH/g. By having a desired acid value of the THF-soluble content, the toner according to the present invention can exhibit better developing performance, sleeve soiling preventing effect and an effect of preventing soiling of a heating member, such as a fixing roller.

Particularly, in order to better attain the effects of preventing the soiling of heating members, such as a fixing roller, enhancing the image density, and preventing fog without adversely affecting the positive chargeability of the toner, the THF-soluble content of the toner may preferably have an acid value of 0.5–30 mgKOH/g, more preferably 0.5–25 mgKOH/g, further preferably 0.5–20 mgKOH/g.

In case where the toner binder resin has an acid value below 0.1 mgKOH/g, the resultant toner is liable to show a lower fixability, and lower effects of developing performance-stabilizing effect and sleeve soiling preventing effect owing to a reaction with the imidazole compound. If the acid value exceeds 50 mgKOH, the resultant positive chargeable toner is liable to have unstable developing performance in continuous image formation due to a substantial negative chargeability of the binder resin.

In case where the carboxyl group and the glycidyl group have been reacted, the acid value of the binder resin can be decreased or even lost due to the decrease of the carboxyl group. In this vase, however, similar effects a above can be expected due to the presence of hydroxyl group formed by the reaction.

In case where the THF-soluble content of the toner has an acid value below 0.5 mgKOH/g, it becomes difficult to attain the effect of preventing soiling of heating members, such as a fixing roller, in some cases, and in excess of 30 mgKOH/g, the binder resin in the toner particles is caused to have a rather strong negative chargeability, thus being liable to result in a lower image density and increased fog, in the case of a positively chargeable toner.

In the toner of the present invention, it is preferred for the THF-soluble content to have a molecular weight distribution according to GPC such that it shows a number-average molecular weight (Mn) of $10^3$–$4\times10^4$, more preferably $2\times10^3$–$2\times10^4$, particularly preferably $3\times10^3$–$1.5\times10^4$, and a weight-average molecular weight (Mw) of $10^4$–$10^7$, more preferably $2\times10^4$–$5\times10^6$, particularly preferably $3\times10^4$–$10^6$.

By satisfying the above-mentioned molecular weight distribution based on the GPC chromatogram, the toner can exhibit a good balance among fixability, anti-offset property and anti-blocking property.

More specifically, if Mn is below $10^3$ or Mw is below $10^4$, the resultant toner is caused to have inferior anti-blocking property. If Mn exceeds $4\times10^4$ or Mw exceeds $10^7$, it is difficult to attain a sufficiently improved fixability.

In the toner of the present invention, the THF-soluble content may preferably exhibit a molecular weight distribution on OPC chromatograph as to show a main peak or peak molecular weight (Mp) in a molecular weight region of $4\times10^3$–$3\times10^4$, preferably $5\times10^3$–$2\times10^4$ so as to improve the fixability, anti-offset property and anti-blocking property in combination.

If Mp is below $4\times10^3$, the anti-blocking property is liable to be inferior, and above $3\times10^4$, the fixability is liable to be lowered.

Based on the GPC chromatogram, the THF-soluble content exhibits a peak area in a molecular weight region of at most 30,000 in a proportion of 60–100%, more preferably 70–100%, particularly preferably 75–100%, with respect to the total peak area. If the peak area in the molecular weight region of at most 30,000 is below 60%, it becomes difficult to attain an excellent fixability-improving effect particularly in a fixing device applying a relatively low fixing pressure.

Further, based on the GPC chromatogram, the THF-soluble content may preferably exhibit a molecular weight distribution such as to provide at least one peak each in a molecular weight region of $4\times10^3$–$3\times10^4$ and a molecular weight region of $10^5$–$10^7$, more preferably at least one peak each in a molecular weight region of $5\times10^3$–$2\times10^4$ and a molecular weight region of $8\times10^5$–$10^7$, further preferably at least one peak each in a molecular weight region of $4\times10^3$–$3\times10^4$, a molecular weight region of $10^5$ to below $8\times10^5$ and a molecular weight region of $8\times10^5$–$10^7$.

If the VHF-soluble content has a molecular weight distribution peak profile as described above based on its GPC chromatogram, it is possible to improve the fixability, anti-offset property and anti-blocking property in combination. This effect is particularly remarkable in a high-speed image forming machine.

Having at least one peak in a molecular weight region of $4\times10^3$–$3\times10^4$ is effective for accomplishing good fixability and anti-blocking property. In case where a peak is not present in the molecular weight region of $4\times10^3$–$3\times10^4$, the anti-blocking property is liable to be impaired if a peak is present in a molecular weight region of below $4\times10^3$, and it becomes difficult to attain good fixability if a peak is present in a molecular weight region of above $3\times10^4$. Having at least one peak in a molecular weight region of $10^5$–$10^7$ is effective for accomplishing good anti-offset characteristic. In case where no peak is present in the molecular weight region of $10^5$–$10^7$, the anti-offset property is lowered if a peak is present in a molecular weight region of below $10^5$, and the fixability is lowered if a peak is present in a molecular weight region of above $10^7$.

It is further preferred that the peak area in a molecular weight region of at least $10^5$ occupies 5–40% of the entire peak area. If the peak area ratio is below 5%, the fixed toner image is liable to be peeled from a transparency film as a fixation sheet. Above 40%, the realization of excellent fixability is liable to be difficult. Herein, the entire peak area refers to a peak area in a molecular weight region of at least 800.

It is preferred that the peak in the molecular region of $4\times10^3$–$3\times10^4$ is a largest peak (main peak) in order to provide an improved fixability.

A sub-peak in the molecular weight region of $8\times10^5$–$10^7$ is provided by a component formed by crosslinking of the binder resin and is effective for improving the anti-offset property. Further, having a peak in a molecular weight region of $10^5$ to below $8\times10^5$ is effective for improving the dispersion in the toner of the component in the molecular weight range of $4\times10^3$–$3\times10^4$ and the component in the molecular weight range of $8\times10^5$–$10^7$ and THF-insoluble content having a large melt-viscosity difference therebetween, to provide a good developing performance and fixability under various conditions.

The resin content in the toner according to the present invention can contain 0.1–60 wt. % of THF-insoluble ratter, so as to improve the anti-offset property.

If the THF-insoluble content in the toner binder resin is 5–60 wt. %, good releasability from a heating member, such as a fixing roller is exhibited. Particularly, in the case where the toner is used in an apparatus equipped with a hot roller fixing device, the offset toner amount onto the heating members, such as the fixing roller and pressure roller, is remarkably reduced to a level of causing substantially no soiling so that a web as a cleaning member therefor need not be equipped to realize a cleaner-less fixing device. Based on these features, the toner is also applicable to the so-called surf-fixing system that is a heat-fixing system for heating a toner image with a film and not equipped with a cleaning web. The fixed toner image exhibits a good releasability from the fixing roller, whereby the jamming of a fixation sheet due to a separation failure after fixation can be obviated even if the image comes to the leading edge of the fixation sheet. Further, even if the jamming happens to occur at the fixing device and a portion of the toner is attached to the fixing roller or the fixing film, most of the attached toner can be discharged by passing a sheet of fixation sheet therethrough to suppress the back soiling with toner to the minimum.

As mentioned above, it the THF-insoluble content in the toner binder resin is 5–60 wt. %, the fixability and anti-offset property can be improved at a good balance. The THF-insoluble content is more preferably 7–55 wt. %, further preferably 9–5 wt. %, particularly preferably 10–45 wt. %, so as to exhibit a good releasability from a heating member, such as a fixing roller. Particularly, when used in a higher-speed machine, such an appropriate level of THF-content is affective for reducing the offset amount onto the heating member, such as a fixing roller, and reducing the consumption of web as a cleaning member therefor. Further, this is also effective for reducing the back soiling caused by re-transfer of toner from the cleaning member at the re-startup of the apparatus as in the morning of a day.

It the THF-insoluble content is below 5 wt. %, the above effect can be reduced, and in excess of 60 wt. %, not only the fixability can be lowered but also the toner chargeability is liable to be ununiform.

The toner according to the present invention may preferably have a glass transition temperature (Tg) of 50–70° C. If Tg is below 50° C., the toner is liable to have an inferior anti-blocking property, and in excess of 70° C., the fixability is lowered.

The toner according to the present invention may preferably have a storage modulus at 80° C., i.e., G' (80° C.), of $1.0\times10^5$–$2.0\times10^6$ Pa, and a storage modulus at 140° C., i.e., G' (140° C.), of $1.0\times10^3$–$2.0\times10^4$ Pa, so as to exhibit excellent fixability and excellent releasability from the fixing member.

G' (80° C.) (the storage modulus at 80° C.) is related with the thermal behavior of toner on a side of transfer or fixation paper at the time of toner fixation. If G' (80° C.) is in the range of $1.0\times10^5$–$2.0\times10^6$ Pa, the toner can be thermally deformed at a pressure in the fixing device, thus exhibiting a strong anchoring effect onto paper fiber, without adversely affecting the storage stability thereof. As a result, excellent fixability onto rough surface transfer paper can be attained. G' (80° C.) is more preferably $1.0\times10^5$–$8.0\times10^5$ Pa, further preferably $1.0\times10^5$–$6.0\times10^6$ Pa. If G' (80° C.) exceeds $2.0\times10^6$ Pa, the fixability onto rough paper can be lowered. If G' (80° C.) is below $1.0\times10^5$ Pa, the toner is liable to be thermally deformed easily at a low temperature region, so that the toner is liable to be deteriorated when an internal temperature in an electrophotographic apparatus is increased, thus being liable to cause conveyance failure or caking in the developing device or the cleaner.

G' (140° C.) (the storage modulus at 140° C.) is related with the thermal behavior of the toner on a side of fixing member at the time of toner fixation. If G' (140° C.) is in the range of $1.0\times10^3$–$2.0\times10^4$ Pa, the toner exhibits excellent releasability to promote the separation of a fixed toner image from the fixing member, thus exhibiting the effects of improved anti-offset property, prevention of transfer sheet winding and prevention of fixing member soiling. G' (140° C.) is more preferably $2.0\times10^3$–$1.0\times10^4$ Pa, further preferably $3.0\times10^3$–$9.0\times10^3$ Pa. If G' (140° C.) exceeds $1.0\times10^4$ Pa, the thermal deformation of the toner can be insufficient to adversely affect the fixability. If G' (140° C.) is below $1.0\times10^3$ Pa, the toner is liable to exhibit insufficient releasability, thus being liable to cause difficulties, such as offset, paper back soiling, winding, fixation claw trace, and fixing masher soiling.

The toner according to the present invention may preferably exhibit a loss tangent tan δ (=loss modulus (G")/storage modulus (G')) of 1 in a temperature range of 90–130° C., preferably 95–125° C., a loss tangent at 80° C. (i.e., tan δ (80° C.)) larger than 1 and a loss tangent at 140° C. (i.e., tan δ (140° C.)) smaller than 1, so as to provide the fixability and the releasability from the fixing member in combination. By satisfying the above requirements in combination, it becomes possible to attain a good balance between the toner behavior on the fixing member side and the toner behavior on the transfer sheet side at the time of toner fixation, thus providing a combination of thermal deformability and releasability, i.e., excellent fixability and anti-offset property. Further, as the fixing member is free from soiling, it is possible to attain excellent fixing performance for a long period without exchanging the fixing member.

The visco-elasticities at 80° C. are related with the thermal behavior of toner on the transfer sheet side at the time of fixation, and tan δ (80° C.) larger than 1, preferably larger than 1.1, makes dominant the irreversible thermal deformation, thus advantageously affecting the improvement in fixability. The viscoelasticities at 140° C. are related with the thermal behavior on the fixing member side, and tan δ (140° C.) smaller than 1, preferably smaller than 0.9, makes dominant the reversible thermal deformation, thus advantageously affecting the improvement in releasability. The presence of temperature giving tan δ=1 in a temperature region of 90–130° C., preferably 95–125° C., more preferably 100–120° C., provides a good balance between contradictory thermal deformations on the transfer sheet side and the fixing member side, providing a good compromise between the thermal deformation for improving the fixability and the thermal deformation for improving the releasability.

If the temperature giving tan δ=1 is below 90° C. or tan δ (80° C.) is below 1, the contribution of irreversible deformation is liable to be lowered, thus adversely affecting the fixability. On the other hand, if the temperature giving tan δ=1 exceeds 130° C. or tan δ (140° C.) is larger than 1, the contribution of reversible deformation is liable to be lowered, thus lowering the releasability to adversely affect the anti-offset property and the peelability of transfer sheet from the fixing member.

The above-mentioned viscoelasticities of the toner according to the present invention are accomplished when the carboxyl group unit and the glycidyl group unit in the binder resin are crosslinked to each other with the aid of the imidazole compound and not accomplished if the carboxyl group unit and the glycidyl group unit are not yet reacted with each other.

Accordingly, the satisfaction of the above-mentioned visco-elasticities by the toner according to the present invention provides an indirect indication that the carboxyl group unit and the glycidyl group unit of the binder resin(s) in the toner have been subjected to an appropriate degree of crosslinking with the aid of the imidazole compound.

The molecular weight distribution of THF-soluble contents of toners or binder resin described herein are based on GPC measurement performed according to the following manner.

<Molecular weight distribution measurement by GPC>

In the GPC apparatus, a column is stabilized in a heat chamber at 40° C., tetrahydrofuran (THF) solvent is caused to flow through the column at that temperature at a rate of 1 ml/min, and about 100 μl of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK quadcoluin available from Toso K.K.

The GPC sample may be prepared as follows.

A resinous sample is placed in THF and left standing for several hours (e.g., 5–6 hours). Then, the mixture is sufficiently shaken until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.2–0.5 μm (e.g., "Maishoridisk H-25-5", available from Toso K.K.) to recover the filtrate as a GPC sample. The sample concentration is adjusted to provide a resin concentration within the range of 0.5–5 mg/ml.

The THF-insoluble content of a toner or a starting binder resin is measured in the following manner.

<Measurement of THF-insoluble content>

Ca. 0.5–1.0 g of a sample is weighed (at $W_1$ g), placed in a cylindrical filter (e.g., "No. 86R", available from Toyo Roshi K.K.) and then subjected to extraction with 200 ml of solvent THF in a Soxhlet's extractor for 12 hours. The solvent is evaporated from the extract solution to leave a THF-soluble resin content, which is dried under vacuum at 100° C. for several hours and then weighed (at $W_2$ g). The weight of components, such as a magnetic material or a pigment, other than the resinous component is determined (at $W_3$ g). THF-insoluble content ($THF_{ins.}$) is calculated as follows:

$$THF_{ins.}(\text{wt. }\%)=[W_1-(W_2+W_3)]/(W_1-W_3)\times 100.$$

The acid value (JIS-acid value) of a THF-soluble content of a toner or a binder resin is measured in the following manner according to JIS K-0070. The acid value of a binder resin means that of a THF-soluble content of the binder resin, <Measurement of acid values>

1) An acid value measurement range is prepared by the THF-insoluble content from a sample toner or binder resin or by recovering the THF-soluble resin content ($W_{28}$) obtained after Soxhlet's extraction in the above-measurement of the THF-insoluble content. Then, 0.5–2.0 g of the sample in a pulverized form is accurately weighed to provide a weight W (g) of the soluble content.

2) The sample is placed in a 300-ml beaker, and 150 ml of a toluene/ethanol (4/1) mixture liquid is added thereto to dissolve the sample.

3) The sample solution is (automatically) titrated with a 0.1 mol/liter-KOH solution in ethanol by means of a potentiometric titration apparatus (e.g., "AT-400 (win workstation)" with an "ABP-410" electromotive buret, available from Kyoto Denshi K.K.).

4) The amount of the KOH solution used for the titration is recorded at S (ml), and the amount of the KOH solution used for a blank titration is measured and recorded at B (ml).

5) The acid value is calculated according to the following equation:

$$\text{Acid value (mgKOH/g)}=\{(S-B)\times f\times 561\}/W,$$

wherein f denotes a factor of the 0.1 mol/liter-KOH solution.

Visco-elastic properties described herein are based on values measured under the following conditions.

Apparatus: Rheometer RDA-II type (available from Rheometrics Co.)

Sample holder: Parallel plates having a diameter of 79 mm.

Sample: A toner or a binder resin is heat-molded into a disk of ca. 8 mm in diameter and 2–5 mm in height.

Measurement frequency: 6.28 rad/sec.

Setting of measurement strain: Initially set to 0.1%, followed by measurement in an automatic measurement node.

Correction of sample elongation: Adjusted in an automatic measurement mode.

Measurement temperatures: From 40° C. to 180° C. at a temperature-increasing rate of 2° C./min.

Figure 6:
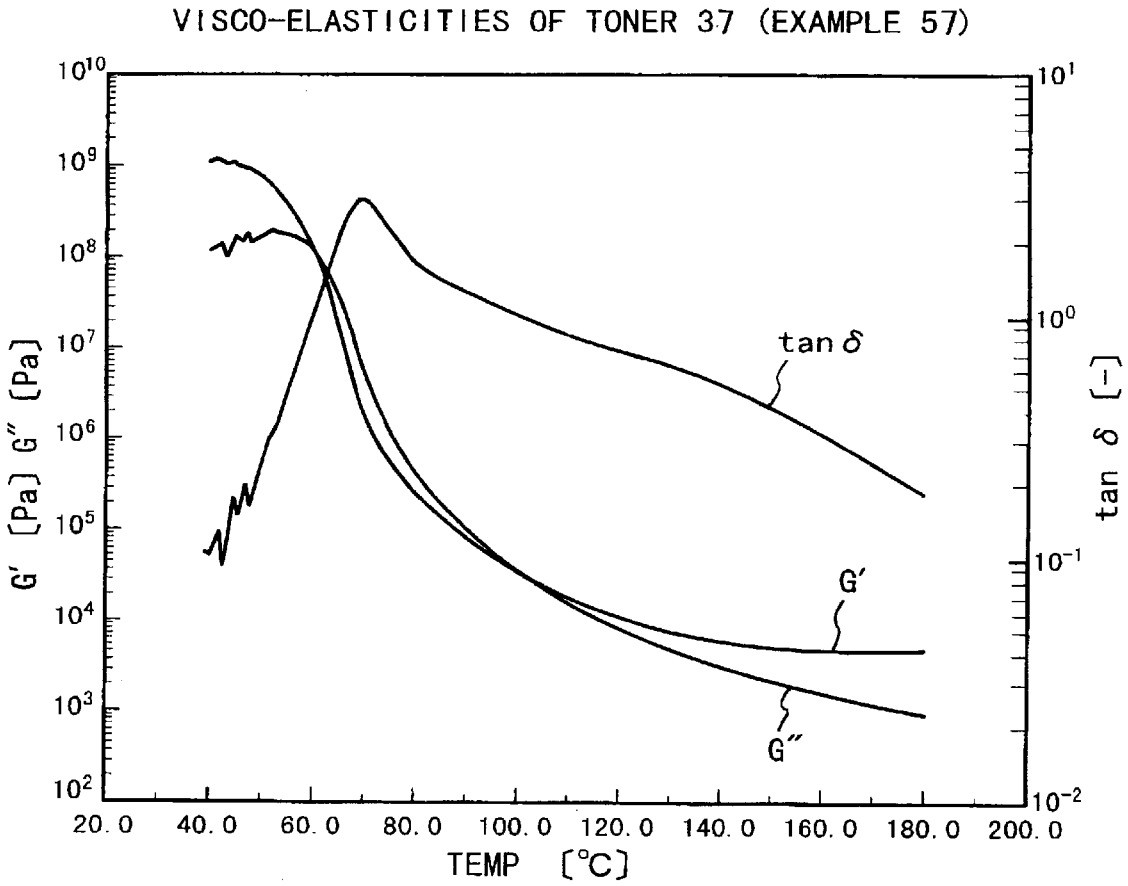
FIG. 6 is a graph showing visco-elasticities of Toner 37 used in Example 57 described hereinafter.

An example of the measured results for a toner of the present invention (Toner 37: EXAMPLE 57) is shown in FIG. 6.

The glass transition temperatures of toners referred to herein are based on values measured in the following manner.

<Measurement of glass transition temperature of toners>

The values of Tg of toners referred herein are based on values measured by using a differential scanning calorimeter ("DSC-7", mfd. by Perkin-Elmer Corp.) according to ASTM D3418-82.

A sample is accurately weighed in an amount of 5–20 g, preferably 10 mg, and placed in an aluminum pan. The measurement is performed by using a blank aluminum pan as a reference at a temperature-raising rate of 10° C./min. in a temperature range of 30–200° C. in a normal temperature/normal humidity environment to obtain a DSC curve. During the temperature increase, a specific heat change occurs An intermediate line is drawn between two base lines before and after the occurrence of the specific heat change to determine an intersection with the DSC curve. The temperature at the intersection is taken as the glass transition temperature (Tg) of the sample toner.

The toner according to the present invention contains a mixture of a vinyl resin having a carboxyl group and a vinyl resin having a glycidyl group; a vinyl resin having both a carboxyl group and a glycidyl group; or a vinyl resin or vinyl resins having a carboxyl group and a glycidyl group in a form reacted with each other.

Examples of monomers having a carboxyl group unit for providing such a vinyl resin having a carboxyl group may include: unsaturated monocarboxylic acids, such as acrylic acid, methacrylic acid, α-ethylacrylic acid, crotonic acid, cinnamic acid, vinylacetic acid, isocrotonic acid, tiglic acid and angelic acid, and their α- or β-alkyl derivatives; and unsaturated dicarboxylic acids, such as fumaric acid, maleic acid, citraconic acid, alkenylsuccinic acid, itaconic acid, mesaconic acid, dimethyl naleic acid and dimethyl faniaric acid, and their monoester derivatives, anhydrides, and α- or β-alkyl derivatives.

Such monomers having a carboxyl group may be used singly or in mixture of two or more species for copolymerization with another vinyl monomer according to a known polymerization process to provide the carboxyl group-containing vinyl resin.

The carboxyl group-containing vinyl resin may preferably have an acid value of 0.5–60 mgKOH/g when used as a toner material. Below 0.5 mgKOH/g, the crosslinking reaction sites reactable with the glycidyl group is scarce so that the resultant toner is provided with little crosslinkage to result in a difficulty in realizing good anti-offset property. This difficulty can be alleviated or compensated for by using a vinyl group-containing vinyl resin having a high epoxy value. In excess of 60 mgKOH/g, the resultant positively chargeable toner is liable to result in low image density and increased fog due to a strong negative chargeability of the binder resin contained in the product toner. The carboxyl group-containing vinyl resin may preferably have a glass transition temperature (Tg) of 40–70° C. If Tg is below 40° C., the resultant toner is liable to exhibit inferior anti-blocking property. Above 70° C., the toner is liable to exhibit inferior fixability.

The carboxyl group-containing vinyl resin may preferably have a number-average molecular weight of $10^3$–$4\times10^4$ so as to accomplish a good fixability, and a weight-average molecular weight of $10^4$–$10^7$ so s to accomplish good anti-offset property and good anti-blocking property.

In a preferred embodiment, the carboxyl group-containing vinyl resin may comprises a low-molecular weight component having a peak molecular weight in a range of $4\times10^3$–$3\times10^4$, and also a high-molecular weight component having a peak molecular weight in a range of $10^5$–$10^6$ so as to accomplish good anti-offset property and good anti-blocking property. By including such a low-molecular weight component and a high molecular weight satisfying the above-mentioned molecular weight ranges, it becomes possible to accomplish the low-temperature fixability and the anti-offset property at high degrees in combination.

Further, in order to improve the dispersibility of other toner ingredients, the carboxyl group-containing vinyl resin may preferably have a THF-insoluble content of at most 10 wt. %, more preferably at most 5 wt. %.

Such a high-molecular weight component copolymer may be produced through a polymerization process, such as bulk polymerization, solution polymerization, emulsion polymerization and suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer.

The high-molecular weight polymer component for providing the resin composition may preferably be produced in the presence of a combination of a polyfunctional polymerization initiator and a monofunctional polymerization initiator, as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,1-di-t-butylperoxy-3,3,5-trimethyl-cyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine-3, tris(t-butylperoxy)-triazine, 1,1-di-t-butylperoxycyclohexane, 2,2-di-t-butylperoxybutane, 4,4-di-t-butylperoxyvaleric acid n-butyl aster, di-t-butylperoxyhexahydroterephthalate, di-t-butylperoxyazelate, di-t-butylperoxytrimethyladipate, 2,2-bis-(4,4-di-t-butylperoxycyclohexyl)propane, 2,2-t-butylperoxyoctane and various polymer oxides; and polyfunctional polymerization initiators having both a polymerization-initiating functional group, such as peroxide group, and a polymerizable unsaturation group in one molecule, such as diallylperoxydicarbonate, t-butylperoxymaleic acid, t-butylperoxyallylcarbonate, and t-butylperoxyisopropylfumarate.

Among these, particularly preferred examples may include: 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl) propane, and t-butylperoxyallylcarbonate.

These polyfunctional polymerization initiators may be used in combination with a monofunctional polymerization initiator, preferably one having a 10 hour-haflife temperature (a temperature providing a halflife of 10 hours by decomposition thereof) which is lower than that of the polyfunctional polymerization initiator, so as to provide a toner binder resin satisfying various requirements in combination.

Examples of the monofunctional polymerization initiator may include: organic peroxides, such as benzoyl peroxide, 1,1-di(t-butylperoxy)-3,3,5-trimethylcyclohexane, n-butyl-4,4-di(t-butylperoxy)valerate, dicumyl peroxide, α,α'-bis(t-butylperoxydiisopropyl)benzene, t-butylperoxycumene and di-t-butyl peroxide; and azo and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator.

The above-mentioned polymerization initiators may preferably be used in an amount of 0.05–2 wt. parts per 100 wt. parts of the monomer in view of the efficiency.

On the other hand, the low-molecular weight polymer component within the binder resin, may be produced through a known process. According to the bulk polymerization, however, such a low-molecular weight polymer can be produced by adopting a high polymerization temperature providing an accelerated reaction speed, the reaction cannot be controlled easily. In contrast thereto, according to the solution polymerization process, such a low-molecular weight polymer can be produced under moderate conditions by utilizing the radical chain transfer function of the solvent and by adjusting the polymerization initiator amount or reaction temperature, so that the solution polymerization process is preferred for formation of the low-molecular weight component in the carboxyl group-containing vinyl resin.

The glycidyl group-containing vinyl resin may be obtained by polymerization from a monomer having a vinyl group and a glycidyl (or epoxy) group, examples thereof may include: esters of glycidyl alcohols and unsaturated carboxylic acids, and unsaturated glycidyl ethers; more specifically, glycidyl acrylate, glycidyl mettbacrylatq, β-methylglycidyl acrylate, β-methylglycidyl methacrylate, allyl glycidyl ether, and allyl β-methylglycidyl ether.

It is particularly preferred to use a glycidyl monomer as represented by the following formula (10):

(10)

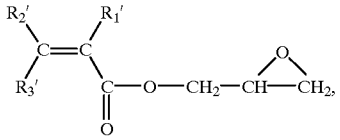

wherein $R_1'$, $R_2'$ and $R_3'$ independently denote hydrogen, an alkyl group, an aryl group, an aralkyl group, a carboxyl group, or an alkoxycarbonyl group.

Such glycidyl monomers may be used singly or in mixture of two or more species for copolymerization with another vinyl monomer according to a known polymerization process to provide the glycidyl group-containing vinyl resin.

The glycidyl group-containing vinyl resin may preferably have a weight-average molecular weight (Mw) of $2\times10^3$–$10^5$, preferably $2\times10^3$–$5\times10^4$, more preferably $3\times10^3$–$4\times10^4$, further preferably $4\times10^3$–$3\times10^4$. In case where Mw is below $2\times10^3$, even it the molecular weight is increased by crosslinking in the binder resin, the molecular chain severance is liable to occur in a subsequent kneading step, thus exhibiting lower effect of improving the anti-offset property. If Mw exceeds $5\times10^4$, particularly $10^5$, the fixability can be adversely affected. The glycidyl group-containing vinyl resin may preferably have a epoxy value of 0.05–5.0 eq/kg. Below 0.05 eq/kg, the crosslinking reaction becomes difficult to result in little high-molecular weight component or THF-insoluble content, thus lowering the anti-offset property-improving effect. Above 5.0 eq/kg, the crosslinking reaction can be easily caused, but the molecular chain severance is liable to occur frequently in a subsequent kneading step, thus lowering the effect of improving the anti-offset property.

Further, the vinyl resin may preferably have a THF-insoluble content of at most 10 wt. %, more preferably at most 5 wt. %, so as to effectively cause the crosslinking reaction.

The glycidyl group-containing vinyl resin may preferably be used in a proportion of providing 0.01–100.0 equivalent, more preferably 0.03–10.0 equivalents, further preferably 0.05–5.0 equivalents of glycidyl group per one equivalent of carboxyl group in the carboxyl group containing vinyl resin.

Below 0.01 equivalent of the glycidyl group, few crosslinking sites are contained in the binder resins, whereby the effects accomplished by crosslinking, such as the anti-offset property-improving effect, become difficult to achieve. In excess of 100 equivalents, the crosslinking reaction may becomes easier but the developing performance can be adversely affected.

The epoxy value of a binder resin may be measured in the following manner according to JIS K-7236.

<Measurement of epoxy value>

(1) A sample is accurately weighed at W (g) in a range of 0.5–2.0 g.

(2) The sample is placed in a 300 ml-beaker and dissolved with a mixture of 10 ml of chloroform and 20 ml of acetic acid.

(3) To the solution, 10 ml of tetraethylammonium bromide-acetic acid solution is added.

(4) The resultant sample solution is (automatically) titrated with a 0.1 mol/l-perchloric acid-acetic acid solution by means of a potentiometric titration apparatus (e.g., "AT-400 (win workstation)" with an "ABP-410" electromotive burst, available from Kyoto Denshi K.K.).

(5) The amount of the perchloric acid-acetic acid solution used for the titration is recorded at S (ml), and the amount of the perchloric acid-acetic acid solution used for a blank titration is measured and recorded at B (ml).

(6) The epoxy value is calculated according to the following equation:

$$\text{Epoxy value (eq/kg)}=0.1\times f\times(S-B)/W,$$

wherein f denotes a factor of the perchloric acid-acetic acid solution.

The vinyl resin having a carboxyl group and a glycidyl group may preferably have a number-average molecular weight (Mw) of $10^3$–$4\times10^4$ so as to accomplish a good fixability, and a weight-average molecular weight (Mw) of $10^4$–$10^6$ so as to accomplish good anti-offset property and good anti-blocking property. By introducing an acid value and an epoxy value as described above to a resin having such a molecular weight, the objective resin can be attained. In order to effectively disperse toner ingredients within the binder resin, the vinyl resin may preferably have a THF-insoluble content of at most 10 wt. %, more preferably at most 5 wt. %.

Examples of vinyl monomers to be copolymerized with a carboxyl group-containing monomer and/or a glycidyl group-containing monomer as described above may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl henzoate; methacrylate, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile methacrylonitrile, and acrylamide. These vinyl monomers may be used singly or in combination of two or more species.

Among these, a combination of monomers providing styrene-based copolymers and styrene-acrylate-based copolymers may be particularly preferred. In this case, the styrene-based copolymer component or styrene acrylate based copolymer component may preferably occupy at least 60 wt. % of the binder resin in view of the finability and mixability.

The binder resin for providing the toner according to the present invention can also contain another polymer, examples of which may include: homopolymers of styrene and its substitution derivatives such as polystyrene, poly-p-chlorostyrene and polyvinyltoluene; styrene-based copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-acrylonitrile copolymer, styrene-vinyl methyl ether copolymer, styrene-vinyl ethyl ether copolymer, styrene-vinyl methyl ketone copolymer, styrene-butadlene copolymer, styrene-isoprene copolymer, and styrene-acrylonitrile-indene copolymer; polyvinyl chloride, phenolic resin, natural resin-modified maleic resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarone-indene resin, and petroleum resin.

Examples of the imridazole compound having an imidazole unit representing the above-mentioned formula (1) used in the toner of the present invention may include those represented by the following formulae (2)–(9).

Formula (2):

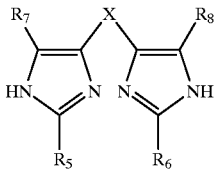

wherein $R_5$–$R_8$ independently denote hydrogen, alkyl aryl, aralkyl, amino, halogen or heterocyclic ring each capable of having a substituent; and X denotes a bonding group selected from the group consisting of phenylene, vinylene and alkylene each capable of having a substituent;

Formula (3):

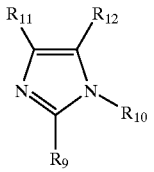

wherein $R_9$, $R_{11}$ and $R_{12}$ independently denote hydrogen, alkyl, aryl, aralkyl, amino, halogen or heterocyclic ring each capable of having a substituent with the proviso that $R_{11}$ and $R_{12}$ can be bonded to each other to form a saturated aliphatic ring, an unsaturated aliphatic ring, an aromatic ring or a heterocyclic ring; and $R_{10}$ denotes hydrogen, alkyl, aryl, aralkyl or heterocyclic ring each capable of having a substituent;

Formula (4):

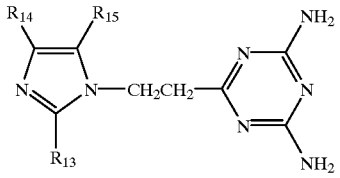

wherein $R_{13}$, $R_{14}$ and $R_{15}$ independently denote hydrogen, alkyl, aryl, aralkyl, amino, halogen or heterocyclic ring each capable of having a substituent with the proviso that $R_{14}$ and $R_{15}$ can be bonded to each other to form a saturated aliphatic ring, an unsaturated aliphatic ring, an aromatic ring or a heterocyclic ring;

Formula (5):

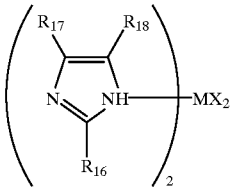

Formula (6):

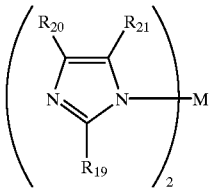

In the formulae (5) and (6), $R_{16}$–$R_{21}$ independently denote hydrogen, alkyl, aryl, aralkyl, amino, halogen or heterocyclic ring each capable of having a substituent with the proviso that a pair of $R_{17}$ and $R_{18}$ or a pair of $R_{20}$ and $R_{21}$ can be bonded to each other to form a saturated aliphatic ring, an unsaturated aliphatic ring, an aromatic ring or a heterocyclic ring; M denotes a metal element, and X denotes a counter anion;

Formula (7):

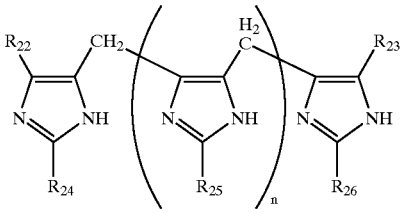

wherein n is an integer of at least 1; and $R_{23}$–$R_{26}$ independently denote hydrogen, alkyl, aryl, aralkyl, amino, halogen or heterocyclic ring each capable of having a substituent with the proviso that in case of $n \geqq 2$, plural groups $R_{25}$ can be identical or different;

Formula (8):

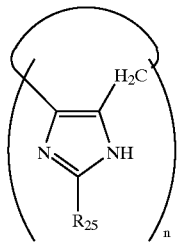

wherein n is an integer of at least 2; and $R_{27}$ denotes hydrogen, alkyl, aryl, aralkyl, amino, halogen or heterocyclic ring each capable of having a substituent with the proviso that plural groups $R_{27}$ can be identical or different:

Formula (9):

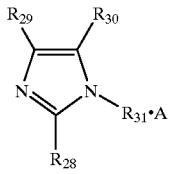

wherein $R_{28}$–$R_{30}$ independently denote hydrogen, alkyl, aryl, aralkyl, amino, halogen or heterocyclic ring each capable of having a substituent with the proviso that $R_{29}$ and $R_{30}$ can be bonded to each other to form a saturated aliphatic ring, an unsaturated aliphatic ring, an aromatic ring or a heterocyclic ring, $R_{31}$ denotes hydrogen, alkyl, aryl, aralkyl or heterocyclic ring each capable of having a substituant; and A denotes an organic or inorganic acid.

Consequently, in the above formulae (2)–(9), $R_5$–$R_9$ and $R_{11}$–$R_{30}$ are independently selected from hydrogen, alkyl, aryl, aralkyl, heterocyclic ring, amino and halogen each capable of having a substituent $R_{10}$ and $R_{31}$ are independently selected from hydrogen, alkyl, aryl, aralkyl and heterocyclic ring each capable of having a substituent. Examples of the substituent in the above may include: alkyl, aryl, aralkyl, alkoxy, amino, hydroxyl, halogen and heterocyclic ring.

In the formulae (5) and (6), M denotes a metal element, examples of which may include: Al, Ti, Cr, Mn, Fe, Co, Ni, Cu, Zn, Sb, Pb and Hg; preferably Fe, Co, Ni and Zn. These metal elements are effective for providing the toner with good anti-offset property.

The imidazole compound of the formula (5) includes optional counter anions, as is understood from a comparison with the formula (6). The counter ion may be an inorganic anion or an organic anion.

Examples of the inorganic anion may include: halogen ions, such as $F^-$, $Cl^-$, $Br^-$ and $I^-$; $OH^-$, $SO_4^{2-}$, $NO_3^-$, $CH_3COO^-$, $CH_3OSO_3^-$, $CH_3C_6H_4SO_3^-$, $BF_4^-$, $SF_5^-$, $ClO_4^-$, $SiF_6^{2-}$; and polyacid ions or heteropolyacid ions, such as $[TeMo_6P_{24}]^{6-}$, $[H_2W_{12}O_{42}]^{10-}$, $[PMo_{12}O_{40}]^{3-}$ and $[PW_{12}O_{40}]^{3-}$. Examples of the organic anion may include: sulfonate ions having 1–24 carbon atoms, carboxylate ions having 1–24 carbon atoms, monoalkyl-sulfate anions having 1–24 carbon atoms, and tetraphenylborate ions. Among the above, halogen ions, $SO_4^{2-}$ and monoalkyl-sulfate anions having 1–6 carbon atoms are preferred in view of easiness of production and storage stability of the compound. Halogen ions are further preferred.

The acid in the formula (9) may also be an inorganic acid or an organic acid. Examples of the inorganic acid may include: hydrogen halide acids, such as hydrofluoric acid, hydrochloric acid, hydrobromic acid, and hydroiodic; sulfuric acid, nitric acid, phosphoric acid, and phosphorous acid. Examples of the organic acid may include: saturated aliphatic monocarboxylic acids, such as formic acid, acetic acid, propionic acid, butyric acid, isobutyric acid, valeric acid, isovalerlc acid, pivalic acid, lauric acid, myristic acid, palmitic acid, and stearic acid; aliphatic oxyacids, such as glycolic acid, lactic acid, hydroacrylic acid, α-oxybutyric acid, glycerin acid, tartronic acid, malic acid, tartaric acid, and citric acid; saturated aliphatic dicarboaylic acids, such as oxalic acid, malonic acid, succinic acid, glutaric acid. adipic acid, pimelic acid, suberic acid, azelaic acid and sebacic acid; unsaturated aliphatic acids, such as acrylic acid, propionic acid, methacrylic acid, crotonic acid, isocrotonic acid, oleic acid, fumaric acid and maleic acid; aromtic carboxylic acids, such as benzoic acid, paranitrobenzoic acid, toluic acid, cirmamic acid, phthalic acid, isophthalic acid, terephthalic acid, trimnellitic acid and pyromellitic acid. Among these, particularly preferred are: hydrochloric acid, hydrobromic acid, sulfuric acid, nitric acid, phosphoric acid, phosphorous acid, lauric acid, myristic acid, palmitic acid, stearic acid, glycolic acid, lactic acid, malic acid, tartaric acid, citric acid, oxalic acid, malonic acid, succinic acid, adipic acid, fumaric acid, maleic acid, paranitrobenzoic acid, isophtbalic acid, terephthalic acid, trimellitic acid and pyromellitlc acid.

Specific examples of $R_5$–$R_{31}$ may include: hydrogen, mathyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, icosyl, henicosyl, tricosyl, tetracosyl, pentacosyl, i-propyl, i-butyl, t-butyl, cyclopentyl, cyclohexyl, benzyl, phenethyl, diphenylmethyl, trityl, cumyl, phenyl, tolyl, xylyl, mesityl, naphthyl and anthryl.

Among the alkyl groups, those having 1–25 carbon atoms are preferred, and particularly those having 3–20 carbon atoms are preferred. Among the aralkyl groups, those having 7–25 carbon atoms are preferred. Further, among the aryl groups, those having 6–25 carbon atoms are preferred. X in the above formula (2) denotes a bonding group selected from phenylene, propenylene, vinylene and alkylene each capable of having a substituent. X may preferably be unsubstituted or substituted with alkyl, aralkyl or aryl.

As for the alkyl groups, aralkyl group and aryl groups for the groups $R_5$–$R_{31}$, those having more than 25 carbon atoms are liable to provide imidazole compounds having lower melting points, whereby the imidazole compound is caused to have a low melt viscosity and the dispersion thereof in the binder resin is liable to be difficult, thus providing a toner exhibiting inferior image characteristics due to insufficient dispersion and posing a restriction on the binder resin.

In the present invention, imidazole compounds represented by the above formulae (2) and (3) are particularly preferred in view of the developing performance and anti-offset property.

In the present invention, the imidazole compound may preferably be added in a proportion of 0.01–20.0 wt. parts, more preferably 0.1–10.0 wt. parts, further preferably 0.5–5.0 wt. parts, per 100 wt. parts of the binder resin. Below 0.01 wt. part, the toner cannot be provided with sufficient crosslinking promotion effect due to the addition of the imidazole compound. Above 20.0 wt. parts, the excessively added imidazole compound can cause dispersion failure to form agglomerates in the resultant toner particles or cause fluctuations of imidazole compound contents in individual toner particles.

By including the binder resin containing a carboxyl group and a glycidyl group in a reacted form owing to the co-presence of the imidazole compound, the toner according to the present invention is prevented from excessive charge in the cleaning step. As a result, it is possible to reduce electrostatic attach int of the toner onto the photosensitive drum, prevent the electrostatic agglomeration of the toner and prevent the discharge from the excessively charged waste toner onto the photosensitive drum.

By reducing the electrostatic toner attachment onto the photosensitive drum, it becomes easier to clean a toner mass even if such a mass is formed on the drum, thus preventing the occurrence of melt-sticking. Further, by preventing the toner agglomeration, it becomes possible to prevent the floating of the cleaning blade liable to be caused by such toner agglomerates, thus preventing the cleaning failure. By preventing the discharge onto the photosensitive drum from the excessively charged waste toner, it becomes possible to prevent electrostatic breakdown on the drum, thus preventing the occurrence of leakage spots.

The imidazole compound used in the present invention can be synthesized through a known synthesis process.

The toner according to the present invention containing such an imidazole compound functioning as a positive charge control agent can be used as a positively chargeable toner. It is also possible to further add a known positive charge control agent in addition to the imidazole compound.

Such a known charge control agent may be added internally into toner particles or externally added in mixture with the toner particles. Such a known charge control agent may be added in an appropriate amount determined based on toner production process factors, such as the species of the binder resin including the amount of the imidazole compound, the addition or absence of other additive and manner of dispersion, but may preferably be added in an amount of 0.1–10 wt. parts, more preferably 0.1–5 wt. parts, per 100 wt. parts of the binder resin.

Hereinbelow, representative examples of the imidazole compound used in the present invention are enumerated hereinbelow with their structural formulae and formula numbers. A formula number (2-3), for example, represents a third example of the imidazole compounds represented by the above-mentioned (general) formula (2). The following examples of the imidazole compound are preferred in view of easiness of handling, but they are not exhaustive.

(2-1)

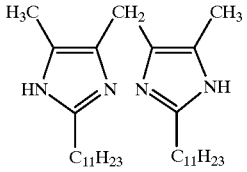

(2-2)

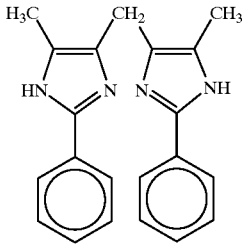

-continued (2-3)

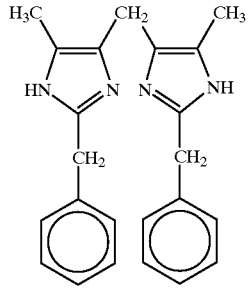

(2-4)

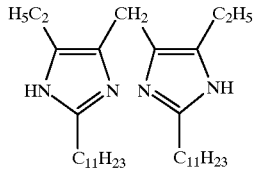

(2-5)

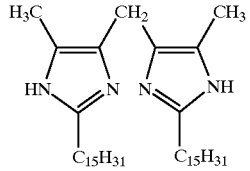

(2-6)

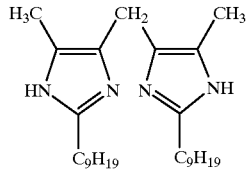

(2-7)

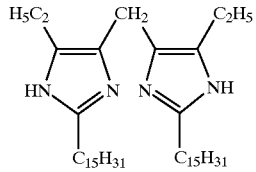

(2-8)

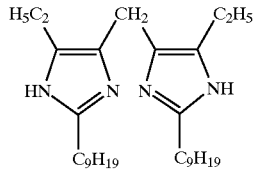

(2-9)

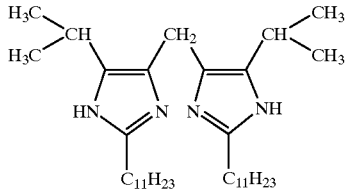

-continued
(2-10)
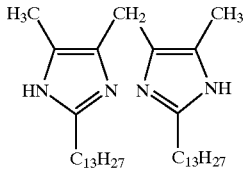
(2-11)
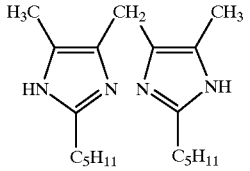
(2-12)
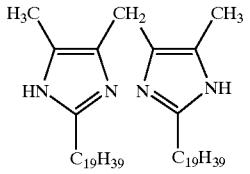
(2-13)
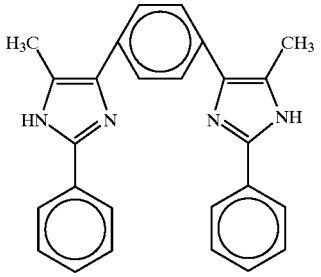
(2-14)
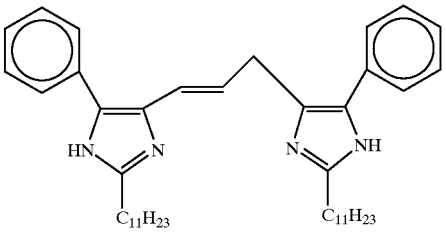
(2-15)
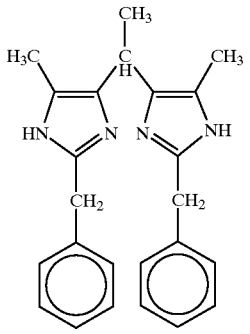
-continued
(2-16)
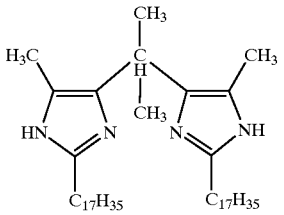
(2-17)
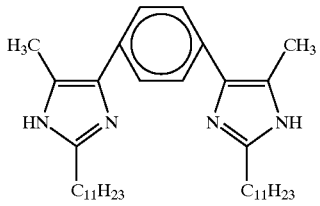
(2-18)
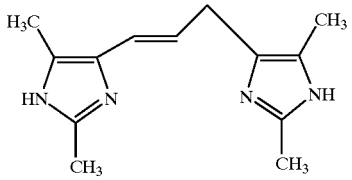
(2-19)
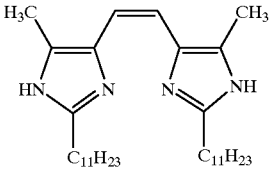
(2-20)
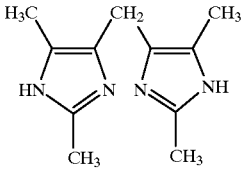
(2-21)
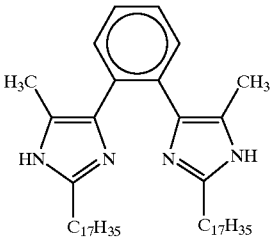
(2-22)
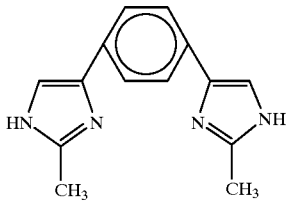

-continued
(2-23)
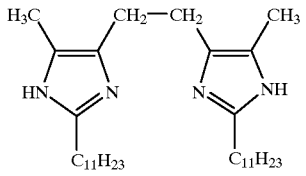
(2-24)
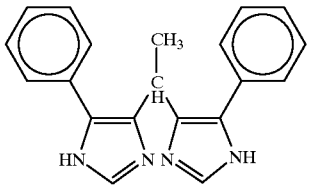
(2-25)
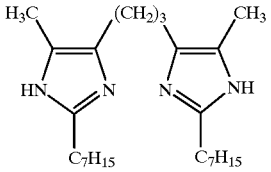
(2-26)
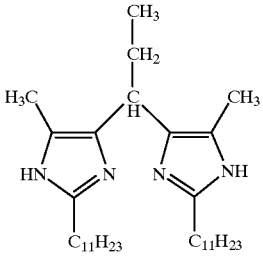
(2-27)
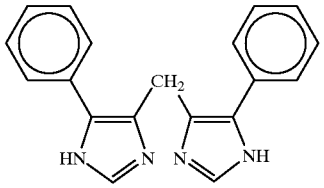
-continued
(2-28)
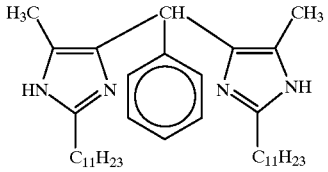
(2-29)
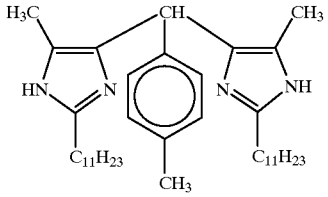
(2-30)
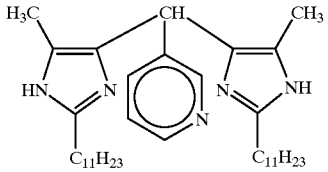
(2-31)
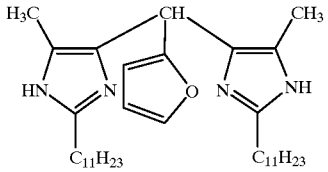
In the following, some imidazole compounds having two imidazole units having identical or different suubstituents are enuzerated. Different imidazole compounds can also be used in mixture.

(2-32)
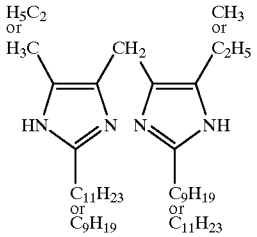
(2-33)
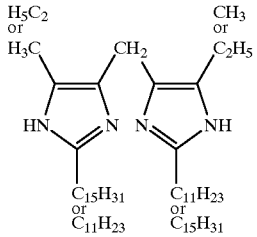
(2-34)
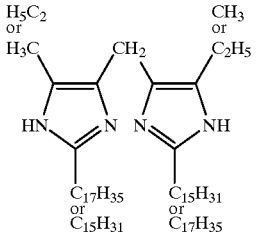
(2-35)
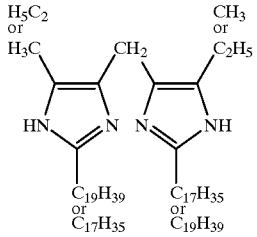
(2-36)
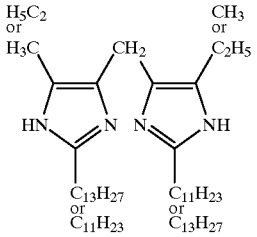
(2-37)
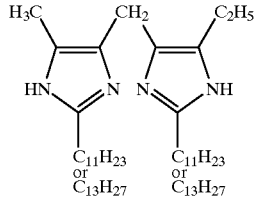
(2-38)
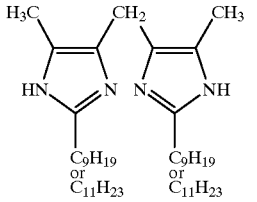
(2-39)
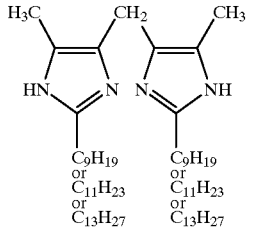
(3-1)
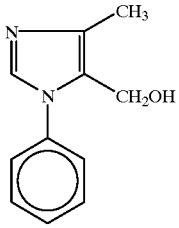
(3-2)
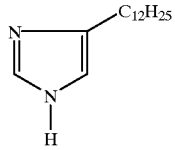
(3-3)
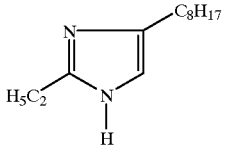
(3-4)
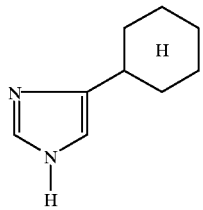

-continued
(3-5)
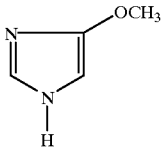
(3-6)
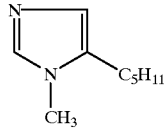
(3-7)
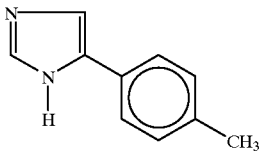
(3-8)
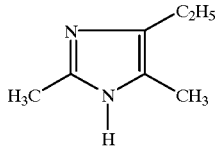
(3-9)
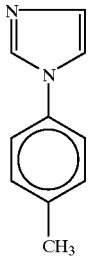
(3-10)
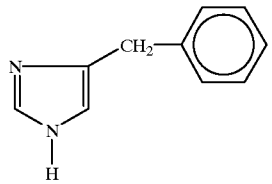
(3-11)
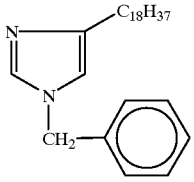
(3-12)
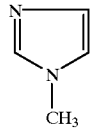
(3-13)
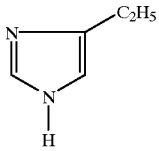
(3-14)
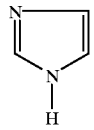
(3-15)
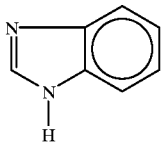
(3-16)
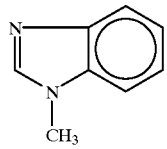
(3-17)
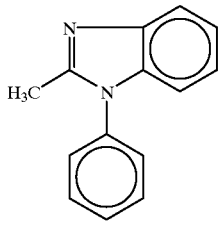
(3-18)
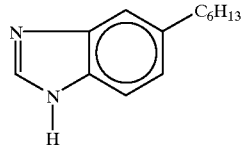
(3-19)
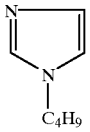
(3-20)
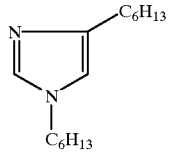

-continued
(3-21)
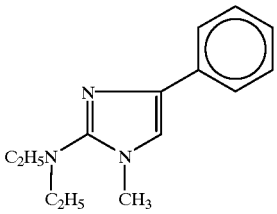
(3-22)
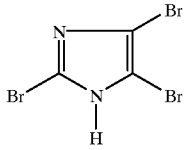
(3-23)
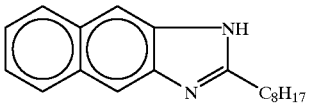
(3-24)
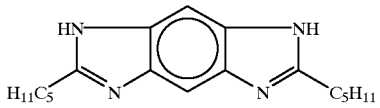
(3-25)
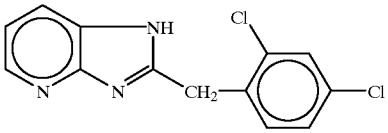
(3-26)
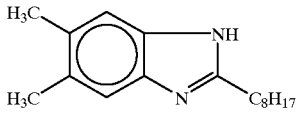
(3-27)
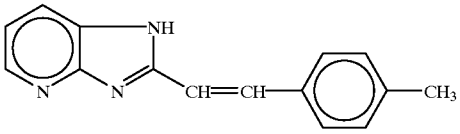
(3-28)
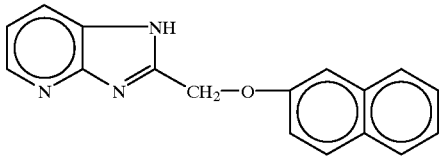
(3-29)
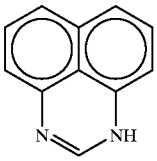
(3-30)
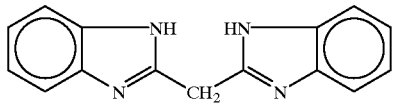
(3-31)
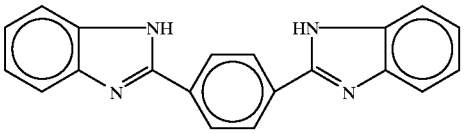
(3-32)
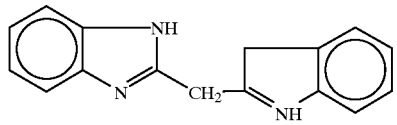
(3-33)
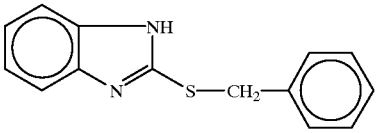
(3-34)
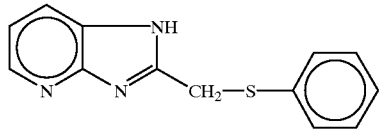
(3-35)
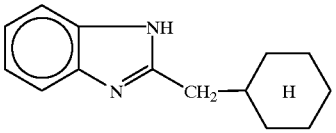
(3-36)
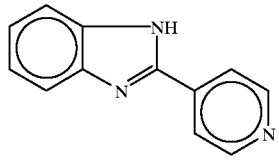
(3-37)
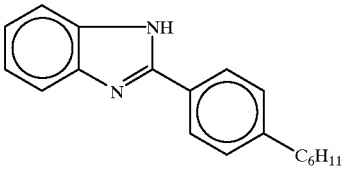
(3-38)
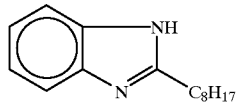

-continued
(3-39)
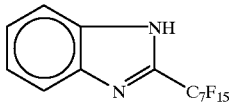
(3-40)
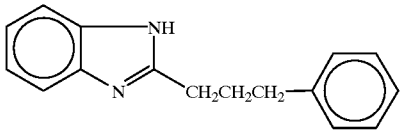
(3-41)
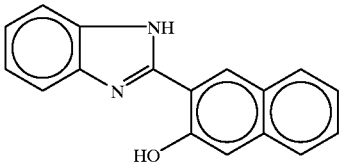
(3-42)
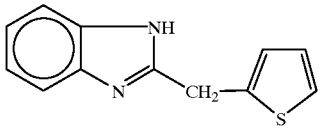
(3-43)
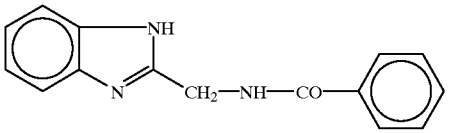
(3-44)
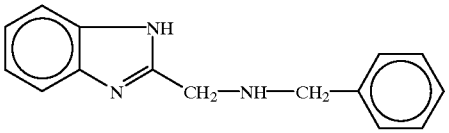
(3-45)
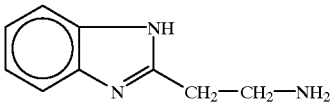
(3-46)
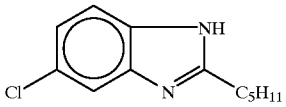
(3-47)
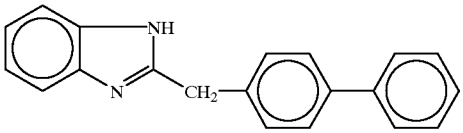
(3-48)
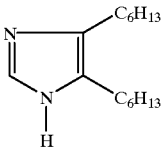
(3-49)
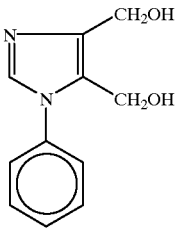
(4-1)
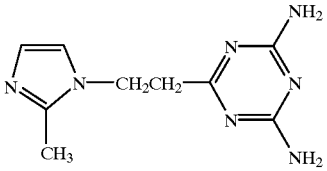
(4-2)
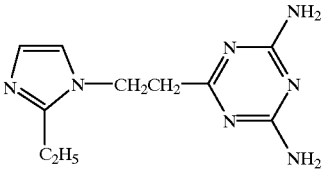
(4-3)
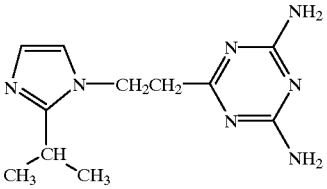
(4-4)
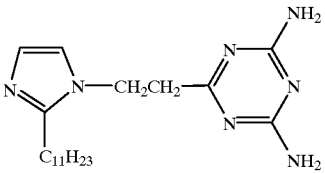
(4-5)
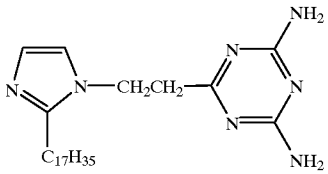

-continued
(4-6)
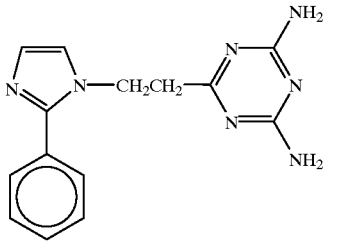
(4-7)
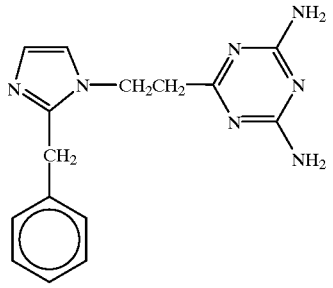
(4-8)
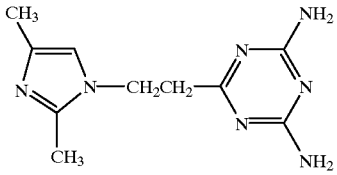
(4-9)
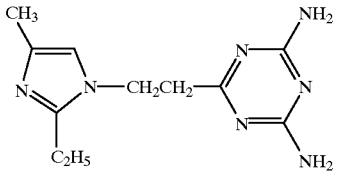
(4-10)
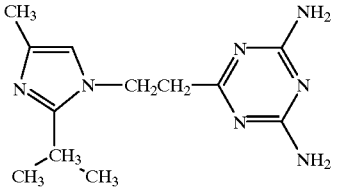
(4-11)
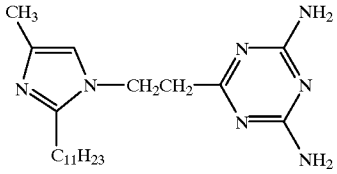
(4-12)
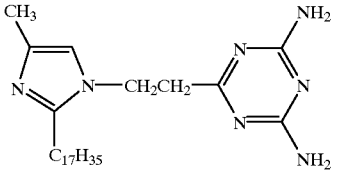
(4-13)
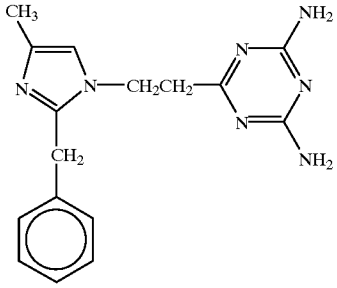
(4-14)
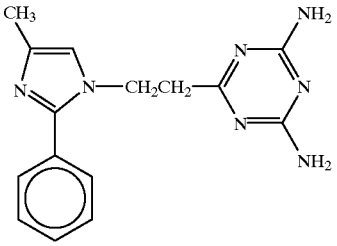
(4-15)
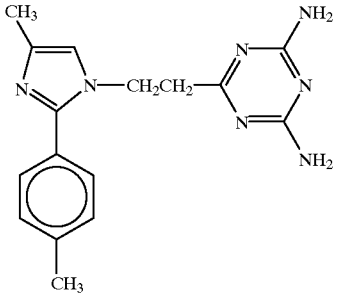
(4-16)
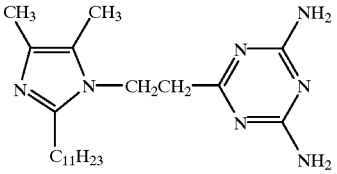
(4-17)
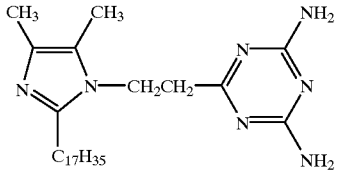

-continued
(4-18)
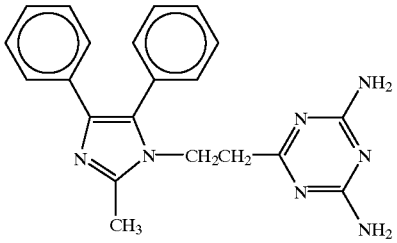
(4-19)
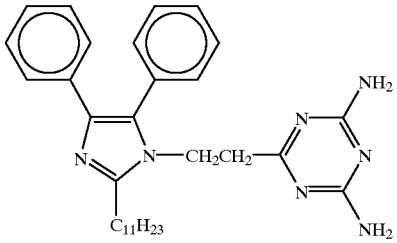
(4-20)
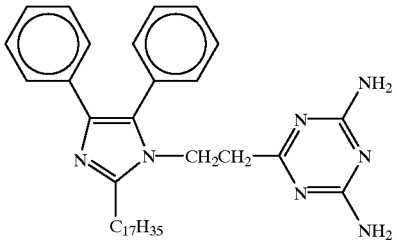
(4-21)
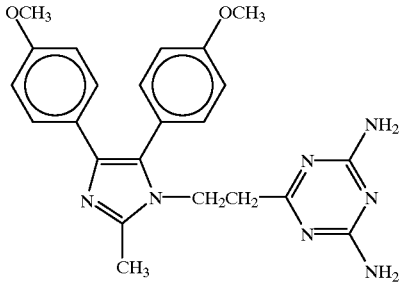
(4-22)
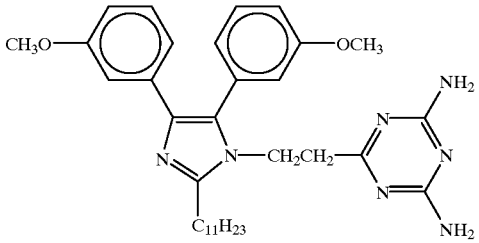
(4-23)
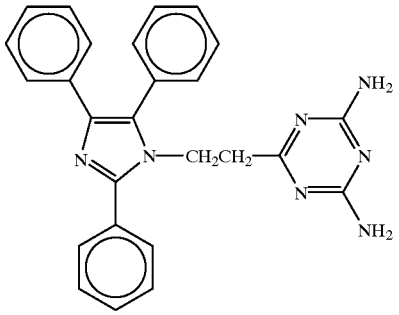
(4-24)
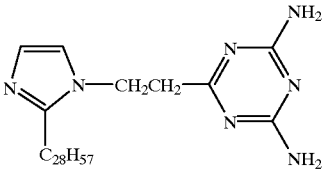
(4-25)
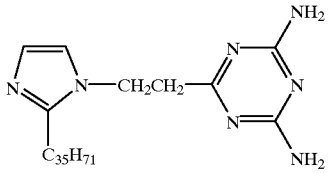
(5-1)
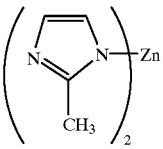
(5-2)
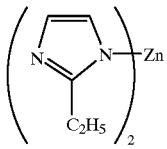
(5-3)
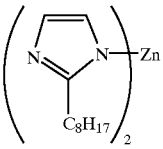
(5-4)
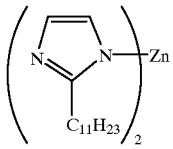

-continued
(5-5)
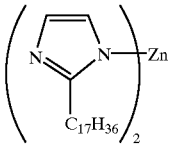
(5-6)
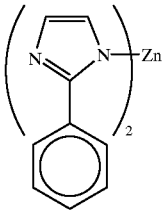
(5-7)
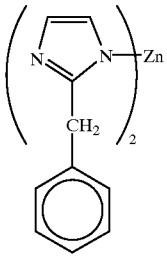
(5-8)
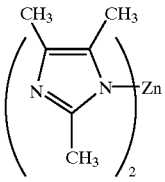
(5-9)
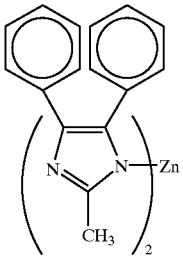
(5-10)
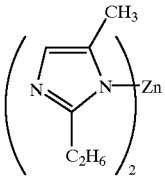
(5-11)
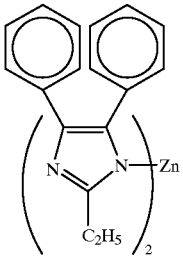
(5-12)
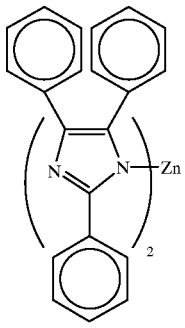
(5-13)
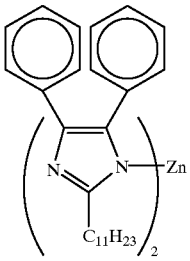
(5-14)
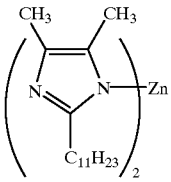

-continued
(5-15)
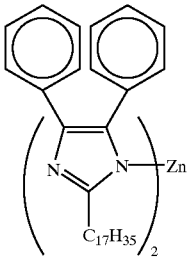
(5-16)
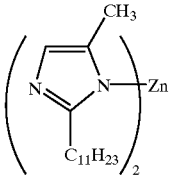
(5-17)
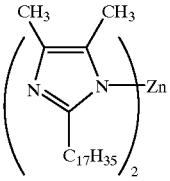
(5-18)
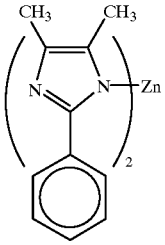
(5-19)
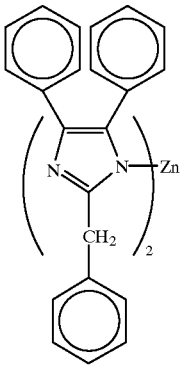
(5-20)
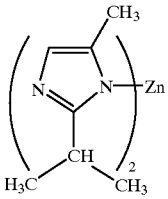
(5-21)
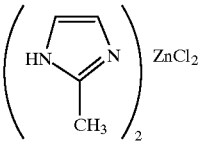
(5-22)
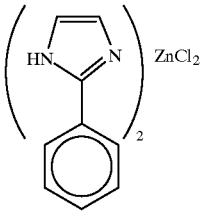
(5-23)
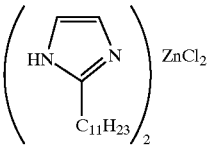
(5-24)
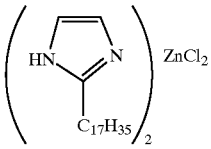
(5-25)
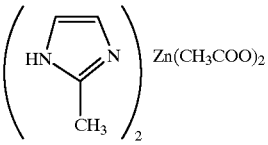
(5-26)
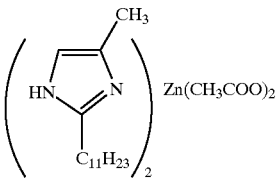

-continued
(5-27)
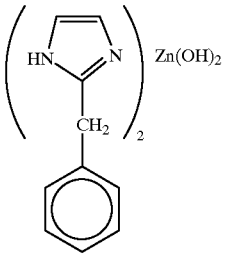
(5-28)
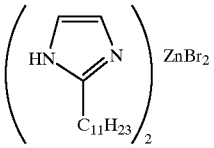
(5-29)
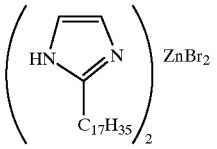
(5-30)
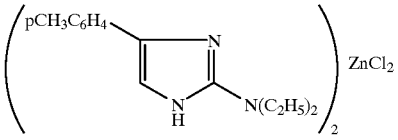
(5-31)
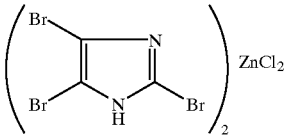
(5-32)
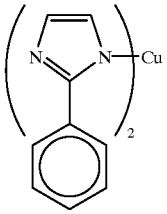
(5-33)
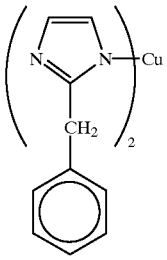
(5-34)
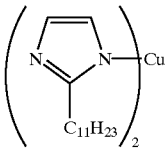
(5-35)
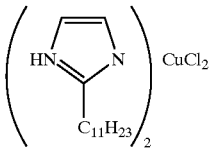
(5-36)
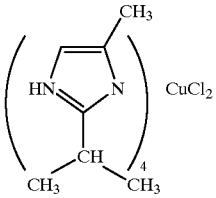
(5-37)
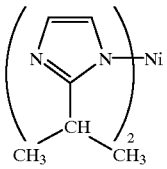
(5-38)
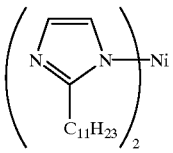
(5-39)
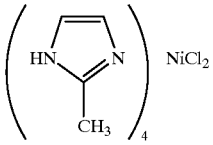
(5-40)
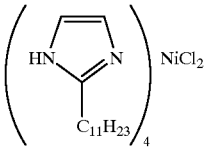

-continued
(5-41)
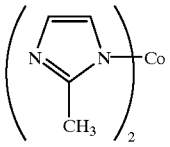
(5-42)
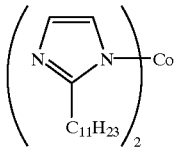
(5-43)
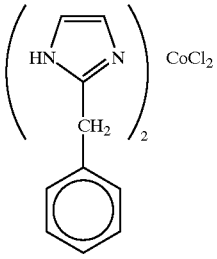
(5-44)
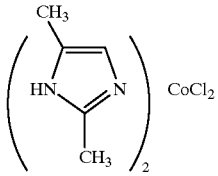
(5-45)
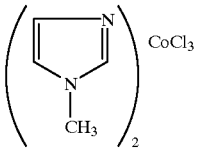
(5-46)
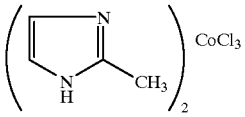
(5-47)
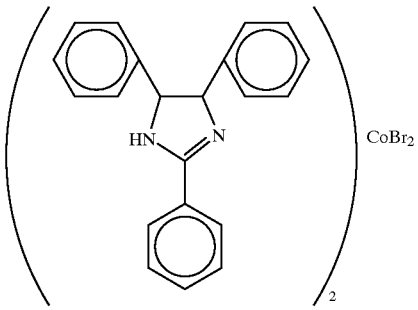
(5-48)
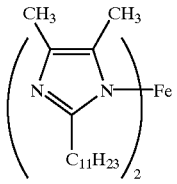
(5-49)
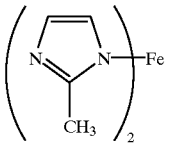
(5-50)
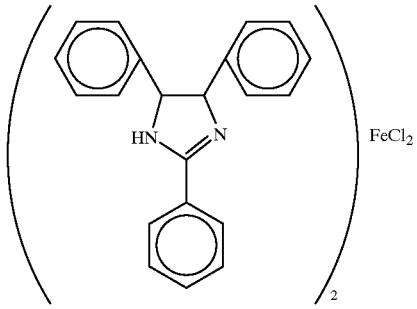
(5-51)
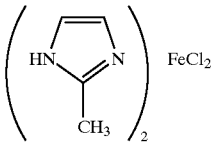
(5-52)
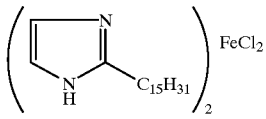
(5-53)
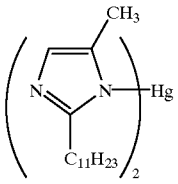
(5-54)
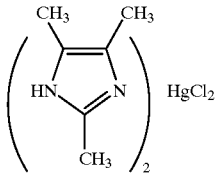

-continued
(5-55)
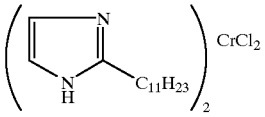
(5-56)
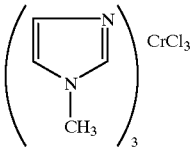
(5-57)
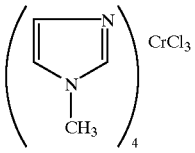
(7-1)
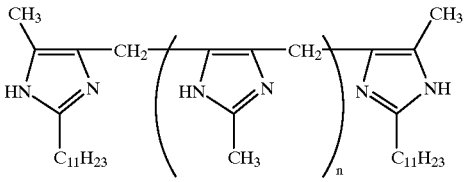
The number average of n ( = $n_{av}$) is 4, for example. That is, $n_{av}$ = 5.
(7-2)
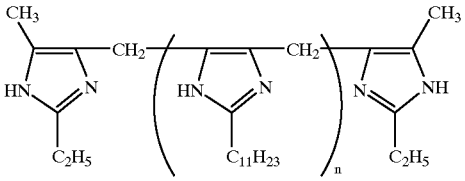
$n_{av}$ = 8
(7-3)
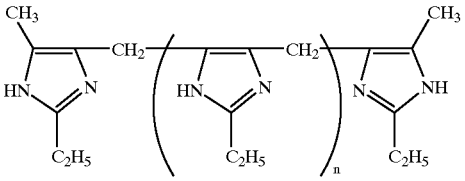
$n_{av}$ = 23
(7-4)
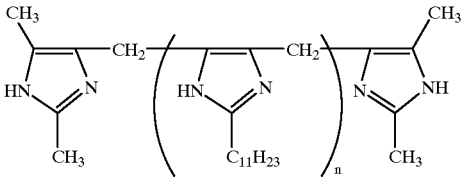
$n_{av}$ = 52
(7-5)
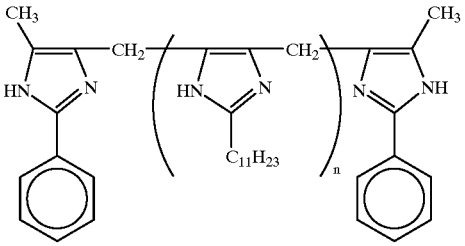
$n_{av}$ = 9
(7-6)
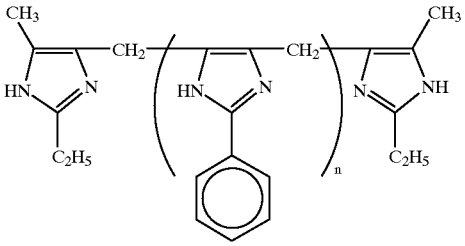
$n_{av}$ = 34
(7-7)
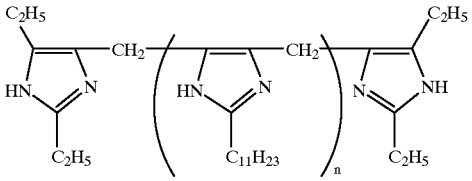
$n_{av}$ = 63
(7-8)
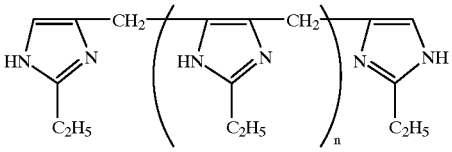
$n_{av}$ = 17
(7-9)
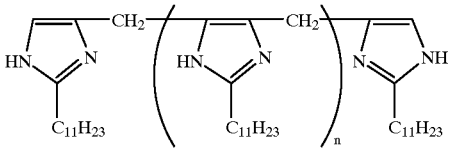
$n_{av}$ = 6

-continued
(7-10)
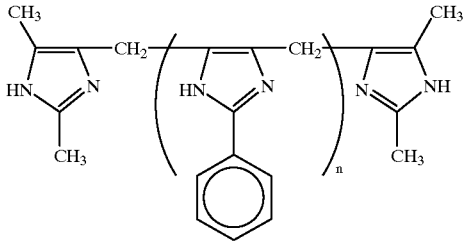
$n_{av}$ = 20
(7-11)
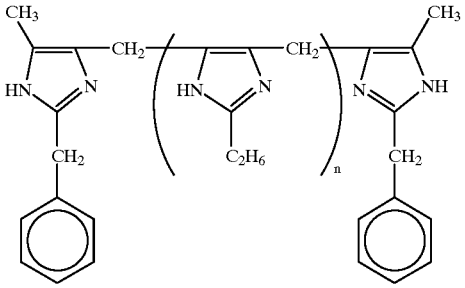
$n_{av}$ = 42
(7-12)
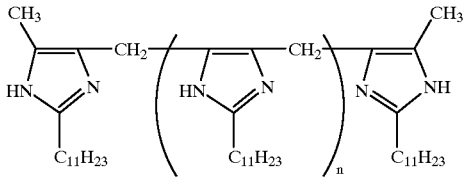
$n_{av}$ = 19
(7-13)
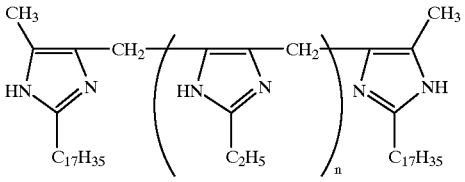
$n_{av}$ = 30
(7-14)
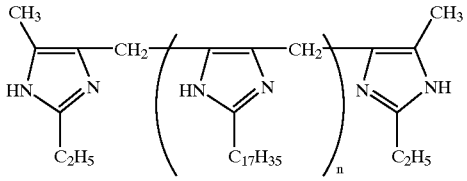
$n_{av}$ = 13
(7-15)
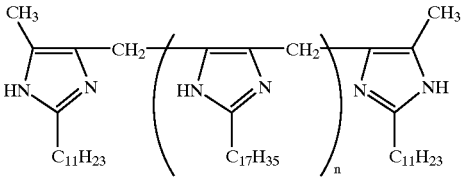
$n_{av}$ = 22
(7-16)
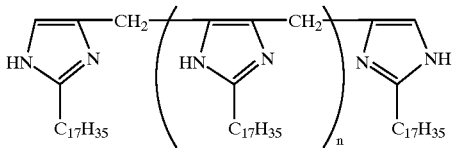
$n_{av}$ = 41
(7-17)
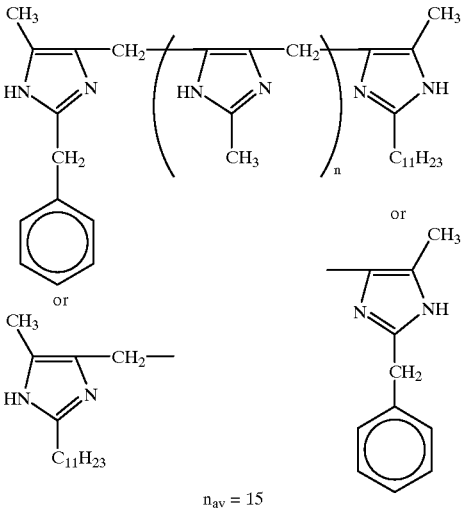
$n_{av}$ = 15
(7-18)
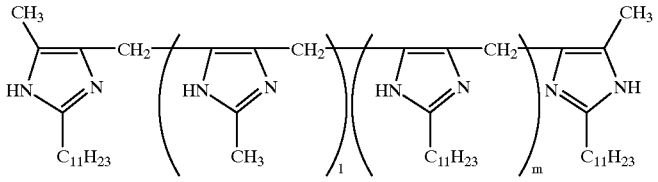
$(l + m)_{av}$ = 12, $(l:m)_{av}$ = 1:2

-continued
(7-19)
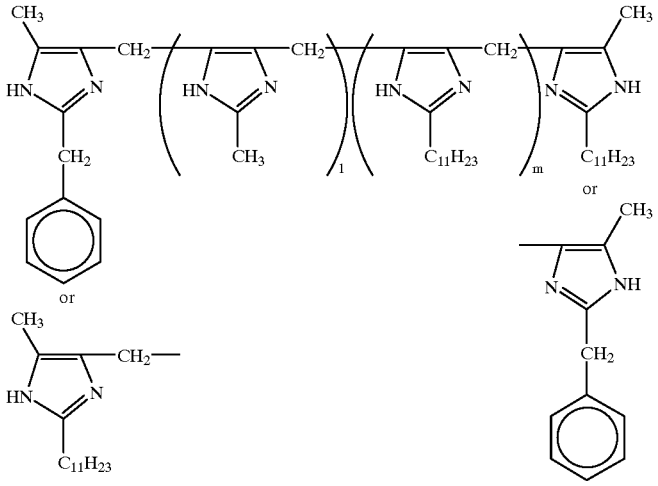
$(l + m)_{av} = 28$, $(l:m)_{av} = 1:1$
(7-20)
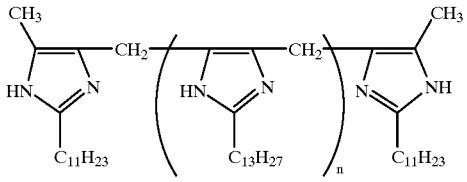
$n_{av} = 28$
(7-21)
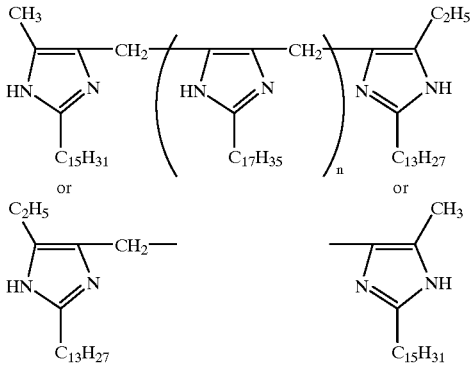
$n_{av} = 10$
(7-22)
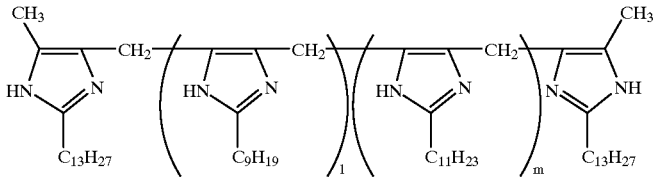
$(l + m)_{av} = 8$, $(l:m)_{av} = 2:1$ -continued (7-23)

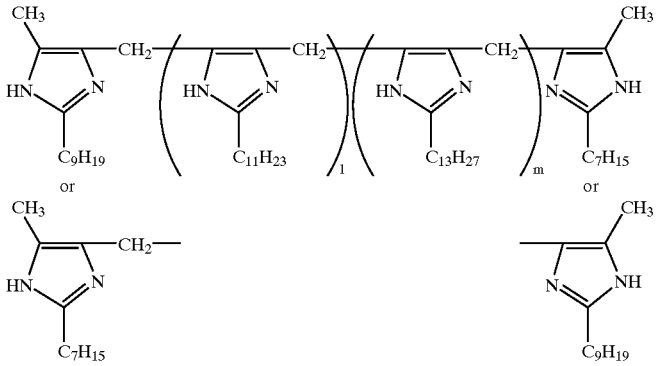

$(l + m)_{av} = 15$, $(l:m)_{av} = 1:1$ (7-24)

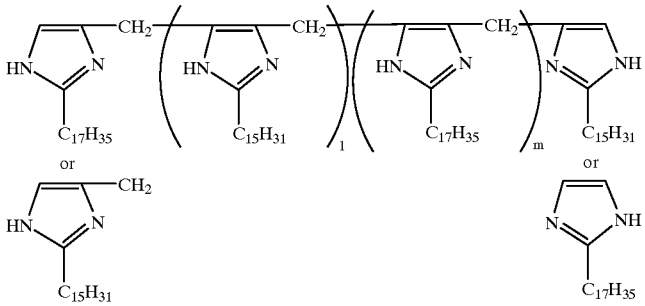

$(l + m)_{av} = 20$, $(l:m)_{av} = 1:2$ (7-25)

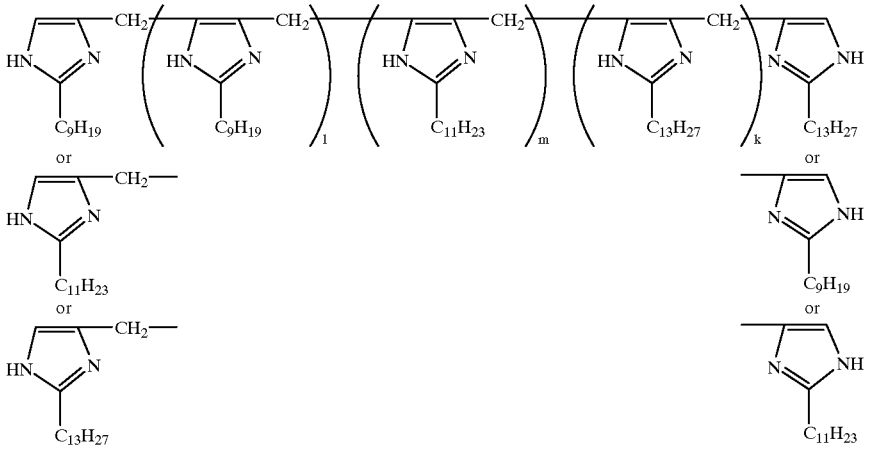

$(l + m + k)_{av} = 30$
$(l:m:k)_{av} = 1:2:1$

As is understood from the above examples, the imidazole compound represented by the general formula (7) is an oligomer or polymer having 3 or more imidazole units, which can include identical or different substituents. Each example represented by one formula number can also be such different imidazole compounds. Each formula example is expressed as a block copolymer formula, but the units therein can also be arranged at random. In the above, l, m and n respectively represents the number of corresponding units contained in the example.

Examples of imidazoles represented by the general formula (8) are enumerated below by formulae (8-1) to (8-17), with only a representative number of units, but each example can be a mixture of compounds having different numbers of units.

Below the formulae (8-1) to (8-17), formulae (a-1) to (a-60) are added for indicating specific examples of imidazole derivatives (a), which are combined with various acids described above to provide examples of imidazole compounds according to the general formula (9).

(8-1)
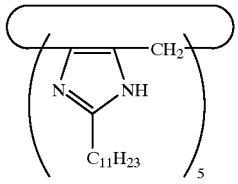
(8-2)
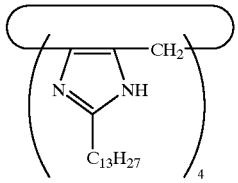
(8-3)
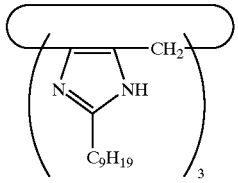
(8-4)
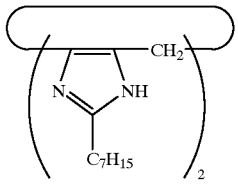
(8-5)
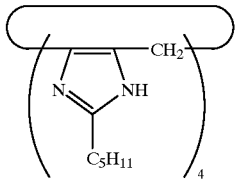
(8-6)
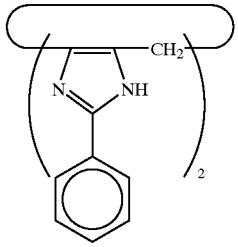
(8-7)
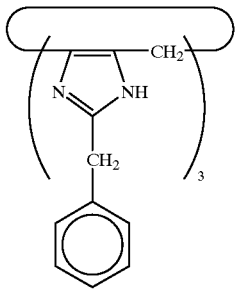
-continued
(8-8)
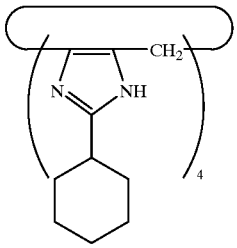
(8-9)
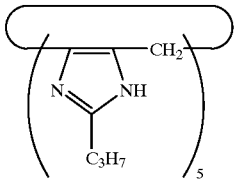
(8-10)
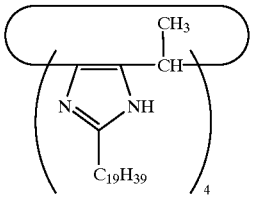
(8-11)
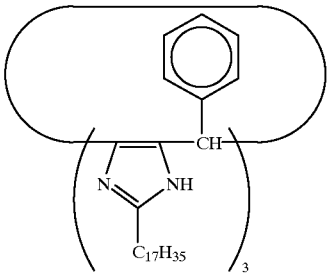
(8-12)
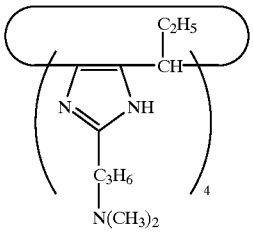
(8-13)
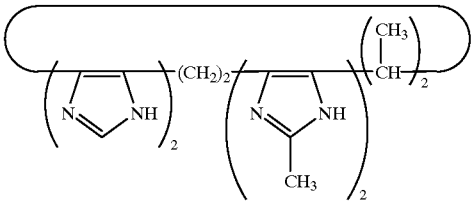

-continued
(8-14)
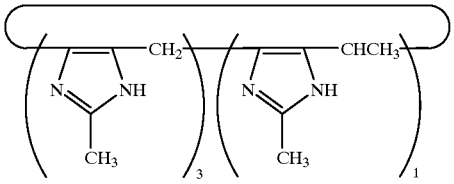
(8-15)
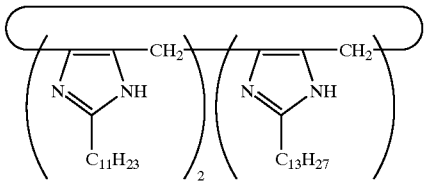
(8-16)
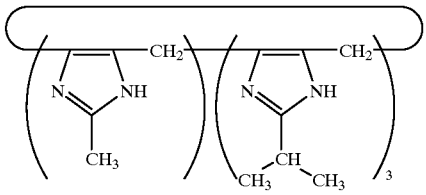
(8-17)
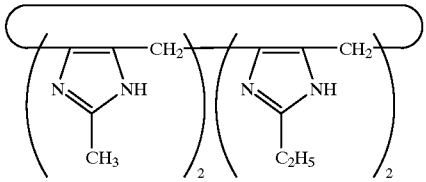
(a-1)
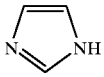
(a-2)
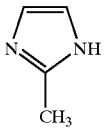
(a-3)
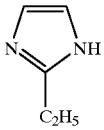
(a-4)
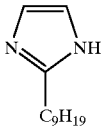
(a-5)
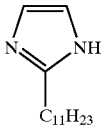
-continued
(a-6)
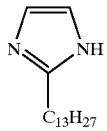
(a-7)
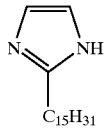
(a-8)
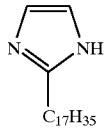
(a-9)
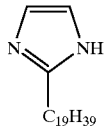
(a-10)
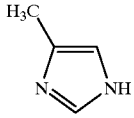
(a-11)
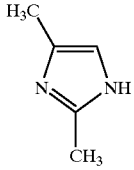
(a-12)
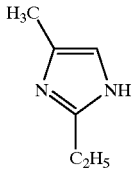
(a-13)
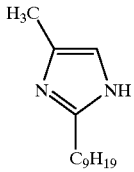
(a-14)
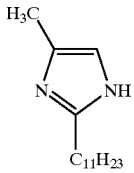

-continued
(a-15)
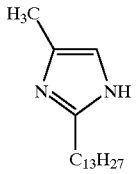
(a-16)
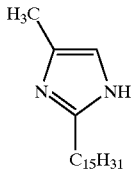
(a-17)
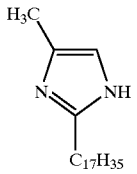
(a-18)
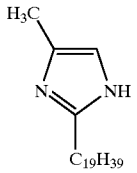
(a-19)
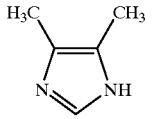
(a-20)
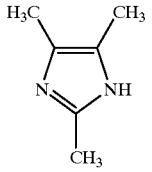
(a-21)
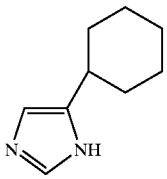
(a-22)
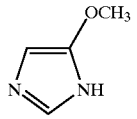
-continued
(a-23)
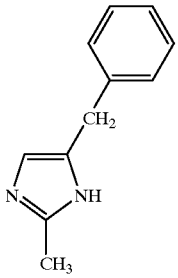
(a-24)
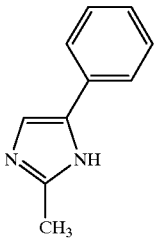
(a-25)
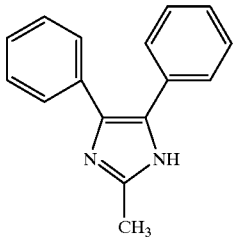
(a-26)
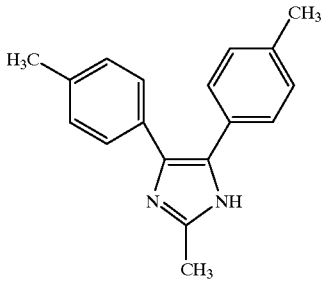
(a-27)
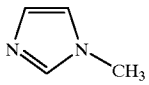
(a-28)
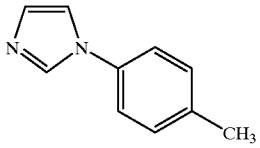
(a-29)
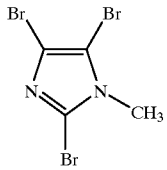

-continued
(a-30)
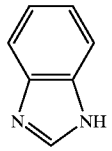
(a-31)
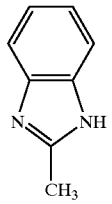
(a-32)
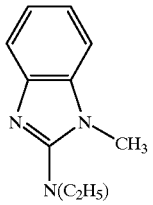
(a-33)
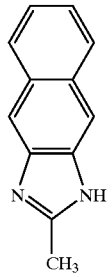
(a-34)
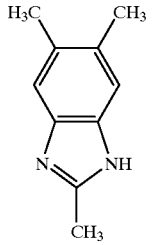
(a-35)
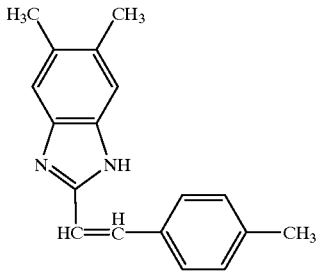
-continued
(a-36)
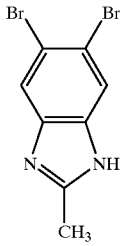
(a-37)
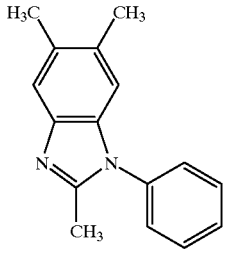
(a-38)
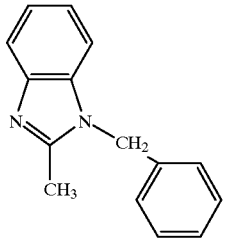
(a-39)
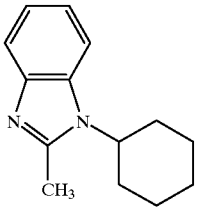
(a-40)
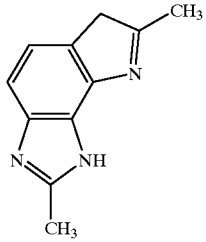
(a-41)
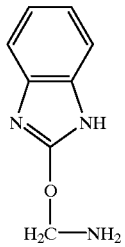

-continued
(a-42)
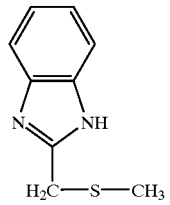
(a-43)
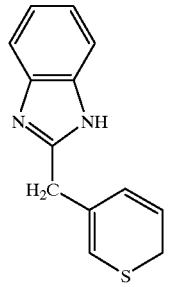
(a-44)
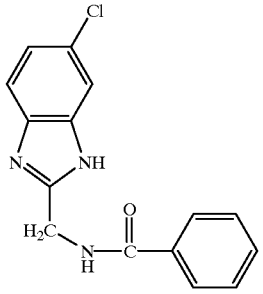
(a-45)
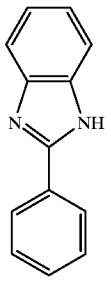
(a-46)
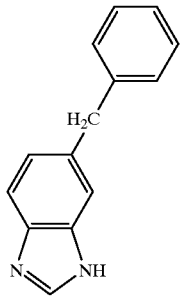
-continued
(a-47)
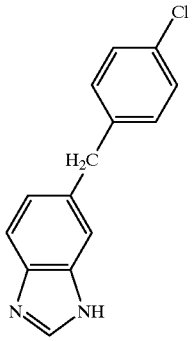
(a-48)
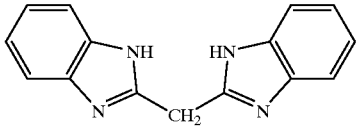
(a-49)
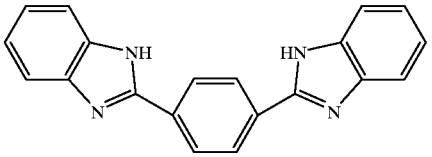
(a-50)
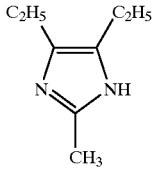
(a-51)
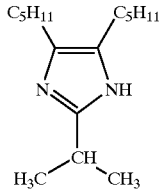
(a-52)
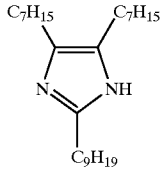
(a-53)
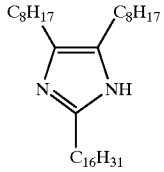

-continued (a-54)

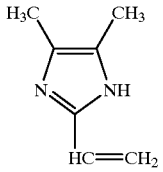

(a-55)

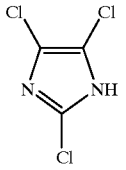

(a-56)

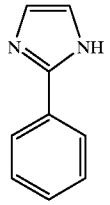

(a-57)

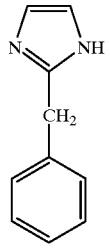

(a-58)

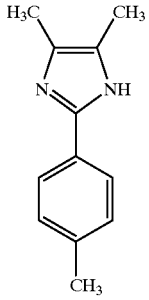

(a-59)

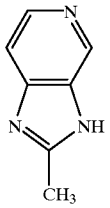

(a-60)

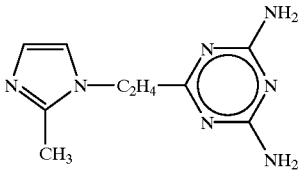

Table 1 below lists specific examples of imidazole compounds represented by the general formula (9) by combinations of imidazole derivatives (a) by formulae (a-1), etc., with specific acids to be combined therewith.

TABLE 1

Specific imidazole compounds according to Formula (9)

| No. | Imidazole (a) | Acid |
|---|---|---|
| 9-1 | a-1 | oxalic acid |
| 9-2 | a-2 | trimellitic acid |
| 9-3 | a-3 | trimellitic acid |
| 9-4 | a-4 | oxalic acid |
| 9-5 | a-5 | hydrochloric acid |
| 9-6 | a-5 | phosphoric acid |
| 9-7 | a-5 | oxalic acid |
| 9-8 | a-5 | p-nitrobenzoic acid |
| 9-9 | a-5 | fumaric acid |
| 9-10 | a-5 | trimellitic acid |
| 9-11 | a-6 | lauric acid |
| 9-12 | a-7 | palmitic acid |
| 9-13 | a-7 | stearic acid |
| 9-14 | a-8 | hydrochloric acid |
| 9-15 | a-8 | hydrobromic acid |
| 9-16 | a-8 | sulfuric acid |
| 9-17 | a-8 | stearic acid |
| 9-18 | a-8 | oxalic acid |
| 9-19 | a-8 | fumaric acid |
| 9-20 | a-8 | trimellitic acid |
| 9-21 | a-8 | pyromellitic acid |
| 9-22 | a-9 | glycolic acid |
| 9-23 | a-10 | lactic acid |
| 9-24 | a-11 | oxalic acid |
| 9-25 | a-12 | nitric acid |
| 9-26 | a-13 | phosphoric acid |
| 9-27 | a-14 | phosphoric acid |
| 9-28 | a-14 | phosphorous acid |
| 9-29 | a-14 | myristic acid |
| 9-30 | a-14 | palmitic acid |
| 9-31 | a-14 | oxalic acid |
| 9-32 | a-14 | trimellitic acid |
| 9-33 | a-14 | pyromellitic acid |
| 9-34 | a-15 | malic acid |
| 9-35 | a-16 | tartaric acid |
| 9-36 | a-17 | citric acid |
| 9-37 | a-18 | oxalic acid |
| 9-38 | a-19 | malonic acid |
| 9-39 | a-20 | succinic acid |
| 9-40 | a-21 | adipic acid |
| 9-41 | a-22 | fumaric acid |
| 9-42 | a-23 | maleic acid |
| 9-43 | a-24 | isophthalic acid |
| 9-44 | a-25 | terephthalic acid |
| 9-45 | a-26 | trimellitic acid |
| 9-46 | a-27 | pyromellitic acid |
| 9-47 | a-28 | p-nitrobenzoic acid |
| 9-48 | a-29 | myristic acid |
| 9-49 | a-30 | palmitic acid |
| 9-50 | a-31 | oxalic acid |
| 9-51 | a-32 | trimellitic acid |
| 9-52 | a-33 | pyromellitic acid |
| 9-53 | a-34 | p-nitrobenzoic acid |
| 9-54 | a-35 | fumaric acid |
| 9-55 | a-36 | trimellitic acid |
| 9-56 | a-37 | lauric acid |
| 9-57 | a-38 | palmitic acid |
| 9-58 | a-39 | stearic acid |
| 9-59 | a-40 | maleic acid |
| 9-60 | a-41 | isophthalic acid |
| 9-61 | a-42 | terephthalic acid |
| 9-62 | a-43 | trimellitic acid |
| 9-63 | a-44 | pyromellitic acid |
| 9-64 | a-45 | citric acid |
| 9-65 | a-46 | oxalic acid |
| 9-66 | a-47 | malonic acid |
| 9-67 | a-48 | succinic acid |
| 9-68 | a-49 | adipic acid |
| 9-69 | a-50 | isocyanuric acid |

The toner according to the present invention may preferably contain a wax so as to be provided with releasability The wax may preferably have a melting point of 70–165° C., more preferably 70–160° C., and a melt-viscosity at 160° C. of at most 100 aPa.s. Specific examples thereof may include: paraffin wax, microcrystalline wax, Fischer-Trapshe wax, montan wax; and homopolymers or copolymers of linear α-olefins or branched α-olefins having a branch at a terminal portion such as ethylene, propylene, butene-1, pentene-1, haxene-1, heptene-1, octene-1, nonene-1 and decene-1, and olefin isomers of these having an unsaturation at different positions. In addition, it is also possible to use alcohol wax, fatty acid wax, ester wax and natural wax.

It is also possible to use a modified wax as by block copolymerization or graft polymerization with a vinyl monomer, or oxidized wax subjected to oxidation.

It is also possible to incorporate such a wax into the polymer component for mixing therewith in advance during toner production. In this case, the polymer component may preferably be prepared by preliminarily dissolving a wax and a high-molecular weight polymer component in a solvent, and then mixing the solution with a low-molecular weight polymer component solution. As a result, phase separation in microscopic region can be alleviated to suppress the re-aggregation of the high-molecular weight component and provide a good dispersion state with the low-molecular weight polymer component.

In the toner according to the present invention, the wax may preferably be used in 0.5–10 wt. parts, more preferably 1–8 wt. parts, per 100 wt. parts of the binder resin. It is possible to use a plurality of waxes in combination so as to provide a total amount as mentioned above.

The toner according to the present invention can contain a colorant comprising any suitable pigment or dye. For example, suitable examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. Such a pigment may be used in an amount necessary to provide a required optical density of fixed image, e.g., 0.1–20 wt. parts, preferably 0.2–10 wt. parts, per 100 wt. parts of the binder resin. For similar purpose, a dye may be used. There are, for example, azo dyes, anthraquinone dyes, xanthene dyes and methin dyes, which may be added in 0.1–20 wt. parts, preferably 0.3–10 wt. parts, per 100 wt. parts of the binder resin.

The toner according to the present invention can also be formed as a magnetic toner by containing a powdery magnetic material which can also function as a colorant.

The toner according to the present invention comprising a specific binder resin and an imidazole compound as mentioned is effectively used for constituting a magnetic toner by containing a powdery magnetic material as a colorant, since the falling-off of the powdery magnetic material from toner particles is effectively suppressed in the toner according to the present invention.

The mechanism why the effect of suppressing falling-off of the magnetic material from the toner is attained, has not been clarified as yet, but it is assumed that the falling-off from the toner particles of the imidazole compound is suppressed due to interaction of secondary amines in the imidazole compound with the carboxyl group, glycidyl group, and hydroxyl group or acid anhydride group, and the falling-off of the magnetic material accompanying the falling-off of the imidazole compound from the toner particles is also suppressed.

Examples of such a powdery magnetic material used in the present invention may include: iron oxide, such as magnetite, hematite and ferrite; metals, such as iron, cobalt and nickel, and alloys of these metals with another element, such as aluminum, copper, lead, magnesium, tin, zinc, antimony, beryllium, bismuth, cadmium, calcium, manganese, selenium, titanium, tungsten and vanadium, and mixtures of these. It is preferred to use magnetic particles containing silicon at the surface or inside thereof.

The magnetic material may preferably have a number-average particle size of 0.05–1.0 μm. more preferably 0.1–0.6 μm, further preferably 0.1–0.4 μm.

Such a magnetic material may preferably be contained in 10–200 wt. parts, more preferably 20–170 wt. parts, further preferably 30–150 wt. parts, per 100 wt. parts of the binder resin in the toner.

It is preferred to use the toner according to the present invention together with silica fine powder externally blended therewith in order to improve the charge stability, developing characteristic, fluidity, and durability.

The silica fine powder may preferably have a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also possible to use two or more treating agents in combination.

The toner according to the present invention can further contain other external additives, inclusive of fine resin particles and inorganic fine particles, functioning as a charging aid, an electroconductivity-imparting agent, a flowabllity-imparting agent, an anti-caking agent, a release agent for hot roller fixation, a lubricant, or abrasive.

Preferred examples of the lubricant may include: powders of polytetrafluorouthylene, zinc stearate and polyvinylldene fluoride; among which polyvinylidene fluoride powder is particularly preferred. Examples of the abrasive may include: powders of cerium carbide, silicon carbide and strontium titanate, among which strontium titanate powder is particularly preferred. The flowability-improving agents may include: titanium oxide powder and aluminum oxide powder, which are preferably hydrophobiLzed. The electroconductivity-imparting agents may include carbon black powder, zinc oxide powder, antimony oxide powder and tin oxide powder. It is also possible to a small amount of white fine particles and black fine particles of opposite polarity as a developing performance-improving agent.

The toner according to the present invention may be prepared through a process including: sufficiently blending the binder resin. the imidazole compound, and optional ingredients, such as a magnetic material, a colorant (of pigment or dye), wax, a metal salt or metal complex and/or other additives, by means of a blender such as a Henschel mixer or a ball mill, melting and kneading the blend by hot kneading means such a hot rollers, a kneader or an extruder, and cooling and solidifying the kneaded product, followed by pulverization and classification, to recover toner particles. The toner particles may optionally be blended sufficiently with desirable additives by a blender, such as an Henschel mixer, to obtain the toner according to the present invention.

Various machines are commercially available for the above process. Several examples thereof are enumerated below together with the makers thereof. For example, the commercially available bleners nay include: Henschel mixer (mfd. by Mitsui Kozan K.K.), Super Mixer (Kawata K.K.), Conical Ribbon Mixer (Ohkawara Seisakusho K.K.): Nautamixer, Turbulizer and Cyclomix (Hosokawa Micron K.K.); Spiral Pin Mixer (Traheiyo Kiko K.K.), Lodige Mixer (Matsubo Co. Ltd.). The kneaders may include: Buse Cokneader (Buss Co.), TEM Extruder (Toshiba Kikai K.K.), TEX Twin-Screw Kneader (Nippon Saeiko K.K.), PCM Kneader (Ikegai Tekko K.K.); Three Roll Mills, Mixing Roll Mill and Kneader (Inoue Seisakusho K.K.), Kneadex (Mitsui Kozan K.K.); MS-Pressure Kneader and Kneadersuder (Moriyama Seisakusho K.K.), and Bambury Mixer (Kobe Seisakusho K.K.). As the pulverizers. Cowter Jet Mill, Micron Jet and Inomizer (Hosokawa Micron K.K.); IDS Mill and PJM Jet Pulberizer (Nippon Pneumatic Kogyo K.K.); Cross Jet Mill (Kurimoto Tekko K.K.), Ulmax (Nisso Engineering K.K.), SK Jet O. Mill (Seishin Kigyo K.K.), Krypron (Kawasaki Jukogyo K.K.), and Turbo Mill (Turbo Kogyo K.K.). As the classifiers, Classiell, Micron Classifier, and Spedic Classifier (Seishin Kigyo K.K.), Turbo Classifier (Nisshin Engineering K.K.); Micron Separator and Turboplex (ATP); Micron Separator and Turboplex (ATP); TSP Separator (Hosokawa Micron K.K.); Elbow Jet (Nittetsu Kogyo K.K.), Dispersion Separator (Nippon Pneumatic Kogro K.K.), YM Microcut (Yasukwa Shoji K.K.). As the sieving apparatus, Ultraonic (Koei Sangro K.K.), Rezona Sieve and Gyrosifter (Tokuju Kosaku K.K.), Vitrasonic System (Dolton K.K.), Sonicreen (Shinto Kogyo K.K.), Turboscreener (Turbo Kogyo K.K.), Microshifter (Makino Sangyo K.K.), and circular vibrating sieves.

An example structure of a developing sleeve as a developer-varying member used in an image forming method according to the present invention will be described with reference to FIG. 1.

The sleeve as a developer-carrying member suitably used in the present invention comprises a resinous material at least as a surface material. More specifically, the sleeve comprises a cylindrical sleeve formed of a resin-containing material, or comprises a cylindrical substrate 6 and a surface coating layer (resinous layer) 1 on the substrate surface, as partly shown in FIG. 1. Referring to FIG. 1, the resinous layer 1 comprises a binder resin 4, and optionally an electroconductive substance 2, a filler 3, a solid lubricant 5, etc., and is disposed to coat the cylindrical substrate 6. In the case where the slectroconductive substance 2 is contained, the resinous layer 1 is provided with an electroconductivity to prevent excessive charge of the toner. In the case where the filler 3 is contained, the wearing of the resinous layer 1 by the toner can be suppressed, and the toner charge can be suitably controlled due to a charge-imparting effect of the filler 3. In the case where the solid lubricant 5 is contained. the releasability between the toner and the sleeve is enhanced, whereby the melt-sticking of the toner onto the sleeve can be prevented. The cylindrical substrate 6 coated with the resinous surface layer 1 may be composed of a material, such as metal, alloy, metal compound. ceramic or resin.

In the case of containing an electroconductive substance, the resinous layer 1 may preferably have a volume resistivity of at most $10^6$ ohm.cm, more preferably at most $10^3$ ohm.cm. If the resinous layer has a volum resistivity exceeding $10^6$ ohm.cm, the toner charge-up is liable to occur, thus causing the occurrence of blotches or deterioration of developing performances.

The resinous layer 1 may preferably have a surface roughness in terms of JIS-center line average roughness (Ra) in the range of 0.2–3.5 $\mu$m. If Ra is below 0.2 $\mu$m, a portion of the toner in proximity to the sleeve surface is liable to be excessively charged, so that the toner is attracted to the sleeve due to the image force and fresh toner cannot be provided with a charge from the sleeve, whereby the developing performance can be insufficient. If Ra exceeds 3.5 $\mu$m, the toner coating amount on the sleeve is excessively increased, so that toner cannot be sufficiently charged but is ununiformly charged, thus causing image density lowering and image density irregularities.

Next, the materials constituting the resinous layer 1 will be respectively described.

Referring to FIG. 1, the electroconductive substance 2 may for example comprise powder of: a metal, such as aluminum, copper, nickel, or silver; powder of a metal oxide such as antimony oxide, indium oxide, or tin oxide; or carbon allotrope, such as carbon fiber, carbon black or graphite. Among these, carbon black is particularly in electroconductivity-imparting effect and is suitably used to be incorporated in a polymeric material to provide an arbitrary level of conductivity by control of the addition amount thereof. The carbon black having a number-average particle size of at most 1 $\mu$m, preferably 0.01–0.8 $\mu$m, is suitably used in the present invention. In case of using carbon black having an average particle size exceeding 1 $\mu$m, it becomes difficult to control the volume resistivity of the resinous layer 1.

The electroconductive substance 2 may preferably be added in 0.1–300 wt. parts, more preferably 1–100 wt. parts, per 100 wt. parts of the binder resin 4 constituting the resinous coating layer 1.

The filler 3 may comprise a negative or positive charge control agent for toners. Examples of other materials constituting the filler 3 may include: inorganic compounds, such as aluminum, asbestos, glass fiber, calcium carbonate, magnesium carbonate, barium carbonate, barium sulfate, silica and calcium silicate; phenolic resin, epoxy resin, melamine resin, silicone resin, polyimathyl methacrylate, methacrylate copolymers such as styrene/n-butylmethacrylate/silane terpolymer, styrene-butadiene copolymer, polycaprolac tone; nitrogen-containing compounds, such as polycaprolactam, polyvinylpyridine, and polyamide; halogen-containing polymer, such as polyvinylidene fluoride, polyvinyl chloride, polytetrafluoroethylene, polytetrachlorofluoroethylene, perfluoroalkoxylated ethylene, polytetrafluoroalkoxyethylene, fluorinated ethylene-propylene-tetrafluoroethylene copolymer, and trifluorochloroethylene-vinyl chloride copolymer; polycarbonate, and polyester. Among these, silica and alumina are preferred because of their hardness and toner chargeability controlling effect.

Such fillers may preferably be used in 0.1–500 wt. part, more preferably 1–200 wt. parts, per 100 wt. parts of the binder resin.

The solid lubricant 5 may comprise, e.g., molybdenum disulfide, boron nitride, graphite, fluorinated graphite, silver-niobium selenide, calcium chloride-graphite, or talc. Among these, graphite may preferably be used because it has electroconductivity in addition to lubricity and may exhibit a function of reducing a portion of toner having an excessive charge to provide a level of charge suitable for development.

The solid lubricant may preferably be added in 0.1–300 wt. parts, more preferably 1–150 wt. parts, per 100 wt. parts of the binder resin.

The binder resin 4 used for constituting the resinous coating layer 1 optionally together with such electroconductive substance 2, filler 3 or/and solid lubricant 5, added as desired, may comprise a resin, such as phenolic resin, epoxy resin, polyamide resin, polyester resin, polycarbonate resin, polyolefin resin, silicone resin, fluorine-containing resin, styrene resin or acrylic resin. It is particularly preferred to use a thermosetting or photocurable resin.

The developing sleeve may be provided with further preferable performances by surface treatment thereof as by abrasion or polishing for surface smoothing described below so as to expose the electroconductive substance 2, filler 3 or/and solid lubricant 5 to the sleeve surface at an appropriate level, or/and to smooth the surface for providing a surface with a uniform unevenness. This is particularly effective for suppressing longitudinal streaks appearing in solid black or halftone images or quickly providing a sufficient image density at the startup of image formation, particularly in a high temperature/high humidity environment.

Figure 2A:
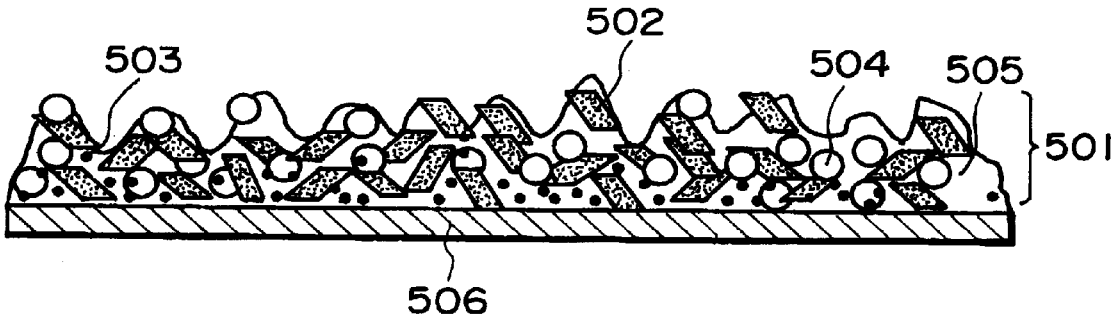
FIGS. 2A and 2B are partial sectional views of a developer-carrying member used in the invention before and after a polishing treatment, respectively.
Figure 2B:
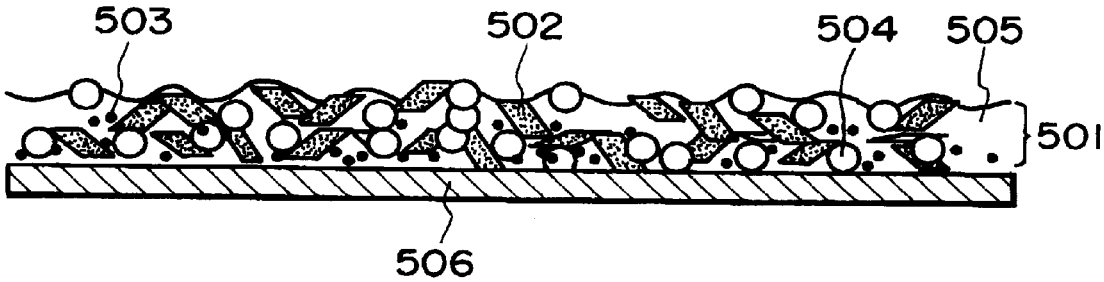

An example of such a sleeve-surface treatment is described with reference to FIGS. 2A and 2B. Referring to FIG. 2A, a resinous coating layer 501 contains a solid lubricant 502, an electroconductive substance 503, a filler 504 and a binder 505 and is disposed to coat a cylindrical substrate 506. If the resinous coating layer 501 is subjected to a polishing treatment with an abrasion or polishing strip of felt or abrasive particle-attached strip, the sleeve surface roughness can be finished evenly as shown in FIG. 2B, whereby the toner coating amount on the sleeve can be uniformized, thereby allowing only toner particles subjected to triboelectrification with the sleeve to be conveyed to the developing region. This is assumed to be the mechanism for the above-mentioned improved performances.

Even after the surface-smoothing treatment, the coating layer may preferably retain a surface roughness Ra (according to JIS B0601) in the range of 0.2–3.5 $\mu$m, more preferably 0.3–2.5 $\mu$m, for the same reason as described above.

The cylindrical substrate 6 may preferably comprise a cylinder of a non-magnetic metal or a resin. For example, a non-magnetic cylindrical tube, such as that of stainless steel, aluminum or copper, may be produced through drawing or extrusion, preferably followed by cutting or polishing for improving the size accuracy to a prescribed size accuracy. The cylindrical tube may preferably have a straight allowance of at most 30 $\mu$m, more preferably at most 20 $\mu$m. The tube may be subjected to sand blasting or abrasion for provide a rough surface with an appropriate degree of surface unevenness. The blasting may be performed by using abrasive particles which may he definitely shaped or indefinitely shaped.

Figure 3:
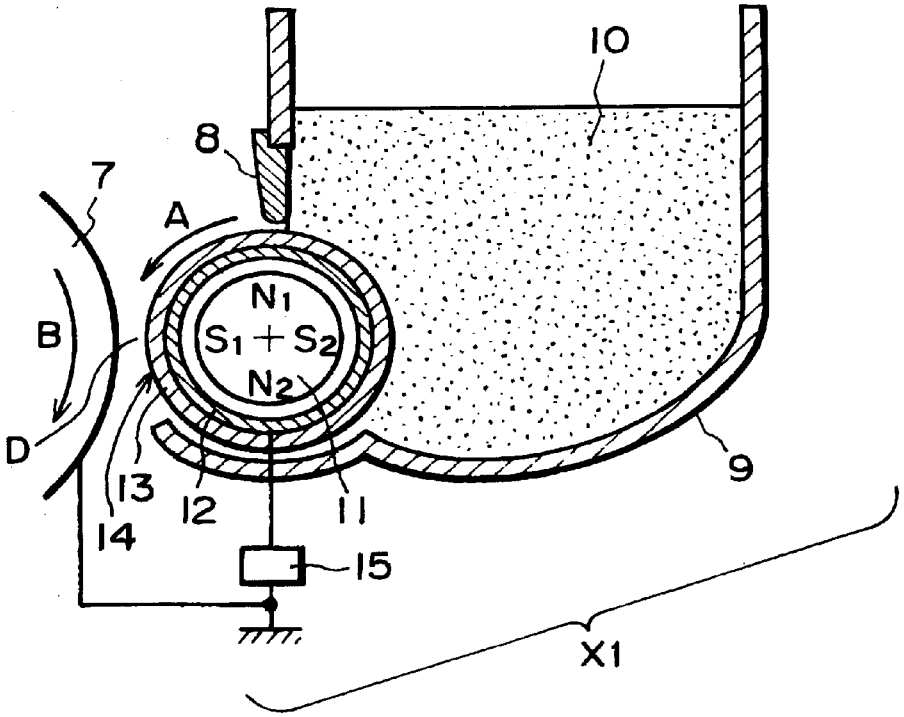
FIGS. 3 and 4 are side sectional illustrations of developing devices using a magnetic regulating blade and an elastic regulating blade, respectively, and including a developer carrying member as mentioned above for supplying a magnetic developer.

Now, an example of developing method using such a developing sleeve as a developer-carrying member with reference to FIG. 3. Referring to FIG. 3, a developing apparatus X1 is operated in combination with an electrophotographic photosensitive drum 7 (as an example of an image-bearing member for bearing an electrostatic image formed by a known process) which is rotated in a direction of arrow B. On the other hand, a developing sleeve 14 (as a developer-carrying member) carrying a toner 10 (as a monocomponent developer) supplied from a hopper 9 is rotated in a direction of arrow A to convey a layer of the toner 10 to a developing region D where the developing sleeve 14 and the photosensitive drum 7 oppose each other. In case where the toner 10 is a magnetic toner, a magnet 11 is disposed within the developing sleeve so as to magnetically attract and hold the magnetic toner 10 on the developing sleeve, whereby the toner is subjected to friction with the developing sleeve 13 to acquire a triboelectric charge sufficient for developing an electrostatic image on the photosensitive drum 7.

In order to regulate the layer thickness of the magnetic toner 10, a regulating magnetic blade 8 comprising a ferromagnetic metal is hung down from the hopper 9 to confront the developing sleeve 14 with a gap of ca 200–300 $\mu$m from the surface of the developing sleeve 14. Lines of magnetic induction from a magnetic pole $N_1$ of the magnet 11 are concentrated to the blade 8, whereby a thin layer of the toner 10 is formed on the developing sleeve 14. The blade 8 can also comprise a non-magnetic blade.

The thin layer thickness of the toner 10 formed on the developing sleeve 14 may preferably be smaller than the minimum gap between the developing sleeve 14 and the photosensitive drum 7 at the developing region D The developing method according to the present invention is particularly effective in such a developing apparatus for the scheme wherein an electrostatic image is developed with such a thin layer of toner, i.e, a non-contact type developing apparatus. However, the developing method according to the present invention is also applicable to a developing apparatus wherein the toner layer thickness is larger than the minimum gap between the developing sleeve 14 and the photosensitive drum 7 at the developing region, i.e., a contact-type developing apparatus.

Hereinbelow, further description of a non-contact type developing apparatus will be made.

Referring again to FIG. 3, the developing sleeve 14 is supplied with a developing bias voltage from a power supply 15 so as to cause a jumping of a toner 10 (as a monocomponent developer) carried on the developing sleeve 14. In case where the developing bias voltage is a DC voltage, it is preferred that the developing sleeve 14 is supplied with a developing bias voltage which is equal to a voltage given as a difference between a potential of an image region (where the toner 10 is attached to provide a visual image region) and a potential of a background region of an electrostatic image. On the other hand, in order to increase the density or gradational characteristic of a developed image, it is also possible to apply an alternating bias voltage to the developing sleeve 14, thereby forming a vibrating field of which the voltage polarity alternates with time at the developing region. In this case, it is preferred that the developing sleeve 14 is supplied with an alternating bias voltage superposed with a DC voltage component equal to the above-mentioned difference between the image region potential and the background region potential.

Further, in the case of so-called normal development scheme wherein a toner is attached to a higher potential region of an electrostatic image having such a higher-potential region and a lower potential region, a toner charged to a polarity opposite to that of the electrostatic image is used. On the other hand, in the case of the reversal development scheme wherein a toner is attached to a lower-potential region of an electrostatic image, a toner charged to a polarity identical to that of the electrostatic image is used. Herein, a higher-potential and a lower-potential refers to potential in terms of absolute value. In any case, the toner 10 is triboelectrically charged due to friction between the toner 10 and the developing sleeve 14 to a polarity appropriate for developing an electrostatic image on the photosensitive drum 7.

Figure 4:
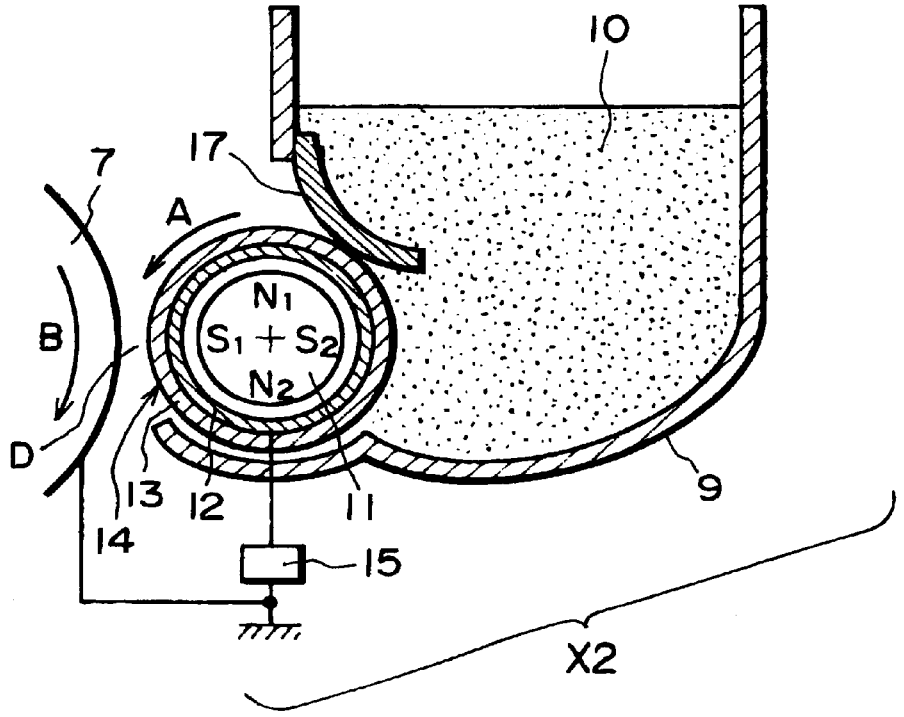

FIG. 4 shows another embodiment of developing apparatus.

In a developing apparatus X2 shown in FIG. 4, an elastic plate 17 comprising a material having a rubber elasticity, such as urethane rubber or silicone rubber, or a material having a metal elasticity, such as phosphor bronze or stainless steel, is used as a member for regulating the layer thickness of toner 10 on a developing sleeve 14, and the elastic plate 17 is pressed against the developing sleeve 14. In such a developing apparatus, a further thin toner layer can be formed on the developing sleeve 14. The other structure of the developing apparatus shown in FIG. 4 is basically identical to that of the apparatus shown in FIG. 3, and identical numerals in FIG. 4 represent identical members as in FIG. 3.

In the developing apparatus of FIG. 4, the toner is applied by rubbing with the elastic plate 17 onto the developing sleeve 14 to form a toner layer thereon, so that the toner can be provided with a larger triboelectric charge and thus results in a higher image density. This type of developing apparatus is used for a non-magnetic mono-component toner.

Next, an example of image forming method including a contact charging and transfer scheme according to the present invention will be described with reference to FIG. 5, which illustrates an image forming apparatus including a contact charging means and a contact transfer means while the developing method according to the present invention is also applicable to an image forming method including a corona charging scheme or/and a corona transfer scheme.

Figure 5:
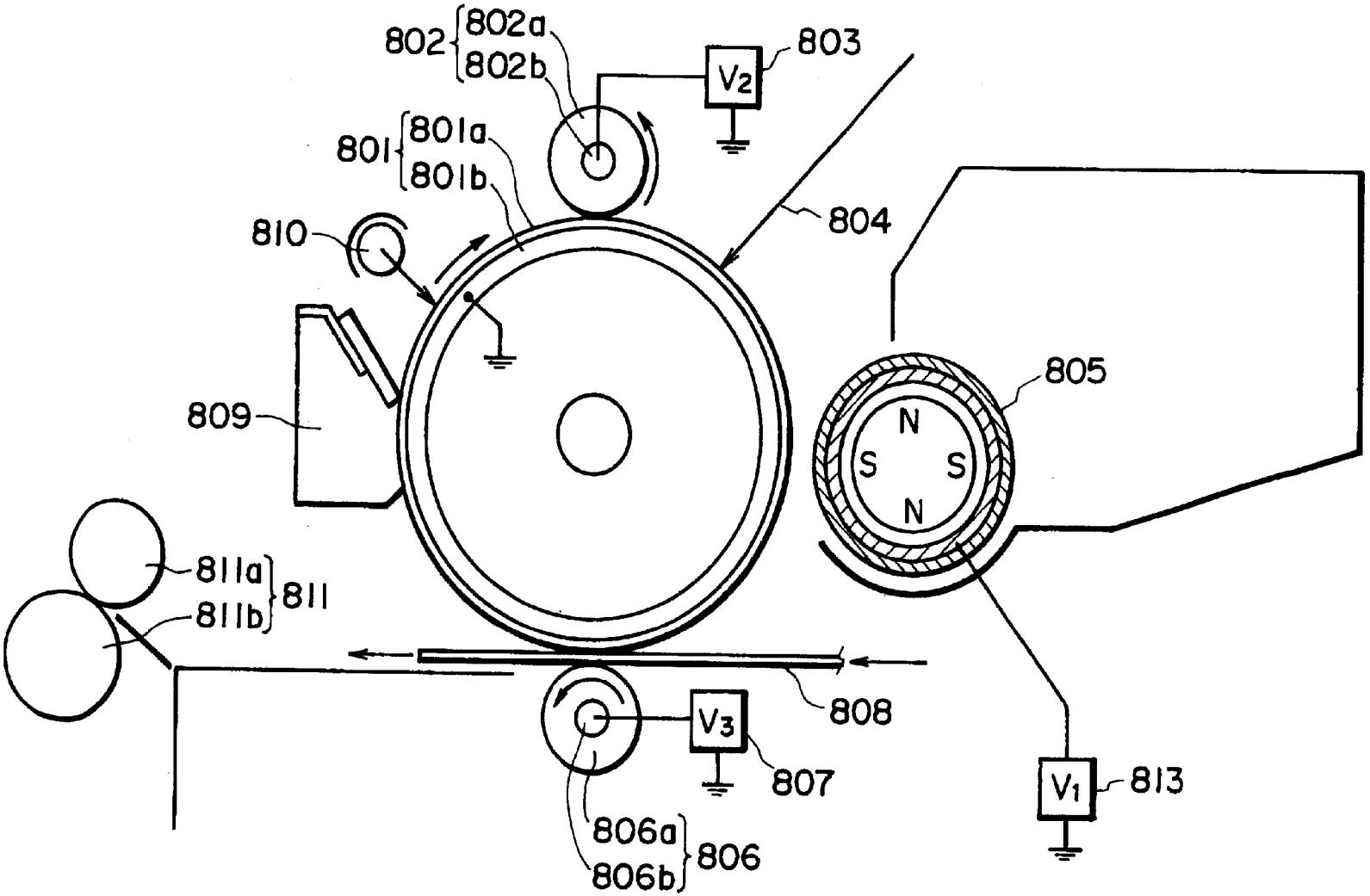
FIG. 5 schematically illustrates an image forming system according to the invention.

Referring to FIG. 5, a rotating drum-type photosensitive member 801 comprising a photoconductor layer 801*a* and an electroconductive substrate 801*b* is rotated at a prescribed peripheral speed (process speed) in a clockwise direction as shown on the drawing. A charging roller 802 comprising an electroconductive elastic layer 802*a* and a core metal 802*b* is supplied with a bias voltage V2 from a charging bias voltage supply 803. The charging roller 802 is pressed against the photosensitive member 801 and is rotated following the rotation of the photosensitive member 801.

Based on the bias voltage applied to the charging roller 802, the surface of the photosensitive member 801 is charged to a prescribed voltage of a prescribed polarity. Then, the charged photosensitive member 801 is exposed to image light 804 to form an electrostatic image thereon, which is then visualized as a toner image by a developing means 805. The developing means 805 includes a developing sleeve which is supplied with a bias voltage V1 from a developing bias voltage supply 813.

The toner image formed on the photosensitive member 801 is electrostatically transferred onto a transfer-receiving material 808 under the action of a transfer bias voltage V3 supplied from a voltage supply 807 via a transfer roller 806 (as a contact transfer means for pressing the transfer-receiving material 808 onto the photosensitive member 801) comprising an electroconductive elastic layer 806*a* and a core metal 806*b*. The toner image transferred onto the transfer-receiving material 808 is then fixed onto the transfer-receiving material 808 under application of heat and pressure by a heat-pressure fixing means 811 comprising a heating roller 811*a* and a pressure roller 811*b*. The surface of the photosensitive member 801 is subjected to cleaning for removal of attached soiling substance, such as transfer residual toner by a cleaning device 809 having an elastic cleaning blade abutted against the photosensitive member 801 in a counter direction, and then charge-removed by a charge-removing exposure means 810, to be used for a subsequent cycle of image formation.

While the charging roller 802 has been described as a contact charging means in the above embodiment, the primary charging means can also comprise another contact charging means, such as a charging blade or a charging brush, or alternatively a non-contact corona charging means. However, the contact charging means is less liable to cause the generation of ozone.

Further, while the transfer roller 806 has been described, the transfer means can also comprise another contact transfer means, such as a transfer blade or a transfer belt, or alternatively a non-contact corona transfer means. The contact transfer means is less liable to cause the occurrence of ozone.

As described above, the toner according to the present invention characterized by a combination of a binder resin comprising at least one member selected from the group consisting of (i) a mixture of vinyl resin having a carboxyl group and a vinyl resin having a glycidyl group, (ii) a vinyl resin having both a carboxyl group and a glycidyl group, and (iii) a vinyl resin having a carboxyl group and a glycidyl group in a form reacted with each other, and a specific imidazole compound, is provided with improved anti-offset property and fixability in combination especially when used in a high-speed image forming apparatus, without impairing adequate chargeability and powdery characteristics. Further, when used in combination with a developer-carrying member comprising a resinous coating layer on a metal substrate, the toner can exhibit remarkably improved chargeabillty, and thus improved developing performances, thereby providing high-definition images free of image density lowering or fog stably for a long period without being affected by environmental changes.

Further, as the chargeability and powder characteristics have been improved, the toner can stably provide high-definition images, without causing problems in the cleaning step, such as melt-sticking, cleaning failure, toner plugging during the conveyance and leakage spots.

EXAMPLES

Hereinbelow, the present invention will be described more specifically based on Examples.

Examples 1–28 and Comparative Examples 1–4

<Production of Carboxylic vinyl resin A-1>

| | |
|---|---|
| Styrene | 81 wt.part(s) |
| n-Butyl acrylate | 18 " |
| Methacrylic acid | 1 " |
| Di-t-butyl peroxide | 2 " |

The above ingredients were added dropwise in 4 hours to 200 wt. parts of xylene which had been sufficiently aerated with nitrogen and heated to 120° C. under stirring in a four-necked flask. Then, the polymerization was completed under reflux of xylene, followed by distilling-off of the solvent under a reduced pressure to recover a polymerizate, which is referred to herein as Carboxylic (i.e., carboxyl group-containing) vinyl resin A-1 or simply Resin A-1.

Resin A-1 exhibited Mn=5600, Mw=41000, Tg=59° C., acid value (Av)=6.4, and THF-insoluble content ($THF_{ins}$)=0 wt. %.

<Production of Carboxylic vinyl resin A-2>

| | |
|---|---|
| Styrene | 80 wt.part(s) |
| n-Butyl acrylate | 18 " |

-continued

| | |
|---|---|
| Acrylic acid | 2 " |
| Di-t-butyl peroxide | 2 " |

Resin A-2 was prepared similarly as Resin A-1 except for using the above ingredients. Resin A-2 exhibited Mn=4800, Mw=45000, Tg=60° C., Av=15.5, and $THF_{ins}$=0 wt. %.

<Production of Carboxylic vinyl resin A-3>

| | |
|---|---|
| Styrene | 72 wt.part(s) |
| n-Butyl acrylate | 18 " |
| Methacryloyloxysuccinic acid | 6 " |
| Di-t-butyl peroxide | 2 " |

Resin A-3 was prepared similarly as Resin A-1 except for using the above ingredients. Resin A-3 exhibited Mn=6100, Mw=37000, Tg=58° C. Av=14.4, and $THF_{ins}$=0 wt. %.

<Production of Carboxylic vinyl resin A-4>

| | |
|---|---|
| Styrene | 81 wt.part(s) |
| n-Butyl acrylate | 18 " |
| Monobutyl maleate | 1 " |
| Di-t-butyl peroxide | 2 " |

Resin A-4 was prepared similarly as Resin A-1 except for using the above ingredients. Resin A-4 exhibited Mn=7200, Mw=39000, Tg=58° C., Av=3.2, and $THF_{ins}$=0 wt. %.

<Production of Carboxylic vinyl resin A-5>

| | |
|---|---|
| Styrene | 75 wt.part(s) |
| n-Butyl acrylate | 18 " |
| Acrylic acid | 7 " |
| Di-t-butyl peroxide | 2 " |

Resin A-5 was prepared similarly as Resin A-1 except for using the above ingredients. Resin A-5 exhibited Mn=5200, Mw=44000, Tg=58° C., Av=54.3, and $THF_{ins}$=0 wt. %.

<Production of Vinyl resin A-6>

| | |
|---|---|
| Styrene | 80 wt.part(s) |
| n-Butyl acrylate | 20 " |
| Di-t-butyl peroxide | 2 " |

Resin A-6 was prepared similarly as Resin A-1 except for using the above ingredients. Resin A-6 exhibited Mn=6300, Mw=46000, Tg=58° C., Av=0.0, and $THF_{ins}$=0 wt. %.

<Production of Carboxylic vinyl resin A-7>

| | |
|---|---|
| Styrene | 79.9 wt.part(s) |
| n-Butyl acrylate | 18 " |
| Acrylic acid | 0.1 " |
| Di-t-butyl peroxide | 2 " |

The above ingredients were added dropwise in 4 hours to 200 wt. parts of xylene which had been sufficiently aerated with nitrogen and heated to 120° C. under stirring in a four-necked flask. Then, the polymerization was completed under reflux of xylene, followed by distilling-off of the solvent under a reduced pressure to recover Resin A-7.

Resin A-7 exhibited Mn=5300, Mw=45000, Tg=58° C., Av=0.8, and $THF_{ins}$=0 wt. %.

<Production of Glycidyl vinyl resin B-1>

| | |
|---|---|
| Styrene | 80 wt.part(s) |
| n-Butyl acrylate | 18 " |
| Glycidyl methacrylate | 2 " |
| Di-t-butylperoxide | 5 " |

The above ingredients were added dropwise in 4 hours to 200 wt. parts of xylene which had been sufficiently aerated with nitrogen and heated to 120° C. under stirring in a four-necked flask. Then, the polymerization was completed under xylene reflux, followed by distilling-off of the solvent under a reduced pressure to recover a polymerizate, which is referred to herein as Glycidyl (group-containing) vinyl resin B-1 or simply Resin B-1.

Resin B-1 exhibited Mw=28000, epoxy value (Ev)=0.14 eq/kg, and $THF_{ins}$=0 wt. %.

<Production of Glycidyl vinyl resin B-2>

| | |
|---|---|
| Styrene | 78 wt.part(s) |
| n-Butyl acrylate | 18 " |
| Glycidyl methacrylate | 4 " |
| Di-t-butyl peroxide | 5 " |

Resin B-2 was prepared similarly as Resin B-1 except for using the above ingredients. Resin B-2 exhibited Mw=22000, Ev=0.28 eq/kg, and $THF_{ins}$=0 wt. %.

<Production of Glycidyl vinyl resin B-3>

| | |
|---|---|
| Styrene | 74 wt.part(s) |
| n-Butyl acrylate | 18 " |
| Glycidyl methacrylate | 8 " |
| Di-t-butyl peroxide | 5 " |

Resin B-3 was prepared similarly as Resin B-1 except for using the above ingredients. Resin B-3 exhibited Mw=26000, Ev=056 eq/kg, and $THF_{ins}$=0 wt. %.

<Production of Glycidyl vinyl resin B-4>

| | |
|---|---|
| Styrene | 66 wt.part(s) |
| n-Butyl acrylate | 18 " |
| Glycidyl methacrylate | 16 " |
| Di-t-butyl peroxide | 5 " |

Resin B-4 was prepared similarly as Resin B-1 except for using the above ingredients. Resin B-4 exhibited MW=20000, Ev=1.13 eg/kg, and $THF_{ins}$=0 wt. %.

<Production of Glycidyl vinyl resin B-5>

| | |
|---|---|
| Styrene | 60 wt.part(s) |
| n-Butyl acrylate | 8 " |
| Glycidyl methacrylate | 32 " |
| Di-t-butyl peroxide | 5 " |

Resin B-5 was prepared similarly as Resin B-1 except for using the above ingredients Resin B-5 exhibited Mw=20000, Ev=2.25 eq/kg, and $THF_{ins}$=0 wt. %.

<Production of Developing Sleeve 1>

| | | |
|---|---|---|
| Phenolic resin intermediate | 125 | wt.part(s) |
| Carbon black | 5 | " |
| Crystalline graphite | 45 | " |
| Methanol | 41 | " |
| Isopropyl alcohol | 284 | " |

A paint was prepared from the above ingredients by diluting a methanol solution of phenolic resin intermediate in isopropyl alcohol (IPA), adding carbon black and crystalline graphite, and dispersing the ingredients together with glass beads in a sand mill. The paint was applied onto a sleeve substrate to form a resinous coating layer.

More specifically, the sleeve substrate was prepared by polishing a stainless steel-made cylinder of 20 mm in outer diameter and 0.8 mm in thickness to provide a straight or vibration allowance of at most 10 $\mu$m and a surface roughness (Rz) of at most 4 $\mu$m. The sleeve substrate was set vertically with masking for a width of 3 mm each at its upper and lower ends and rotated at a constant speed, and the above paint was applied from a spray gun while causing the spray gun to descent at a constant speed. The coating on the sleeve was heated at 160° C. for 20 min. in a drying oven for drying and curing, and the cured resin-coated sleeve surface was rubbed for surface polishing with a felt strip at a pressing load of 39.2 N (4 kgf) to obtain a sleeve having a resinous coating layer of uniform thickness.

The resinous layer had a thickness of 10 $\mu$m, a 6 point-average roughness (Ra) of 0.86 $\mu$m and a volume resistivity (Rv) of 4 ohm.cm and exhibited a pencil hardness of 2H. A magnet was inserted into the sleeve and flanges were attached to both ends thereof to provide Developing sleeve 1.

<Production of Developing sleeve 2>

A 20 mm-outer dia. (OD) and 0.8 mm-thick stainless steel-made cylinder similar to the one used in Production of Developing sleeve 1 was similarly polished to provide a vibration allowance of at most 10 $\mu$m and a surface roughness (Rz) of at most 4 $\mu$m. After masking for a width of 3 mm each at both ends, the sleeve was subjected to a blasting treatment with indefinitely shaped alumina abrasive particles (#300) at a blasting pressure of 0.392 MPa (4.0 kgf/cm$^2$) by means of a blasting machine. The thus blasted sleeve exhibited a 6 point-average surface roughness (Ra) of 1.12 $\mu$m. A magnet was inserted into the blasted sleeve and flanges were attached to both ends to provide Developing sleeve 2.

Example 1

| | | |
|---|---|---|
| Carboxylic vinyl resin A-1 | 95 | wt.part(s) |
| Glycidyl vinyl resin B-3 | 5 | " |
| Magnetite | 90 | " |
| Polyethylene wax | 4 | " |
| Imidazole compound (2-1) | 2 | " |

The above ingredients were sufficiently preliminarily blended by a Henschel mixer and melt-kneaded through a twin-screw kneading extruder set at 150° C. After cooling, the kneaded product was coarsely crushed by a cutter mill, finely pulverized by a pulverizer using an air jet stream and classified by a pneumatic classifier to obtain classified powder (toner particles) having a weight-average particle size (D4) of 7.5 $\mu$m. The melt-viscosity during the kneading of the above ingredients was higher than during the kneading of identical ingredients but excluding Glycidyl vinyl resin B-3, whereby a reaction of Carboxylic vinyl resin A-1 and Glycidyl vinyl resin B-3 was confirmed. Moreover, the resultant toner particles exhibited $THF_{ins}$=15.4 wt. % increased from $THF_{ins}$=0 wt. % of both Resin A-1 and Resinl B-3, thus showing a substantial occurrence of THF-insoluble matter.

100 wt. parts of the above-prepared toner particles were blended by a Henschel miser with 0.8 wt. part of hydrophobic silica prepared by treating 100 wt. parts of dry-process silica fine powder (BET specific surface area ($S_{BET}$)=200 m$^2$/g) with 17 wt. parts of amino-modified silicone oil (amine equivalent=830, viscosity at 25° C.=70 mm$^2$/s), and the blend was sieved through a screen having a mesh opening of 150 $\mu$m to obtain Toner 1, which exhibited properties shown in Table 2 hereinafter.

Toner 1 was subjected to performance evaluation test with respect to the following items.

Anti-offset Property

The fixing device of a commercially available copying machine ("NP4080", mfd. by Canon K.K.) was taken out of the main body and remodeled so as to be able to arbitrarily set the fixing temperature and a process speed of 50 mm/sec, thereby providing an external fixing device. The anti-offset property was evaluated by passing a transfer paper sheet of 64 g/m$^2$ having yet-unflexed toner image on its smoother surface (so-called "felt surface") through the fixing device at fixing temperatures set by increments of 5° C. each in a temperature range of 170–250° C. in an environment of normal temperature/normal humidity (NT/NH=23° C./60% RH), whereby the offset behavior was observed to determine a highest offset-free temperature ($T_{of}$) as a measure of anti-offset property A higher highest offset-free temperature represents a better anti-offset property.

Fixability

The above external fixing device was operated at a process speed of 200 mm/sec and at fixing temperatures set by increments of 5° C. each in a temperature range of 120–200° C. Yet-unfixed toner images on a coarser surface (so-called "wire surface") of a transfer paper sheet of 64 g/m$^2$ were fixed at the respective temperatures in an environment of normal temperature/normal humidity (NT/NH=23° C./60% RH). The fixed images at the respective fixing temperatures ere rubbed for 5 reciprocations with a lens cleaning paper under a load of 4.9 kPa to determine the lowest fixing temperature giving an image density lowering of at most 10% as a fixing initiation temperature ($T_{in}$). A lower fixing initiation temperature represents a better fixability.

Anti-Blocking Property 20 g of a sample toner was placed in a plastic cup and left standing for 3 days in a thermostat vessel at 50° C. The state of the toner after the standing was observed with eyes and evaluated according to the following standard.

A (excellent): No block was observed but the toner flowing freely.

B (good): Slight agglomerates were observed but could be disintegrated instantaneously.

C (fair): Some agglomerates were observed but could be collapsed easily.

D (poor); Some block was observed and could not be easily disintegrated.

Sleeve Coating State

The toner coating state on the sleeve was observed and evaluated with respect to the occurrence of blotches and streaks due to toner coating irregularity according to the following standard in environments of (NT/NR=23° C./60% RH), normal temperature/low humidity (NT/LH=23° C./5% RH) and high temperature/high humidity (HT/HH=30° C./80% RH).

A (excellent): No occurred at all.

B (good): Slight blotches or streaks occurred at sleeve edges.

C (fair): Occurred but not affecting the images.

D (poor): Noticeably occurred and affecting the images.

Image Evaluation and Fixing Heating Member Durability

A commercially available copying machine ("NP6016", mfd. by Canon K.K.) was used after exchanging the developing sleeve with Developing sleeve 2 prepared above for copying on 20000 sheets in an environment of NT/NH (=23° C./60% RH) and on 10000 sheets each in environments of NT/LH (=23° C./5% RH) and HT/HH (=30° C./80% RH), and the performances of a sample toner were evaluated with respect to image density (ID), fog and image soiling due to cleaning failure or melt-sticking.

<Image density (ID)>

Measured by using a Macbeth reflection densitometer (mfd by Macbeth Co.).

<Fog>

Measured as a difference between a reflection density of a transfer paper before use and a density of the transfer paper after copying a blank white image thereon, respectively measured by using a reflection densitometer (mfd. by Tokyo Denshoku Gijutsu Center K.K.).

<Sleeve soiling>

A part of the developing sleeve surface after a continuous copying on 20,000 sheets in the NT/NH (23° C./60% RH) environment was cleaned by wiping with a cloth impregnated with ethanol, and by using the developing sleeve after the ethanol wiping, a solid black image was formed, to determine an image density difference ΔID between the parts subjected to and not subjected to the ethanol wiping. The sleeve soiling was evaluated based on ΔID according to the following standard.

A (excellent): ΔID<0.03

B (good): ΔID=0.03–0.10

C (fair): ΔID=0.10–0.20

D (poor): ΔID>0.20.

<Image soiling>

A (excellent): Not occurred at all.

B (good): Slight soil occurred but at a level of practically no problem.

C (fair): Spotty and streak-like soil occurred and disappeared repetitively.

D (poor): Soil occurred and not disappeared.

<Soil on fixing member>

A (excellent): Almost no soil observed.

B (good): Some soil observed but at a level of practically no problem.

C (fair): Separation failure could occur.

D (poor); Images were soiled due to the soil on the fixing member.

The results of the above evaluation for Toner 1 are inclusively shown in Table 3 together with those of toners prepared in the following Examples and Comparative Examples.

Example 2

| | |
|---|---|
| Carboxylic vinyl resin A-2 | 95 wt.part(s) |
| Glycidyl vinyl resin B-2 | 5 " |
| Magnetite | 90 " |
| Polyethylene wax | 4 " |
| Imidazole compound (2-3) | 2 " |

Toner particles (D4=7.6 μm) were prepared in the same manner as in Example 1 except for using the above ingredients, and Toner 2 was prepared therefrom and evaluated otherwise in the same manner as in Example 1.

Example 3

| | |
|---|---|
| Carboxylic vinyl resin A-3 | 95 wt.part(s) |
| Glycidyl vinyl resin B-1 | 5 " |
| Magnetite | 90 " |
| Polyethylene wax | 4 " |
| Imidazole compound (2-5) | 2 " |

Toner particles (D4=7.4 μm) were prepared in the same manner as in Example 1 except for using the above ingredients, and Toner 3 was prepared therefrom and evaluated otherwise in the same manner as in Example 1.

Example 4

| | |
|---|---|
| Carboxylic vinyl resin A-4 | 95 wt.part(s) |
| Glycidyl vinyl resin B-4 | 5 " |
| Magnetite | 90 " |
| Polyethylene wax | 4 " |
| Imidazole compound (2-10) | 2 " |

Toner particles (D4=7.3 μm) were prepared in the same manner as in Example 1 except for using the above ingredients, and Toner 4 was prepared therefrom and evaluated otherwise in the same manner as in Example 1.

Examples 5–14

| | |
|---|---|
| Carboxylic vinyl resin A (indicated in Table 2) | 95 wt.part(s) |
| Glycidyl vinyl resin B (indicated in Table 2) | 5 " |
| Magnetite | 90 " |
| Polyethylene wax | 4 " |
| Imidazole compound (indicated in Table 2 by number) | 2 " |

Ten species of toner particles (D4=7.0–8.0 μm) were respectively prepared in the same manner as in Example 1 except for using the ingredients of the above-indicated prescriptions with species of resins shown in Table 2 appearing hereinafter and Toners 5–14 were prepared respectively therefrom and evaluated otherwise in the same manner as in Example 1.

Comparative Example 1

| | |
|---|---|
| Vinyl resin A-6 (not containing carboxylic group) | 95 wt.part(s) |
| Glycidyl vinyl resin B-1 | 5 " |
| Magnetite | 90 " |
| Polyethylene wax | 4 " |
| Imidazole compound (4-4) | 2 " |

Toner particles (D4=7.4 μm) were prepared in the same manner as in Example 1 except for using the above ingredients, and Toner 15 was prepared therefrom and evaluated otherwise in the same manner as in Example 1.

Comparative Example 2

| | |
|---|---|
| Carboxylic vinyl resin A-1 | 95 wt.part(s) |
| Glycidyl vinyl resin B-3 | 5 " |
| Magnetite | 90 " |
| Polyethylene wax | 4 " |
| Nigrosine compound | 2 " |

Toner particles (D4=7.5 μm) were prepared in the same manner as in Example 1 except for using the above ingredients, and Toner 16 was prepared therefrom and evaluated otherwise in the same manner as in Example 1.

Comparative Example 3

| | |
|---|---|
| Carboxylic vinyl resin A-1 | 100 wt.part(s) |
| Magnetite | 90 " |
| Polyethylene wax | 4 " |
| Imidazole compound (2-1) | 2 " |

Toner particles (D4=7.5 μm) were prepared in the same manner as in Example 1 except for using the above ingredients, and Toner 17 was prepared therefrom and evaluated otherwise in the same manner as in Example 1.

Comparative Example 4

| | |
|---|---|
| Carboxylic vinyl resin A-1 | 95 wt.part(s) |
| Glycidyl vinyl resin B-3 | 5 " |
| Magnetite | 90 " |
| Polyethylene wax | 4 " |
| Salicylic acid aluminum compound | 1 " |
| Triphenylmethane lake pigment | 2 " |

Toner particles (D4=7.5 μm) were prepared in the same manner as in Example 1 except for using the above ingredients, and Toner 18 was prepared therefrom and evaluated otherwise in the same manner as in Example 1.

TABLE 2-1

Toner properties

| Ex. or Comp. Ex. | Ex.1 | Ex.2 | Ex.3 | Ex.4 | Ex.5 | Ex.6 | Ex.7 | Ex.8 | Ex.9 |
|---|---|---|---|---|---|---|---|---|---|
| Toner No. | 1 | 2 | 3 | 4 | 5 | 6 | 7 | 8 | 9 |
| Carboxylic vinyl resin | A-1 | A-2 | A-3 | A-4 | A-1 | A-1 | A-1 | A-2 | A-2 |
| Glycidyl vinyl resin | B-3 | B-2 | B-1 | B-4 | B-1 | B-2 | B-4 | B-1 | B-3 |
| Glycidyl/carboxyl ratio (B/A) (eq/eq) | 0.25 | 0.05 | 0.03 | 1.02 | 0.06 | 0.13 | 0.51 | 0.03 | 0.11 |
| Imidazole | 2-1 | 2-3 | 2-5 | 2-10 | 3-1 | 3-26 | 4-4 | 5-4 | 5-28 |
| Developing sleeve | 2 | 2 | 2 | 2 | 2 | 2 | 2 | 2 | 2 |
| Av (toner) (mgKOH/g) | 6.3 | 15.7 | 14.2 | 2.8 | 6.5 | 6.3 | 6.3 | 15.3 | 15.4 |
| Mn | 6700 | 5600 | 7200 | 6200 | 5800 | 6000 | 7100 | 5500 | 5800 |
| Mw | 85000 | 91000 | 78000 | 89000 | 68000 | 71000 | 92000 | 88000 | 93000 |
| Tg (toner) (° C.) | 58.1 | 58.8 | 56.9 | 57.1 | 58.0 | 58.2 | 58.3 | 58.7 | 59.2 |
| $THF_{ins}$ (wt. %) | 15.4 | 17.3 | 18.1 | 16.5 | 10.8 | 12.2 | 22.4 | 11.8 | 24.1 |
| Temp. for tanδ = 1 (° C.) | 98 | 97 | 97 | 98 | 99 | 99 | 97 | 99 | 96 |
| tanδ (80° C.) | 1.6 | 1.5 | 1.5 | 1.6 | 1.8 | 1.7 | 1.5 | 1.8 | 1.5 |
| tanδ (140° C.) | 0.72 | 0.68 | 0.66 | 0.70 | 0.78 | 0.74 | 0.64 | 0.78 | 0.62 |
| G' (80° C.) ($\times 10^5$ Pa) | 8.5 | 8.6 | 8.6 | 8.5 | 8.3 | 8.3 | 8.7 | 8.4 | 8.7 |
| G' (140° C.) ($\times 10^3$ Pa) | 5.1 | 5.3 | 5.4 | 5.2 | 4.7 | 5.0 | 6.1 | 4.9 | 6.2 |

TABLE 2-2

| Ex. or Comp. Ex. | Ex.10 | Ex.11 | Ex.12 | Ex.13 | Ex.14 | Comp. Ex.1 | Comp. Ex.2 | Comp. Ex.3 | Comp. Ex.4 |
|---|---|---|---|---|---|---|---|---|---|
| Toner properties | | | | | | | | | |
| Toner No. | 10 | 11 | 12 | 13 | 14 | 15 | 16 | 17 | 18 |
| Carboxylic vinyl resin | A-2 | A-3 | A-4 | A-7 | A-5 | A-6*1 | A-1 | A-1 | A-1 |
| Glycidyl vinyl resin | B-4 | B-2 | B-3 | B-5 | B-4 | B-1 | B-3 | — | B-3 |
| Glycidyl/carboxyl ratio (B/A) (eq/eq) | 0.22 | 0.06 | 0.51 | 8.62 | 0.06 | — | 0.25 | — | 0.25 |
| Imidazole | 7-1 | 8-9 | 9-1 | 2-32 | 4-4 | 4-4 | NG*2 | 2-1 | TM*3 |
| Developing sleeve | 2 | 2 | 2 | 2 | 2 | 2 | 2 | 2 | 2 |
| Av (toner) (mgKOH/g) | 15.5 | 14.0 | 3.0 | 0.4 | 54.2 | 0.0 | 6.5 | 6.4 | 6.2 |
| Mn | 6200 | 7500 | 5900 | 6400 | 6500 | 6200 | 5800 | 5500 | 6500 |
| Mw | 95000 | 81000 | 85000 | 79000 | 92000 | 44000 | 62000 | 40000 | 80000 |
| Tg (toner) (° C.) | 59.1 | 57.1 | 57.2 | 57.5 | 56.8 | 57.1 | 57.9 | 58.7 | 58.6 |
| $THF_{ins}$ (wt. %) | 35.5 | 42.1 | 6.8 | 20.8 | 63.5 | 0.0 | 4.2 | 0.0 | 23.5 |
| Temp. for tanδ = 1 (° C.) | 95 | 95 | 100 | 97 | 92 | 145 | 142 | 144 | 99 |
| tanδ (80° C.) | 1.4 | 1.3 | 2.0 | 1.5 | 1.2 | 2.4 | 2.3 | 2.3 | 1.7 |
| tanδ (140° C.) | 0.58 | 0.56 | 0.86 | 0.73 | 0.42 | 1.11 | 1.02 | 1.12 | 0.67 |
| G' (80° C.) ($\times 10^5$ Pa) | 8.9 | 9.4 | 8.2 | 8.5 | 11.6 | 8.1 | 8.2 | 8.0 | 8.8 |
| G' (140° C.) ($\times 10^3$ Pa) | 7.4 | 8.5 | 3.8 | 5.7 | 10.7 | 1.6 | 1.9 | 1.5 | 6.2 |

*1: Vinyl resin A-6 contained no carboxyl group.

*2: NG = nigrosine compound

*3: TM = triphenylmethane

TABLE 3-1

Evaluation results NT/NH (23° C./60% RH)

| Ex. or Comp. Ex. | Toner No. | Anti-off-set | Fixa-bility (° C.) | Anti-block | Sleeve coat | Sleeve soil | I.D. | Fog | Image soil | Fix member soil |
|---|---|---|---|---|---|---|---|---|---|---|
| Ex. 1 | 1 | 240 | 150 | A | A | A | 1.31 | 0.4 | A | A |
| Ex. 2 | 2 | 240 | 150 | A | A | A | 1.32 | 0.5 | A | A |
| Ex. 3 | 3 | 240 | 150 | A | A | A | 1.30 | 0.4 | A | A |
| Ex. 4 | 4 | 240 | 150 | A | A | A | 1.31 | 0.5 | A | A |
| Ex. 5 | 5 | 235 | 150 | A | A | A | 1.32 | 0.6 | A | A |
| Ex. 6 | 6 | 235 | 150 | A | A | A | 1.30 | 0.7 | A | A |
| Ex. 7 | 7 | 245 | 150 | A | A | A | 1.29 | 0.8 | A | A |
| Ex. 8 | 8 | 235 | 150 | A | A | A | 1.28 | 0.9 | A | A |
| Ex. 9 | 9 | 245 | 150 | A | A | A | 1.29 | 0.8 | A | A |
| Ex.10 | 10 | 250 | 155 | A | A | A | 1.28 | 0.9 | A | A |
| Ex.11 | 11 | 250 | 155 | A | A | A | 1.29 | 0.8 | B | A |
| Ex.12 | 12 | 230 | 150 | A | A | A | 1.28 | 0.9 | A | B |
| Ex.13 | 13 | 230 | 155 | B | A | A | 1.27 | 0.9 | A | B |
| Ex.14 | 14 | 250 | 160 | A | B | A | 1.21 | 1.7 | B | A |
| Comp | | | | | | | | | | |
| Ex. 1 | 15 | 210 | 160 | B | B | B | 1.23 | 1.1 | C | D |
| Ex. 2 | 16 | 225 | 155 | B | B | C | 1.22 | 1.6 | D | C |
| Ex. 3 | 17 | 220 | 155 | A | A | A | 1.30 | 0.6 | B | B |
| Ex. 4 | 18 | 240 | 155 | A | B | B | 1.24 | 0.7 | B | A |

TABLE 3-2

Evaluation results NT/LH (23° C./5% RH)

| Ex. or Comp.Ex. | Toner No. | Sleeve coat | Sleeve soil | I.D. | Fog | Image soil | Fix member soil |
|---|---|---|---|---|---|---|---|
| Ex. 1 | 1 | A | A | 1.35 | 0.7 | A | A |
| Ex. 2 | 2 | A | A | 1.36 | 0.6 | A | A |
| Ex. 3 | 3 | A | A | 1.35 | 0.7 | A | A |
| Ex. 4 | 4 | A | A | 1.35 | 0.6 | A | A |
| Ex. 5 | 5 | A | A | 1.36 | 0.8 | A | A |
| Ex. 6 | 6 | A | A | 1.35 | 0.8 | A | A |
| Ex. 7 | 7 | A | A | 1.31 | 0.9 | A | A |
| Ex. 8 | 8 | A | A | 1.28 | 1.0 | A | A |
| Ex. 9 | 9 | A | A | 1.32 | 1.0 | A | A |
| Ex.10 | 10 | A | A | 1.30 | 0.9 | A | A |
| Ex.11 | 11 | A | A | 1.31 | 1.1 | B | A |
| Ex.12 | 12 | A | A | 1.32 | 1.1 | A | B |
| Ex.13 | 13 | A | A | 1.30 | 1.2 | A | B |
| Ex.14 | 14 | B | A | 1.24 | 1.9 | B | A |
| Comp Ex. 1 | 15 | B | A | 1.27 | 1.7 | C | D |
| Comp Ex. 2 | 16 | D | B | 1.27 | 1.8 | D | C |
| Comp Ex. 3 | 17 | A | A | 1.34 | 0.8 | B | C |
| Comp Ex. 4 | 18 | C | B | 1.28 | 1.2 | B | A |

TABLE 3-3

Evaluation results HT/HH (30° C/80% RH)

| Ex. or Comp.Ex. | Toner No. | Sleeve coat | Sleeve soil | I.D. | Fog | Image soil | Fix member soil |
|---|---|---|---|---|---|---|---|
| Ex. 1 | 1 | A | A | 1.28 | 0.3 | A | A |
| Ex. 2 | 2 | A | A | 1.29 | 0.3 | A | A |
| Ex. 3 | 3 | A | A | 1.29 | 0.4 | A | A |
| Ex. 4 | 4 | A | A | 1.28 | 0.3 | A | A |
| Ex. 5 | 5 | A | A | 1.27 | 0.5 | A | A |
| Ex. 6 | 6 | A | A | 1.27 | 0.5 | A | A |
| Ex. 7 | 7 | A | A | 1.25 | 0.6 | A | A |
| Ex. 8 | 8 | A | A | 1.26 | 0.7 | A | A |
| Ex. 9 | 9 | A | A | 1.25 | 0.6 | A | A |
| Ex.10 | 10 | A | A | 1.25 | 0.7 | A | A |
| Ex.11 | 11 | A | A | 1.26 | 0.7 | A | A |
| Ex.12 | 12 | A | A | 1.25 | 0.7 | A | B |
| Ex.13 | 13 | A | A | 1.24 | 0.8 | A | B |
| Ex.14 | 14 | B | A | 1.12 | 1.6 | B | A |
| Comp. Ex. 1 | 15 | B | B | 1.18 | 0.8 | B | D |
| Comp. Ex. 2 | 16 | B | D | 1.19 | 0.9 | C | C |
| Comp. Ex. 3 | 17 | A | A | 1.28 | 0.4 | B | B |
| Comp. Ex. 4 | 18 | B | C | 1.15 | 0.9 | B | A |

Examples 15–28

Toners 1–14 were subjected to image forming tests in an environment of normal temperature/normal humidity (NT/NH=23° C./60% RH) in the same manner as in Examples 1–14, respectively, except that Developing sleeve 1 was used instead of Developing sleeve 2. The results are inclusively shown in the following Table 4.

TABLE 4

Evaluation results NT/NH (23° C./60% RH)

| Ex. or Comp.Ex. | Toner No. | Sleeve coat | Sleeve soil | I.D. | Fog | Image soil | Fix member soil |
|---|---|---|---|---|---|---|---|
| Ex. 15 | 1 | A | A | 1.36 | 0.2 | A | A |
| Ex. 16 | 2 | A | A | 1.37 | 0.3 | A | A |
| Ex. 17 | 3 | A | A | 1.38 | 0.2 | A | A |
| Ex. 18 | 4 | A | A | 1.37 | 0.2 | A | A |
| Ex. 19 | 5 | A | A | 1.36 | 0.3 | A | A |
| Ex. 20 | 6 | A | A | 1.38 | 0.3 | A | A |
| Ex. 21 | 7 | A | A | 1.32 | 0.4 | A | A |
| Ex. 22 | 8 | A | A | 1.31 | 0.5 | A | A |
| Ex. 23 | 9 | A | A | 1.30 | 0.4 | A | A |
| Ex. 24 | 10 | A | A | 1.32 | 0.5 | A | A |
| Ex. 25 | 11 | A | A | 1.33 | 0.5 | B | A |
| Ex. 26 | 12 | A | A | 1.32 | 0.4 | A | B |
| Ex. 27 | 13 | A | A | 1.30 | 0.5 | A | B |
| Ex. 28 | 14 | A | A | 1.28 | 0.9 | B | A |

Examples 29–56 and Comparative Examples 5–8

<Production of Carboxylic vinyl resin A-8>

| | | |
|---|---|---|
| Styrene | 81 | wt.part(s) |
| n-Butyl acrylate | 18 | " |
| Methacrylic acid | 1.0 | " |
| Di-t-butyl peroxide | 2.0 | " |

The above ingredients were added dropwise in 4 hours to 200 wt. parts of xylene which had been sufficiently aerated with nitrogen and heated to 120° C. under stirring in a four-necked flask. Then, the polymerization was completed under refux of xylene, followed by distilling-off of the solvent under a reduced pressure to recover a polymerizate, which is referred to herein as Carboxylic (i.e., carboxyl group-containing) vinyl resin A-8 or simply Resin A-8.

The properties of Resin A-8 are incusively shown in Table 5 appearing hereinafter together with those of vinyl resins prepared in the following Examples and Comparative Examples.

<Production of Carboxylic vinyl resin A-9>

Resin A-9 was prepared similarly as Resin A-8 except for using the following ingredients.

| | | |
|---|---|---|
| Styrene | 78.5 | wt.part(s) |
| n-Butyl acrylate | 18 | " |
| Acrylic acid | 3.5 | " |
| Di-t-butyl peroxide | 2.0 | " |

<Production of Carboxylic vinyl resin A-10>

Resin A-10 was prepared similarly as Resin A-8 except for using the following ingredients.

| | | |
|---|---|---|
| Styrene | 81.2 | wt.part(s) |
| n-Butyl acrylate | 18 | " |
| Monobutyl maleate | 0.8 | " |
| Di-t-butyl peroxide | 1.8 | " |

<Production of Vinyl resin A-11>

Resin A-11 was prepared similarly as Resin A-8 except for using the following ingredients.

| | |
|---|---|
| Styrene | 84 wt.part(s) |
| n-Butyl acrylate | 16 " |
| Di-t-butyl peroxide | 2.7 " |

<Production of Carboxylic vinyl resin A-12>

Resin A-12 was prepared similarly as Resin A-8 except for using the following ingredients.

| | |
|---|---|
| Styrene | 88.8 wt.part(s) |
| n-Butyl acrylate | 10 " |
| Methacrylic acid | 1.2 " |
| Di-t-butyl peroxide | 4.0 " |

<Production of Carboxylic vinyl resin A-13>

Resin A-13 was prepared similarly as Resin A-8 except for using the following ingredients.

| | |
|---|---|
| Styrene | 75.5 wt.part(s) |
| n-Butyl acrylate | 20 " |
| Methacrylic acid | 4.5 " |
| Di-t-butyl peroxide | 0.7 " |

<Production of Carboxylic vinyl resin A-14>

Resin A-14 was prepared similarly as Resin A-8 except for using the following ingredients.

| | |
|---|---|
| Styrene | 78.9 wt. part(s) |
| n-Butyl acrylate | 20 wt. part(s) |
| Acrylic acid | 1.1 wt. part(s) |
| Di-t-butyl peroxide | 0.6 wt. part(s) |

<Production of Carboxylic vinyl resin A-15>

Resin A-15 was prepared similarly as Resin A-8 except for using the following ingredients.

| | |
|---|---|
| Styrene | 80.4 wt. part(s) |
| n-Butyl acrylate | 18 wt. part(s) |
| Methacrylic acid | 1.1 wt. part(s) |
| Divinylbenzene | 0.5 wt. part(s) |
| Di-t-butyl peroxide | 2.0 wt. part(s) |

<Production of Carboxylic vinyl resin A-16>

Resin A-16 was prepared similarly as Resin A-8 except for using the following ingredients.

| | |
|---|---|
| Styrene | 79.5 wt. part(s) |
| n-Butyl acrylate | 18 wt. part(s) |
| Acrylic acid | 2.0 wt. part(s) |
| Divinylbenzene | 0.5 wt. part(s) |
| Di-t-butyl peroxide | 1.8 wt. part(s) |

<Production of Carboxylic vinyl resin A-17>

Resin A-17 was prepared similarly as Resin A-8 except for using the following ingredients.

| | |
|---|---|
| Styrene | 79 wt. part(s) |
| n-Butyl acrylate | 16 wt. part(s) |
| Acrylic acid | 4.5 wt. part(s) |
| Divinylbenzene | 0.5 wt. part(s) |
| Di-t-butyl peroxide | 2.5 wt. part(s) |

<Production of Carboxylic vinyl resin A-18>

Resin A-18 was prepared similarly as Resin A-8 except for using the following ingredients.

| | |
|---|---|
| Styrene | 77.5 wt. part(s) |
| n-Butyl acrylate | 20 wt. part(s) |
| Monobutyl maleate | 2.5 wt. part(s) |
| Divinylbenzene | 0.5 wt. part(s) |
| Di-t-butyl peroxide | 0.6 wt. part(s) |

<Production of Carboxylic vinyl resin A19>

Resin A-19 was prepared similarly as Resin A-8 except for using the following ingredients.

| | |
|---|---|
| Styrene | 81 wt. part(s) |
| n-Butyl acrylate | 18 wt. part(s) |
| Monobutyl maleate | 0.5 wt. part(s) |
| Divinylbenzene | 0.5 wt. part(s) |
| Di-t-butyl peroxide | 2.0 wt. part(s) |

<Production of Vinyl resin A-20>

Resin A-20 was prepared similarly as Resin A-8 except for using the following ingredients.

| | |
|---|---|
| Styrene | 81.5 wt. part(s) |
| n-Butyl acrylate | 18 wt. part(s) |
| Divinylbenzene | 0.5 wt. part(s) |
| Di-t-butyl peroxide | 2.0 wt. part(s) |

<Production of Carboxylic vinyl resin A-21>

Resin A-21 was prepared similarly as Resin A-8 except for using the following ingredients.

| | |
|---|---|
| Styrene | 91 wt. part(s) |
| n-Butyl acrylate | 8 wt. part(s) |
| Methacrylic acid | 1.0 wt. part(s) |
| Di-t-butyl peroxide | 5.0 wt. part(s) |

The proportions of Resins A-8 to A-21 thus prepared are inclusively shown in Table 5.

<Production of Glycidyl vinyl resin B-6>

| | |
|---|---|
| Styrene | 75 wt. part(s) |
| n-Butyl acrylate | 18 wt. part(s) |
| Glycidyl methacrylate | 7 wt. part(s) |
| Di-t-butylperoxide | 5 wt. part(s) |

The above ingredients were added dropwise in 4 hours to 200 wt. parts of xylene which had been sufficiently aerated with nitrogen and heated to 120° C. under stirring in a four-necked flask Then, the polymerization was completed under xylene reflux, followed by distilling-off of the solvent under a reduced pressure to recover a polymerizate, which is referred to herein as Glycidyl (group-containing) vinyl resin B-6 or simply Resin B-6.

The properties of Resin B-6 thus prepared are summarized in Table 5 appearing hereinafter together with those prepared in the following examples.

TABLE 5

| Resin No. | A-8 | A-9 | A-10 | A-11 | A-12 | A-13 | A-14 | A-15 | A-16 | A-17 | A-18 | A-19 | A-20 | A-21 |
|---|---|---|---|---|---|---|---|---|---|---|---|---|---|---|
| | Carboxylic vinyl resin | | | | | | | | | | | | | |
| Composition(wt. parts) | | | | | | | | | | | | | | |
| Styrene | 81 | 78.5 | 81.2 | 84 | 88.8 | 75.5 | 18.9 | 80.4 | 19.5 | 79 | 77.5 | 81 | 81.5 | 91 |
| n-Butylacrylate | 18 | 18 | 18 | 16 | 10 | 20 | 20 | 18 | 18 | 18 | 20 | 18 | 18 | 8 |
| Methacrylic acid | 1 | — | — | — | 1.2 | 4.5 | — | 1.1 | — | — | — | — | — | 1 |
| Acrylic acid | — | 3.5 | — | — | — | — | 1.1 | — | 2 | 4.5 | — | — | — | — |
| Monobutyl maleate | — | — | 0.8 | — | — | — | — | — | — | — | 2.5 | 0.5 | — | — |
| Divinylbenzene | — | — | — | — | — | — | — | 0.5 | 0.5 | 0.5 | 0.5 | 0.5 | 0.5 | — |
| Di-t-butylperoxide | 2 | 2 | 1.8 | 2.7 | 4 | 0.7 | 0.6 | 2 | 1.8 | 2.5 | 0.6 | 2 | 2 | 5 |
| Mp | 10000 | 10200 | 12300 | B100 | 4200 | 24500 | 34400 | 9800 | 11900 | 7800 | 29600 | 9700 | 9900 | 3000 |
| Acid value (mgKOH/g) | 6.5 | 27.3 | 2.6 | 0 | 7.8 | 29.3 | 8.6 | 7.2 | 15.8 | 35.1 | 8.1 | 1.6 | 0 | 6.4 |
| Tg (° C.) | 57.2 | 57.3 | 57.6 | 56.8 | 56.4 | 58.3 | 58.6 | 57.1 | 57.7 | 56.7 | 58.7 | 57.3 | 57.0 | 5 8.3 |
| THFins (wt. %) | 0 | 0 | 0 | 0 | 0 | 0 | 0 | 0 | 1 | 0 | 3 | 0 | 0 | 0 |

<Production of Glycidyl vinyl resin B-7>

Resin B-7 was prepared similarly as Resin B-6 except for using the following ingredients.

| | |
|---|---|
| Styrene | 70.7 wt. part(s) |
| n-Butyl acrylate | 25 wt. part(s) |
| Glycidyl methacrylate | 4.3 wt. part(s) |
| Di-t-butyl peroxide | 5 wt. part(s) |

<Production of Glycidyl vinyl resin B-8>

Resin B-8 was prepared similarly as Resin B-6 except for using the following ingredients.

| | |
|---|---|
| Styrene | 75.7 wt. part(s) |
| n-Butyl acrylate | 20 wt. part(s) |
| Glycidyl methacrylate | 4.3 wt. part(s) |
| Di-t-butyl peroxide | 1 wt. part(s) |

<Production of Glycidyl vinyl resin B-9>

Resin B-9 was prepared similarly as Resin B-6 except for using the following ingredients.

| | |
|---|---|
| Styrene | 75.7 wt. part(s) |
| n-Butyl acrylate | 20 wt. part(s) |
| Glycidyl methacrylate | 4.3 wt. part(s) |
| Di-t-butyl peroxide | 10 wt. part(s) |

<Production of Glycidyl vinyl resin B-10>

Resin B-10 was prepared similarly as Resin B-6 except for using the following ingredients.

| | |
|---|---|
| Styrene | 60 wt. part(s) |
| n-Butyl acrylate | 20 wt. part(s) |
| Glycidyl methacrylate | 20 wt. part(s) |
| Di-t-butyl peroxide | 5 wt. part(s) |

The properties of Resins B-6 to B-10 are inclusively shown in Table 6.

TABLE 6

| | Resin No. | | | | |
|---|---|---|---|---|---|
| | B-6 | B-7 | B-8 | B-9 | B-10 |
| Glycidyl vinyl resin | | | | | |
| Composition (wt. parts) | | | | | |
| Styrene | 75 | 70.7 | 75.7 | 75.7 | 60 |
| n-Butylacrylate | 18 | 25 | 20 | 20 | 20 |
| Glycidyl methacrylate | 7 | 4.3 | 4.3 | 4.3 | 20 |
| Di-t-butylperoxide | 5 | 5 | 1 | 10 | 5 |
| Mw | 20200 | 25100 | 61400 | 1500 | 19700 |
| Epoxy value (eq/kg) | 0.5 | 0.3 | 0.3 | 0.3 | 1.4 |
| $THF_{ins}$ (wt. %) | 0 | 0 | 0 | 0 | 0 |

Example 29

67 wt. parts of Carboxylic vinyl resin A-8 and 28 wt. parts of Carboxylic vinyl resin A-15 were placed together with 200 wt. parts of toluene in a four-necked flask which had been sufficiently aerated with nitrogen under stirring, and the mixture was then heated and sufficiently mixed under toluene reflux, followed by distilling-off of the solvent and pulverization of the remaining solid to obtain Binder resin.

| | |
|---|---|
| Binder resin (prepared above) | 100 wt. part(s) |
| Magnetite | 90 wt. part(s) |
| Polyethylene wax | 4 wt. part(s) |
| Imidazole compound (2-1) | 2 wt. part(s) |
| Glycidyl vinyl resin B-6 | 5 wt. part(s) |

The above ingredients were sufficiently preliminarily blended by a Henschel mixer and melt-kneaded through a twin-screw kneading extruder set at 180° C. After cooling, the kneaded product was coarsely crushed by a cutter mill, finely pulverized by a pulverizer using an air jet stream and classified by a pneumatic classifier to obtain classified powder (toner particles) having a weight-average particle size (D4) of 7.5 μm. The melt-viscosity during the kneading of the above ingredients was higher than during the kneading of identical ingredients but excluding Glycidyl vinyl resin B-6, whereby a reaction of Carboxylic vinyl resins (A-8 and A-15) and Glycidyl vinyl resin B-6 was confirmed. Moreover, the resultant toner particles exhibited an increased $THF_{ins}$ of 18 wt. %, thus showing a substantial occurrence of THF-insoluble matter.

100 wt. parts of the above-prepared toner particles were blended by a Henschel miser with 0.8 wt. part of hydrophobic silica prepared by treating 100 wt. parts of dry-process silica fine powder (BET specific surface area ($S_{BET}$)=200 $m^2/g$) with 17 wt. parts of amino-modified silicone oil (amine equivalent=830, viscosity at 25° C.=70 $mm^2/s$), and the blend was sieved through a screen having a mesh opening of 150 μm to obtain Toner 19, which exhibited properties shown in Table 7 hereinafter.

Toner 19 was subjected to performance evaluation test with respect to the following items.

Anti-Offset Property

The fixing device of a commercially available copying machine ("NP6016", mfd. by Canon K.K.) was taken out of the main body and remodeled so as to be able to arbitrarily set the fixing temperature and a process speed of 50 mm/sec, thereby providing an external fixing device. The anti-offset property was evaluated by passing a transfer paper sheet of 50 $g/m^2$ having yet-unfixed toner image on its smoother surface (so-called "felt surface") through the fixing device at fixing temperatures set by increments of 5° C. each in a temperature range of 190–240° C. in an environment of normal temperature/normal humidity (NT/NH=23° C./60% RH), whereby the offset behavior was observed to determine a lowest offset occurrence temperature ($T_{of}$) as a measure of anti-offset property.

Incidentally, the yet-unfixed toner images were formed by using a commercially available copying machine ("NP6035", mfd. by Canon K.K.) after replacing the developing sleeve with Developing sleeve 2 prepared above.

Fixability

The above external fixing device was operated at a process speed of 100 mm/sec and at fixing temperatures set by increments of 5° C. each in a temperature range of 120–240° C. Yet-unfixed toner images on a coarser surface (so-called "wire surface") of a transfer paper sheet of 80 $g/m^2$ were fixed at the respective temperatures. The fixed images at the respective fixing temperatures were rubbed for 5 reciprocations with a lens cleaning paper under a load of 4.9 kPa to determine the lowest fixing temperature giving an image density lowering of at most 10% as a fixing initiation temperature ($T_{in}$). A lower fixing initiation temperature represents a better fixability.

Anti-Blocking Property

Ca. 10 g of a sample toner was placed in a 100 ml-plastic cup and left standing for 3 days in a thermostat vessel at 50° C. The state of the toner after the standing was observed with eyes and evaluated according to the following standard A (excellent): No agglomerates were observed.

B (good): Agglomerates were observed but could be collapsed easily.

C (fair): Some agglomerates were observed but could be collapsed by shaking.

D (poor): Agglomerates could be grasped and could not be easily collapsed.

Sleeve Coating State

The toner coating state on the sleeve was observed and evaluated with respect to the occurrence of blotches according to the following standard in environments of (NT/NH=23° C./60% RH), normal temperature/low humidity (NT/LH 23° C./5% RH) and high temperature/high humidity (HT/HH=32.5° C./85% RH).

A (excellent): No occurred at all.

B (good): Slight blotches occurred at sleeve edges.

C (fair): Slightly occurred but not affecting the images.

D (poor): Noticeably occurred and affecting the images.

Image Evaluation and Fixing Heating Member Durability

A commercially available copying machine ("NP6035", mfd. by Canon K.K.) was used after remodeling so that copying could be performed in a state of having removed the cleaning web from the fixing device and exchanging the developing sleeve with Developing sleeve 2 prepared above for copying on 20000 sheets in an environment of NT/NH (=23° C./60% RH), and then on 20000 sheets each in environments NT/LH (=23° C./5% RH) and HT/HH (=32.5° C./85% RH), and the performances of a sample toner were evaluated with respect to image density (ID), fog and image soiling due to cleaning failure or melt-sticking.

<Image density (ID)>

Measured by using a Macbeth reflection densitometer (mfd. by Macbeth Co.).

<Fog>

Measured as a difference between a reflection density of a transfer paper before use and a density of the transfer paper after copying a blank white image thereon, respectively measured by using a reflection densitometer (mfd. by Tokyo Denshoku Gijutsu Center K.K.).

<Sleeve soiling>

A part of the developing sleeve surface after a continuous copying on 20,000 sheets in the NT/NH (23° C./60% RH) environment was cleaned by wiping with a cloth impregnated with ethanol, and by using the developing sleeve after the ethanol wiping, a solid black image was formed, to determine i image density difference ΔID between the parts subjected to and not subjected to the ethanol wiping. The sleeve soiling was evaluated based on ΔID according to the following standard.

A (excellent): ΔID<0.03

B (good): ΔID=0.03–0.10

C (fair): ΔID=0.10–0.20

D (poor): ΔID>0.20.

<Image defect>

A (excellent): Not occurred at all.

B (good): Slight soil occurred but at a level of practically no problem.

C (fair): Spotty and streak-like soil occurred and disappeared repetitively.

D (poor): Soil occurred and not disappeared.

<Offset during continuous image formation>

A (excellent); Not occurred at all.

B (good): Slightly occurred rarely but not readily recognized.

C (fair): Slightly occurred rarely at a recognizable level.

D (poor): Frequently occurred.

<Image soiling during continuous image formation>

A (excellent); No soil recognized at all.

B (good): Slight soil occurred on one side of transfer sheets.

C (fair): Slight soil occurred on both sides of transfer sheets.

D (poor): Soil occurred on both sides of transfer sheets.

The results of the above evaluation for Toner 19 are inclusively shown in Table 3 together with those of toners prepared in the following Examples and Comparative Examples.

Example 30

Toner 20 wag prepared and evaluated in the same manner as in Example 29 except for using Carboxylic vinyl resin A-16 instead of A-15 and Imidazole compound (2-10) instead of (2-1).

Example 31

Toner 21 was prepared and evaluated in the same manner as in Example 29 except for using 57 wt. parts of Carboxylic vinyl resin A-8 and 38 wt. parts of Carboxylic vinyl resin A-15 and using Imidazole compound (2-5) instead of (2-1).

Example 32

Toner 22 was prepared and evaluated in the same manner as in Example 29 except for using 57 wt. parts of Carboxylic vinyl resin A-8, and using 38 wt. parts of Carboxylic vinyl resin A-16 instead of A-15 and Imidazole compound (3-1) instead of (2-1).

Example 33

Toner 23 was prepared and evaluated in the same manner as in Example 29 except for using 57 wt. parts of Carboxylic vinyl resin A-10 instead of A-8, 38 wt. parts of Carboxylic vinyl resin A-19 instead of A-15, 5 wt. parts of Glycidyl vinyl resin B-7 instead of B-6, and Imidazole compound (4-1) instead of (2-1).

Example 34

Toner 24 was prepared and evaluated in the same manner as in Example 29 except for using 76 wt. parts of Carboxylic vinyl resin A-9 instead of A-8, 19 wt. parts of Carboxylic vinyl resin A-17 instead of A-15, 5 wt. parts of Glycidyl vinyl resin B-7 instead of B-6, and Imidazole compound (5-1) instead of (2-1).

Example 35

Toner 25 was prepared and evaluated in the same manner as in Example 29 except for using 76 wt. parts of Carboxylic vinyl resin A-12 instead of A-8, 19 wt. parts of Carboxylic vinyl resin A-17 instead of A-15, 5 wt. parts of Glycidyl vinyl resin B-7 instead of B-6, and Imidazole compound (5-23) instead of (2-1).

Example 36

Toner 26 was prepared and evaluated in the same manner as in Example 29 except for using 48 wt. parts of Carboxylic vinyl resin A-13 instead of A-8, 48 wt. parts of Carboxylic vinyl resin A-18 instead of A-15, 5 wt. parts of Glycidyl vinyl resin B-7 instead of B-6, and Imidazole compound (7-1) instead of (2-1).

Example 37

Toner 27 was prepared and evaluated in the same manner as in Example 29 except for using 79 wt. parts of Carboxylic vinyl resin A-8, 19 wt. parts of Carboxylic vinyl resin A-16 instead of A-15, 2 wt. parts of Glycidyl vinyl resin B-7 instead of B-6, and Imidazole compound (8-1) instead of (2-1).

Example 38

Toner 28 was prepared and evaluated in the same manner as in Example 29 except for using 48 wt. parts of Carboxylic vinyl resin A-8, 47 wt. parts of Carboxylic vinyl resin A-16 instead of A-15, 5 wt. parts of Glycidyl vinyl resin B-10 instead of B-6, and Imidazole compound (9-1) instead of (2-1).

Comparative Example 5

Toner 29 was prepared and evaluated in the same manner as in Example 29 except for using 57 wt. parts of Vinyl resin A-11 instead of Carboxylic vinyl resin A-8, 38 wt. parts of Vinyl resin A-20 instead of Carbozylic vinyl resin A-15, and Imidazole compound (5-1) instead of (2-1).

Comparative Example 39

Toner 30 was prepared and evaluated in the same manner as in Example 29 except for using 48 wt. parts of Carboxylic vinyl resin A-13 instead of A-8, 48 wt. parts of Carbozylic vinyl resin A-17 instead of A-15, 4 wt. parts of Glycidyl vinyl resin B-7 instead of B-6, and Imidazole compound (5-1) instead of (2-1).

Example 40

Toner 31 was prepared and evaluated in the same manner as in Example 29 except for using 48 wt. parts of Carboxylic vinyl resin A-12 instead of A-8, 48 wt. parts of Carboxylic vinyl resin A-21 instead of A-15, 4 wt. parts of Glycidyl vinyl resin B-9 instead of B-6, and Imidazole compound (5-1) instead of (2-1).

Example 41

Toner 32 was prepared and evaluated in the same manner as in Example 29 except for using 57 wt. parts of Carboxylic vinyl resin- A-14 instead of A-8, 38 wt. parts of Carboxylic vinyl resin A-18 instead of A-15, 5 wt. parts of Glycidyl vinyl resin B-9 instead of B-6, and Imidazole compound (5-1) instead of (2-1).

Example 42

Toner 33 was prepared and evaluated in the same manner as in Example 29 except for using 45 wt. parts of Carboxylic vinyl resin A-8, 45 wt. parts of Carboxylic vinyl resin A-16 instead of A-15, 10 wt. parts of Glycidyl vinyl resin B-8 instead of B-6, and Imidazole compound (5-1) instead of (2-1).

Comparative Example 6

Toner 34 was prepared and evaluated in the same manner as in Example 29 except for using nigrosine instead of Imidazole compound (2-1).

Comparative Example 7

Toner 35 was prepared and evaluated in the same manner as in Example 29 except for omitting Glycidyl vinyl resin B-6.

Comparative Example 8

Toner 36 was prepared and evaluated in the same manner as in Example 29 except for using 2 wt. parts of triphenylmethane lake pigment and 1 wt. part of salicylic acid aluminum compound instead of Imidazole compound (2-1).

The properties and the evaluation results of Toners 19–34 prepared in the above Examples and Comparative Examples are inclusively shown in Table 7 and Table 8, respectively

TABLE 7-1

| | Toner properties | | | | | | | | |
|---|---|---|---|---|---|---|---|---|---|
| Ex. or Comp.Ex. | Ex.29 | Ex.30 | Ex.31 | Ex.32 | Ex.33 | Ex.34 | Ex.35 | Ex.36 | Ex.37 |
| Toner No. | 19 | 20 | 21 | 22 | 23 | 24 | 25 | 26 | 27 |
| Carboxylic vinyl resin | A-8 (67) | A-8 (67) | A-8 (57) | A-8 (57) | A-10 (57) | A-9 (76) | A-12 (76) | A-13 (48) | A-8 (79) |
| Carboxylic vinyl resin | A-15 (28) | A-16 (28) | A-15 (38) | A-16 (38) | A-19 (38) | A-17 (19) | A-17 (19) | A-18 (48) | A-16 (19) |
| Glycidyl vinyl resin | B-6 (5) | B-6 (5) | B-6 (5) | B-6 (5) | B-7 (5) | B-7 (5) | B-7 (5) | B-7 (4) | B-7 (2) |
| Glycidyl/ carboxyl ratio (B/A) (eq/eq) | 0.22 | 0.26 | 0.22 | 0.27 | 0.41 | 0.03 | 0.07 | 0.04 | 0.06 |
| Imidazole | 2-1 | 2-10 | 2-5 | 3-1 | 4-1 | 5-1 | 5-23 | 7-1 | 8-1 |
| Developing sleeve | 2 | 2 | 2 | 2 | 2 | 2 | 2 | 2 | |
| Av (toner) (mgKOH/g) | 6.1 | 8.8 | 6.4 | 9.8 | 1.9 | 27 | 10.5 | 16.5 | 7.1 |
| Mp | 9900 | 10800 | 10200 | 11100 | 11600 | 9200 | 4600 | 25800 | 10100 |
| Peak area ratio M ≦ 3 × $10^4$) toner)(%) | 88 | 89 | 86 | 87 | 86 | 90 | 94 | 64 | 78 |
| Tg (toner) (° C.) | 56.1 | 56.3 | 56.2 | 56.4 | 55.7 | 55.9 | 54.8 | 57.1 | 56.5 |
| $THF_{ins}$ (wt. %) | 18 | 24 | 33 | 47 | 12 | 38 | 27 | 41 | 7 |
| Temp. for tanδ = 1 (° C.) | 115 | 114 | 112 | 106 | 116 | 111 | 113 | 108 | 118 |
| tanδ (80° C.) | 1.8 | 1.7 | 1.6 | 1.5 | 1.9 | 1.6 | 1.7 | 1.5 | 2.1 |
| tanδ (140° C.) | 0.61 | 0.57 | 0.52 | 0.48 | 0.64 | 0.51 | 0.56 | 0.49 | 0.71 |
| G' (80° C.) (×$10^5$ Pa) | 7.1 | 7.3 | 7.6 | 7.8 | 6.9 | 7.7 | 7.2 | 7.9 | 6.7 |
| G' (140° C.) (×$10^3$ Pa) | 6.2 | 6.4 | 6.8 | 7.2 | 5.8 | 7.0 | 6.5 | 7.1 | 4.5 |

TABLE 7-2

| | Toner properties | | | | | | | | |
|---|---|---|---|---|---|---|---|---|---|
| Ex. or Comp.Ex. | Ex.38 | Comp. Ex.5 | Ex.39 | Ex.40 | Ex.41 | Ex.42 | Comp. Ex.6 | Comp. Ex.7 | Comp. Ex.8 |
| Toner No. | 28 | 29 | 30 | 31 | 32 | 33 | 34 | 35 | 36 |
| Carboxylic vinyl resin | A-8 (48) | *1 A-11 (57) | A-13 (48) | A-12 (57) | A-14 (45) | A-8 (76) | A-8 (67) | A-8 (70) | A-8 (67) |
| Carboxylic vinyl resin | A-16 (47) | *1 A-20 (38) | A-17 (48) | A-21 (48) | A-18 (38) | A-16 (45) | A-15 (28) | A-15 (30) | A-15 (28) |
| Glycidyl vinyl resin | B-10 (5) | B-6 (5) | B-7 (4) | B-9 (4) | B-9 (5) | B-8 (10) | B-6 (5) | — | B-6 (5) |
| Glycidyl/ carboxyl ratio (B/A) (eq/eq) | 0.80 | — | 0.02 | 0.11 | 0.11 | 0.36 | 0.22 | — | 0.22 |
| Imidazole | 9-1 | 5-1 | 5-1 | 5-1 | 5-1 | 5-1 | *2 NG | 2-1 | *3 TM |
| Developing sleeve | 2 | 2 | 2 | 2 | 2 | 2 | 2 | 2 | |
| Av (toner) (mgKOH/g) | 6.1 | 8.8 | 6.4 | 9.8 | 1.9 | 27 | 10.5 | 16.5 | 7.1 |
| MnMp | 10900 | 9200 | 21200 | 3400 | 32400 | 11200 | 11000 | 10000 | 10200 |

TABLE 7-2-continued

| Toner properties | | | | | | | | | |
|---|---|---|---|---|---|---|---|---|---|
| Ex. or Comp.Ex. | Ex.38 | Comp. Ex.5 | Ex.39 | Ex.40 | Ex.41 | Ex.42 | Comp. Ex.6 | Comp. Ex.7 | Comp. Ex.8 |
| Peak area ratio M ≦ 3 × $10^4$) toner)(%) | 84 | 87 | 78 | 98 | 57 | 94 | 90 | 89 | 91 |
| Tg (toner) (° C.) | 56.4 | 56.0 | 56.7 | 56.9 | 57.3 | 56.4 | 56.3 | 56.2 | 56.3 |
| $THF_{ins}$ (wt. %) | 56 | 0 | 37 | 6 | 8 | 63 | 8 | 0 | 24 |
| Temp. for tanδ = 1 (° C.) | 99 | 148 | 110 | 122 | 102 | 96 | 126 | 143 | 117 |
| tanδ (80° C.) | 1.4 | 2.2 | 1.6 | 2.3 | 1.7 | 1.3 | 2.1 | 1.9 | 1.7 |
| tanδ (140° C.) | 0.45 | 1.18 | 0.554 | 0.87 | 0.82 | 0.38 | 0.91 | 1.15 | 0.54 |
| G' (80° C.) (×$10^5$ Pa) | 8.3 | 6.5 | 8.1 | 5.9 | 8.2 | 8.5 | 7.4 | 7.2 | 7.4 |
| G' (140° C.) (×$10^3$ Pa) | 8.4 | 1.4 | 8.2 | 2.3 | 3.1 | 9.8 | 1.8 | 1.6 | 6.9 |

*1: Each of Vinyl resins A-11 and A-20 contained no carboxyl group.
*2: NG = nitrosine compound
*3: TM = triptienylmethame

TABLE 8-1

| Evaluation results NT/NH (23° C./60% RH) | | | | | | | | | | | |
|---|---|---|---|---|---|---|---|---|---|---|---|
| Ex. or Comp. Ex. | Toner No. | Anti-off-set | Fixa-bility (° C.) | Anti-block | Sleeve coat | Sleeve soil | Image density | Fog | Image defect | Off-set | Image soil |
| Ex.29 | 19 | >240 | 135 | A | A | A | 1.35 | 0.41 | A | A | A |
| Ex.30 | 20 | >240 | 135 | A | A | A | 1.35 | 0.42 | A | A | A |
| Ex.31 | 21 | >240 | 135 | A | A | A | 1.34 | 0.39 | A | A | A |
| Ex.32 | 22 | >240 | 135 | A | A | A | 1.32 | 0.44 | A | A | A |
| Ex.33 | 23 | 230 | 135 | A | A | A | 1.32 | 0.41 | A | B | B |
| Ex.34 | 24 | 240 | 135 | A | A | A | 1.30 | 0.43 | A | A | A |
| Ex.35 | 25 | 235 | 135 | B | A | A | 1.31 | 0.44 | A | B | B |
| Ex.36 | 26 | 240 | 145 | A | A | A | 1.35 | 0.41 | A | A | A |
| Ex.37 | 27 | 230 | 135 | A | A | A | 1.31 | 0.43 | A | B | B |
| Ex.38 | 28 | >240 | 140 | A | A | A | 1.33 | 0.43 | A | A | A |
| Comp. Ex. 5 | 29 | 200 | 140 | B | B | C | 1.30 | 0.56 | C | D | D |
| Ex.39 | 30 | >240 | 135 | A | B | B | 1.18 | 1.10 | A | A | A |
| Ex.40 | 31 | 210 | 130 | D | A | B | 1.26 | 1.51 | C | C | C |
| Ex.41 | 32 | 235 | 160 | A | A | A | 1.30 | 0.54 | A | B | B |
| Ex.42 | 33 | >240 | 150 | A | B | D | 1.21 | 0.20 | A | A | A |
| Comp. Ex. 6 | 34 | 215 | 140 | B | C | D | 1.15 | 0.54 | D | C | C |
| Comp. Ex. 7 | 35 | 210 | 140 | A | A | A | 1.34 | 0.45 | A | B | B |
| Comp. Ex. 8 | 36 | 240 | 140 | A | B | B | 1.17 | 0.63 | B | A | A |

TABLE 8-2

| Evaluation results NT/LH (23° C./5% RH) | | | | | | | | |
|---|---|---|---|---|---|---|---|---|
| Ex. or Comp. Ex. | Toner No. | Sleeve coat | Sleeve soil | Image density | Fog | Image defect | Off-set | Image soil |
| Ex.29 | 19 | A | A | 1.37 | 0.42 | A | A | A |
| Ex.30 | 20 | A | A | 1.36 | 0.42 | A | A | A |
| Ex.31 | 21 | A | A | 1.35 | 0.40 | A | A | A |
| Ex.32 | 22 | A | A | 1.33 | 0.43 | A | A | A |
| Ex.33 | 23 | A | A | 1.35 | 0.43 | A | B | B |

TABLE 8-2-continued

| Evaluation results NT/LH (23° C./5% RH) | | | | | | | | |
|---|---|---|---|---|---|---|---|---|
| Ex. or Comp. Ex. | Toner No. | Sleeve coat | Sleeve soil | Image density | Fog | Image defect | Off-set | Image soil |
| Ex.34 | 24 | A | A | 1.30 | 0.45 | A | A | A |
| Ex.35 | 25 | A | A | 1.33 | 0.45 | A | A | B |
| Ex.36 | 26 | A | A | 1.30 | 0.41 | A | B | A |
| Ex.37 | 27 | A | A | 1.34 | 0.43 | A | B | A |
| Ex.38 | 28 | A | A | 1.33 | 0.45 | A | A | A |

TABLE 8-2-continued

Evaluation results NT/LH (23° C./5% RH)

| Ex. or Comp. Ex. | Toner No. | Sleeve coat | Sleeve soil | Image density | Fog | Image defect | Off-set | Image soil |
|---|---|---|---|---|---|---|---|---|
| Comp. Ex. 5 | 29 | B | C | 1.30 | 0.54 | C | D | D |
| Ex.39 | 30 | B | B | 1.23 | 1.98 | A | A | A |
| Ex.40 | 31 | A | B | 1.27 | 0.50 | C | C | C |
| Ex.41 | 32 | B | A | 1.30 | 0.53 | A | B | B |
| Ex.42 | 33 | B | B | 1.28 | 2.01 | A | A | A |
| Comp. Ex. 6 | 34 | C | D | 1.25 | 0.55 | D | C | C |
| Comp. Ex. 7 | 35 | A | A | 1.36 | 0.46 | A | C | C |
| Comp. Ex. 8 | 36 | C | B | 1.27 | 0.56 | B | A | A |

TABLE 8-3

Evaluation results HT/HH (32.5° C./85% RH)

| Ex. or Comp. Ex. | Toner No. | Sleeve coat | Sleeve soil | Image density | Fog | Image defect | Off-set | Image soil |
|---|---|---|---|---|---|---|---|---|
| Ex.29 | 19 | A | A | 1.32 | 0.39 | A | A | A |
| Ex.30 | 20 | A | A | 1.33 | 0.40 | A | A | A |
| Ex.31 | 21 | A | A | 1.31 | 0.36 | A | A | A |
| Ex.32 | 22 | A | A | 1.30 | 0.40 | A | A | A |
| Ex.33 | 23 | A | A | 1.30 | 0.40 | B | B | B |
| Ex.34 | 24 | A | A | 1.29 | 0.39 | A | A | A |
| Ex.35 | 25 | A | A | 1.28 | 0.42 | A | B | B |
| Ex.36 | 26 | A | A | 1.30 | 0.42 | A | A | A |
| Ex.37 | 27 | A | A | 1.28 | 0.40 | A | B | A |
| Ex.38 | 28 | A | A | 1.31 | 0.42 | A | A | A |
| Comp. Ex. 5 | 29 | A | C | 1.27 | 0.43 | C | D | D |
| Ex.39 | 30 | A | B | 1.02 | 0.98 | A | A | A |
| Ex.40 | 31 | A | B | 1.23 | 0.49 | C | C | C |
| Ex.41 | 32 | A | A | 1.24 | 0.49 | A | B | B |
| Ex.42 | 33 | A | C | 1.08 | 1.28 | A | A | A |
| Comp. Ex. 6 | 34 | B | D | 1.03 | 0.45 | D | C | C |
| Comp. Ex. 7 | 35 | A | A | 1.30 | 0.35 | A | B | B |
| Comp. Ex. 8 | 36 | B | C | 1.01 | 1.03 | B | A | A |

Examples 43–56

Toners 19–28 and 30–33 were subjected to image forming tests in an environment of normal temperature/normal humidity (NT/NH=23° C./60% RH) in the same manner as in Examples 29–42, respectively, except that Developing sleeve 1 was used instead of Developing sleeve 2. The results are inclusively shown in the following Table 9.

TABLE 9

Evaluation results NT/NH (23° C./160% RH)

| Ex. or Comp.Ex. | Toner No. | Sleeve coat | Sleeve soil | I.D. | Fog |
|---|---|---|---|---|---|
| Ex. 43 | 19 | A | A | 1.44 | 0.23 |
| Ex. 44 | 20 | A | A | 1.43 | 0.24 |
| Ex. 45 | 21 | A | A | 1.44 | 0.23 |
| Ex. 46 | 22 | A | A | 1.41 | 0.30 |

TABLE 9-continued

Evaluation results NT/NH (23° C./160% RH)

| Ex. or Comp.Ex. | Toner No. | Sleeve coat | Sleeve soil | I.D. | Fog |
|---|---|---|---|---|---|
| Ex. 47 | 23 | A | A | 1.42 | 0.32 |
| Ex. 48 | 24 | A | A | 1.41 | 0.33 |
| Ex. 49 | 25 | A | A | 1.41 | 0.31 |
| Ex. 50 | 26 | A | A | 1.43 | 0.36 |
| Ex. 51 | 27 | A | A | 1.42 | 0.36 |
| Ex. 52 | 28 | A | A | 1.44 | 0.38 |
| EX. 53 | 30 | A | B | 1.29 | 0.91 |
| Ex. 54 | 31 | A | B | 1.37 | 0.39 |
| Ex. 55 | 32 | A | A | 1.40 | 0.42 |
| Ex. 56 | 33 | A | B | 1.32 | 0.21 |

Examples 57–96 and Comparative Examples 9–12

<Production of High-molecular weight resin C-1>

| | |
|---|---|
| Styrene | 78.5 wt. part(s) |
| n-Butyl acrylate | 20 wt. part(s) |
| Methacrylic acid | 1.5 wt. part(s) |
| 2,2-(Bis(4,4-di-t-butylperoxy-Cyclohexyl)propane | 1.0 wt. part(s) |

The above ingredients were added dropwise in 4 hours to 200 wt. parts of xylene which had been sufficiently aerated with nitrogen and heated to 120° C. under heating in a four-necked flask. Then, the polymerization was completed under xylene reflux. The resin thus obtained in the form of a solution thereof is referred to herein as High-molecular weight resin C-1 or simply Resin C-1.

<Production of High-molecular weight resin C-2>

Resin C-2 was prepared similarly as Resin C-1 except for using the following ingredients.

| | |
|---|---|
| Styrene | 78.0 wt. part(s) |
| n-Butyl acrylate | 18 wt. part(s) |
| Methacrylic acid | 4 wt. part(s) |
| 2,2-(Bis(4,4-di-t-butylperoxy-Cyclohexyl)propane | 0.8 wt. part(s) |

<Production of High-molecular weight resin C-3>

Resin C-3 was prepared similarly as Resin C-1 except for using the following ingredients.

| | |
|---|---|
| Styrene | 78.6 wt. part(s) |
| n-Butyl acrylate | 19 wt. part(s) |
| Methacrylic acid | 2.4 wt. part(s) |
| 2,2-(Bis(4,4-di-t-butylperoxy-Cyclohexyl)propane | 1.2 wt. part(s) |

<Production of High-molecular weight resin C-4>

Resin C-4 was prepared similarly as Resin C-1 except for using the following ingredients.

| | |
|---|---|
| Styrene | 75.0 wt. part(s) |
| n-Butyl acrylate | 23 wt. part(s) |

-continued

| | |
|---|---|
| Methacrylic acid | 2 wt. part(s) |
| 2,2-(Bis(4,4-di-t-butylperoxy-Cyclohexyl)propane | 0.6 wt. part(s) |

<Production of High-molecular weight resin C-5>

Resin C-5 was prepared similarly as Resin C-1 except for using the following ingredients.

| | |
|---|---|
| Styrene | 72.0 wt. part(s) |
| n-Butyl acrylate | 20 wt. part(s) |
| Methacrylic acid | 8 wt. part(s) |
| 2,2-(Bis(4,4-di-t-butylperoxy-Cyclohexyl)propane | 1.0 wt. part(s) |

<Production of High-molecular weight resin C-6>

Resin C-6 was prepared similarly an Resin C-1 except for using the following ingredients.

| | |
|---|---|
| Styrene | 80.0 wt. part(s) |
| n-Butyl acrylate | 19 wt. part(s) |
| Methacrylic acid | 1 wt. part(s) |
| 1,1-Di-t-butylperoxycyclohexane | 0.2 wt. part(s) |

<Production of High-molecular weight resin C-7>

Resin C-7 was prepared similarly as Resin C-1 except for using the following ingredients.

| | |
|---|---|
| Styrene | 80.0 wt. part(s) |
| n-Butyl acrylate | 19 wt. part(s) |
| Methacrylic acid | 1 wt. part(s) |
| 1,1-Di-t-butylperoxy-3,3,5-trimethylcyclohexane | 2.0 wt. part(s) |

<Production of High-molecular weight resin C-8>

Resin C-8 was prepared similarly as Resin C-1 except for using the following ingredients.

| | |
|---|---|
| Styrene | 80.0 wt. part(s) |
| n-Butyl acrylate | 20 wt. part(s) |
| 2,2-Bis(4,4-di-t-butylperoxy-cyclohexyl)propane | 1.0 wt. part(s) |

<Production of high-molecular weight resin C-9>

Resin C-9 was prepared similarly as Resin C-1 except for using the following ingredients.

| | |
|---|---|
| Styrene | 72.0 wt. part(s) |
| n-Butyl acrylate | 18 wt. part(s) |
| Methacrylic acid | 10 wt. part(s) |
| 2,2-Bis(4,4-di-t-butylperoxy-cyclohexyl)propane | 1.0 wt. part(s) |

<Production of High-molecular weight resin C-10>

Resin C-10 was prepared similarly as Resin C-1 except for using the following ingredients.

| | |
|---|---|
| Styrene | 87.7 wt. part(s) |
| n-Butyl acrylate | 18 wt. part(s) |
| Methacrylic acid | 0.3 wt. part(s) |
| 2,2-Bis(4,4-di-t-butylperoxy-cyclohexyl)propane | 1.0 wt. part(s) |

<Production of High-molecular weight resin C-11>

Resin C-11 was prepared similarly as Resin C-1 except for using the following ingredients.

| | |
|---|---|
| Styrene | 81.8 wt. part(s) |
| n-Butyl acrylate | 18 wt. part(s) |
| Monobutyl acid | 0.2 wt. part(s) |
| 2,2-Bis(4,4-di-t-butylperoxy-cyclohexyl)propane | 1.0 wt. part(s) |

<Production of High-molecular weight resin C-12>

| | |
|---|---|
| Styrene | 79.0 wt. part(s) |
| n-Butyl acrylate | 20.0 wt. part(s) |
| Monobutyl acid | 1.0 wt. part(s) |
| 2,2-Bis(4,4-di-t-butylperoxy-cyclohexyl)propane | 0.3 wt. part(s) |

To the above mixture liquid, 170 wt. parts of water containing 0.12 wt. part of partially saponified polyvinyl alcohol was added and vigorously stirred therewith to form a suspension liquid, which was then added to a reaction vessel containing 50 wt. parts of water and aerated with nitrogen, followed by 8 hours of suspension polymerization at 80° C. After the reaction, the polymerizate was washed with water, dewatered and dried to obtain Resin C-12 in the form of suspension polymerized beads.

<Production of Carboxylic vinyl resin A-22>

| | |
|---|---|
| High-molecular weight resin C-1 | 25 wt. part(s) |
| Styrene | 60.2 wt. part(s) |
| n-Butyl acrylate | 14 wt. part(s) |
| Methacrylic acid | 0.8 wt. part(s) |
| Di-t-butyl peroxide | 2.0 wt. part(s) |

Among the above ingredients, the monomers and polymerization initiator (i.e., those other than Resin C-1) were added dropwise in 4 hours to 200 wt. parts of xylene, and the polymerization was completed under xylene reflux. To the system, Resin C-1 in the polymerized solution form was added in an amount of 25 wt. parts in terms of resin to be mixed, followed by distilling-off of the solvent to recover a resin, which is referred to herein as Carboxylic vinyl resin A-22 or simply Resin A-22.

<Production of Carboxylic vinyl resin A-23>

Resin A-23 was prepared similarly as Resin A-22 except for using the following ingredients.

| | |
|---|---|
| High-molecular weight resin C-1 | 30 wt. part(s) |
| Styrene | 55.2 wt. part(s) |

-continued

| | |
|---|---|
| n-Butyl acrylate | 14 wt. part(s) |
| Methacrylic acid | 0.8 wt. part(s) |
| Di-t-butyl peroxide | 2.0 wt. part(s) |

<Production of Carboxylic vinyl resin A-24>

Resin A-24 was prepared similarly as Resin A-22 except for using the following ingredients.

| | |
|---|---|
| High-molecular weight resin C-1 | 10 wt. part(s) |
| Styrene | 72 wt. part(s) |
| n-Butyl acrylate | 17 wt. part(s) |
| Methacrylic acid | 1 wt. part(s) |
| Di-t-butyl peroxide | 2.0 wt. part(s) |

<Production of Carboxylic vinyl resin A-25>

Resin A-25 was prepared similarly as Resin A-22 except for using the following ingredients.

| | |
|---|---|
| High-molecular weight resin C-1 | 40 wt. part(s) |
| Styrene | 48 wt. part(s) |
| n-Butyl acrylate | 11.4 wt. part(s) |
| Methacrylic acid | 0.6 wt. part(s) |
| Di-t-butyl peroxide | 2.0 wt. part(s) |

<Production of Carboxylic vinyl resin A-26>

Resin A-26 was prepared similarly as Resin A-22 except for using the following ingredients.

| | |
|---|---|
| High-molecular weight resin C-3 | 30 wt. part(s) |
| Styrene | 54.4 wt. part(s) |
| n-Butyl acrylate | 14 wt. part(s) |
| Methacrylic acid | 1.6 wt. part(s) |
| Di-t-butyl peroxide | 1.4 wt. part(s) |

<Production of Carboxylic vinyl resin A-27>

Resin A-27 was prepared similarly as Resin A-22 except for using the following ingredients.

| | |
|---|---|
| High-molecular weight resin C-4 | 30 wt. part(s) |
| Styrene | 55.8 wt. part(s) |
| n-Butyl acrylate | 13 wt. part(s) |
| Methacrylic acid | 1.2 wt. part(s) |
| Di-t-butyl peroxide | 1.4 wt. part(s) |

<Production of Carboxylic vinyl resin A-28>

Resin A-28 was prepared similarly as Resin A-22 except for using the following ingredients.

| | |
|---|---|
| High-molecular weight resin C-4 | 25 wt. part(s) |
| Styrene | 59.8 wt. part(s) |
| n-Butyl acrylate | 15 wt. part(s) |
| Methacrylic acid | 0.2 wt. part(s) |
| Di-t-butyl peroxide | 0.7 wt. part(s) |

<Production of Carboxylic vinyl resin A-29>

Resin A-29 was prepared similarly as Resin A-22 except for using the following ingredients.

| | |
|---|---|
| High-molecular weight resin C-5 | 25 wt. part(s) |
| Styrene | 63.8 wt. part(s) |
| n-Butyl acrylate | 10 wt. part(s) |
| Methacrylic acid | 1.2 wt. part(s) |
| Di-t-butyl peroxide | 4.0 wt. part(s) |

<Production of Carboxylic vinyl resin A-30>

Resin A-30 was prepared similarly as Resin A-22 except for using the following ingredients.

| | |
|---|---|
| High-molecular weight resin C-2 | 2 wt. part(s) |
| Styrene | 78.8 wt. part(s) |
| n-Butyl acrylate | 18 wt. part(s) |
| Methacrylic acid | 1.2 wt. part(s) |
| Di-t-butyl peroxide | 1.4 wt. part(s) |

<Production of Carboxylic vinyl resin A-31>

Resin A-31 was prepared similarly as Resin A-22except for using the following ingredients.

| | |
|---|---|
| High-molecular weight resin C-3 | 60 wt. part(s) |
| Styrene | 31.9 wt. part(s) |
| n-Butyl acrylate | 8 wt. part(s) |
| Methacrylic acid | 0.1 wt. part(s) |
| Di-t-butyl peroxide | 1.0 wt. part(s) |

<Production of Carboxylic vinyl resin A-32>

Resin A-32 was prepared similarly as Resin A-22 except for using the following ingredients.

| | |
|---|---|
| High-molecular weight resin C-6 | 25 wt. part(s) |
| Styrene | 59 wt. part(s) |
| n-Butyl acrylate | 15 wt. part(s) |
| Methacrylic acid | 1 wt. part(s) |
| Di-t-butyl peroxide | 0.5 wt. part(s) |

<Production of Carbozylic vinyl resin A-33>

Resin A-33 was prepared similarly as Resin A-22 except for using the following ingredients.

| | |
|---|---|
| High-molecular weight resin C-7 | 25 wt. part(s) |
| Styrene | 68 wt. part(s) |
| n-Butyl acrylate | 6 wt. part(s) |
| Methacrylic acid | 1 wt. part(s) |
| Di-t-butyl peroxide | 6 wt. part(s) |

<Production of Vinyl resin A-34>

Resin A-34 was prepared similarly as Resin A-22 except for using the following ingredients.

| | |
|---|---|
| High-molecular weight resin C-8 | 25 wt. part(s) |
| Styrene | 61 wt. part(s) |
| n-Butyl acrylate | 14 wt. part(s) |
| Di-t-butyl peroxide | 2.4 wt. part(s) |

<Production of Carboxylic vinyl resin A-35>

Resin A-35 was prepared similarly as Resin A-22 except for using the following ingredients.

| | |
|---|---|
| High-molecular weight resin C-9 | 25 wt. part(s) |
| Styrene | 58 wt. part(s) |
| n-Butyl acrylate | 14 wt. part(s) |
| Methacrylic acid | 3 wt. part(s) |
| Di-t-butyl peroxide | 2.4 wt. part(s) |

<Production of Carboxylic vinyl resin A-36>

Resin A-36 was prepared similarly as Resin A-22 except for using the following ingredients.

| | |
|---|---|
| High-molecular weight resin C-10 | 50 wt. part(s) |
| Styrene | 42 wt. part(s) |
| n-Butyl acrylate | 8 wt. part(s) |
| Di-t-butyl peroxide | 2.0 wt. part(s) |

<Production of Carboxylic vinyl resin A-37>

Resin A-37 was prepared similarly as Resin A-22 except for using the following ingredients.

| | |
|---|---|
| High-molecular weight resin C-11 | 50 wt. part(s) |
| Styrene | 42 wt. part(s) |
| n-Butyl acrylate | 8 wt. part(s) |
| Di-t-butyl peroxide | 2.0 wt. part(s) |

<Production of Carboxylic vinyl resin A-38>

| | |
|---|---|
| High-molecular weight resin C-12 | 30 wt. part(s) |
| Styrene | 58 wt. part(s) |
| n-Butyl acrylate | 12 wt. part(s) |
| Di-t-butyl peroxide | 2.0 wt. part(s) |

Among the above ingredients, the monomers and polymerization initiator (i.e., those other than Resin C-12) were added dropwise in 4 hours to 200 wt. parts of xylene, and the polymerization was completed under xylene reflux To the system, Resin C-12 in the bead form was added in 30 wt. parts, followed by stirring and distilling-off of the solvent to recover Resin A-38.

The properties of the above-prepared Resins A-22 to A-38 are inclusively shown in Table 10.

<Production of Glycidyl vinyl resin B-11>

| | |
|---|---|
| Styrene | 75 wt. part(s) |
| n-Butyl acrylate | 18 wt. part(s) |
| Glycidyl methacrylate | 7 wt. part(s) |
| Di-t-butylperoxide | 5 wt. part(s) |

The above ingredients were added dropwise in 4 hours to 200 wt. parts of xylene which had been sufficiently aerated with nitrogen and heated to 120° C. under stirring in a four-necked flask. Then, the polymerization was completed under xylene reflux, followed by distilling-off of the solvent under a reduced pressure to recover a polymerizate, which is referred to herein as Glycidyl (group-containing) vinyl resin B-11 or simply Resin B-11.

The properties of Resin B-11 thus prepared are summarized in Table 5 appearing hereinafter together with those prepared in the following examples.

<Production of Glycidyl vinyl resin B-12>

Resin B-12 was prepared similarly as Resin B-11 except for using the following ingredients.

| | |
|---|---|
| Styrene | 70.7 wt. part(s) |
| n-Butyl acrylate | 25 wt. part(s) |
| Glycidyl methacrylate | 4.3 wt. part(s) |
| Di-t-butyl peroxide | 5 wt. part(s) |

<Production of Glycidyl vinyl resin B-13>

Resin B-13 was prepared similarly as Resin B-11 except for using the following ingredients.

| | |
|---|---|
| Styrene | 75.7 wt. part(s) |
| n-Butyl acrylate | 20 wt. part(s) |
| Glycidyl methacrylate | 4.3 wt. part(s) |
| Di-t-butyl peroxide | 1 wt. part(s) |

<Production of Glycidyl vinyl resin B-14>

Resin B-14 was prepared similarly as Resin B-11 except for using the following ingredients.

| | |
|---|---|
| Styrene | 75.7 wt. part(s) |
| n-Butyl acrylate | 20 wt. part(s) |
| Glycidyl methacrylate | 4.3 wt. part(s) |
| Di-t-butyl peroxide | 10 wt. part(s) |

<Production of Glycidyl vinyl resin B-15>

Resin B-15 was prepared similarly as Resin B-11 except for using the following ingredients.

| | |
|---|---|
| Styrene | 60 wt. part(s) |
| n-Butyl acrylate | 20 wt. part(s) |
| Glycidyl methacrylate | 20 wt. part(s) |
| Di-t-butyl peroxide | 5 wt. part(s) |

The propriety of Resins B-11 to B-15 are inclusively shown in Table 11.

TABLE 10

| | Carboxylic vinyl resin | | | | | | | | |
|---|---|---|---|---|---|---|---|---|---|
| | A-22 | A-23 | A-24 | A-25 | A-25 | A-27 | A-28 | A-29 | A-30 |
| High MW Resin | C-1 | C-1 | C-1 | C-1 | C-3 | C-4 | C-4 | C-5 | C-2 |

TABLE 10-continued

| | Carboxylic vinyl resin | | | | | | | | |
|---|---|---|---|---|---|---|---|---|---|
| High/low *1 resin ratio | 25/75 | 30/70 | 10/90 | 40/60 | 30/70 | 30/70 | 25/75 | 25/75 | 2/98 |
| Mp1 *2 | 10100 | 9900 | 10000 | 10200 | 11800 | 12100 | 24500 | 5200 | 12200 |
| Mp2 *3 (×10000) | 16 | 16 | 17 | 15 | 12 | 51 | 50 | 12 | 32 |
| Av (mgKOH/g) | 7.6 | 9.2 | 7.5 | 7.8 | 15.1 | 5.9 | 2.9 | 23.4 | 8.3 |
| Tg (° C.) | 57.5 | 57.2 | 56.8 | 57.4 | 56.7 | 57.4 | 58.2 | 58.1 | 57.1 |
| THFins (wt. %) | 0 | 0 | 0 | 0 | 0 | 0 | 0 | 0 | 0 |
| | A-31 | A-32 | A-33 | A-34 | A-35 | A-38 | A-37 | A-38 | |
| High MW Resin | C-3 | C-6 | C-7 | C-8 | C-9 | C-10 | C-11 | C-12 | |
| High/low *1 resin ratio | 60/40 | 25/75 | 25/75 | 25/75 | 25/75 | 50/50 | 50/50 | 30/70 | |
| Mp1 *2 | 15300 | 35600 | 2500 | 8100 | 8200 | 10200 | 10400 | 10300 | |
| Mp2 *3 (×10000) | 11 | 123 | 8 | 19 | 18 | 32 | 28 | 75 | |
| Av (mgKOH/g) | 10.0 | 6.1 | 8.1 | 0 | 35.8 | 1.0 | 0.3 | 0.9 | |
| Tg (° C.) | 57.6 | 58.5 | 56.6 | 57.3 | 57.1 | 57.5 | 57.3 | 57.1 | |
| THFins (wt. %) | 0 | 0 | 0 | 0 | 0 | 0 | 0 | 0 | |

*1: High-molecular weight resin component/low-molecular weight resin component (i. e., solution polymerization product) weight ratio
*2: Mp1 = Low molecular weight side peak molecule weight.
*3: Mp2 = High-molecular weight side peak molecular weight.

TABLE 11

| | Glycidyl vinyl resin | | | | |
|---|---|---|---|---|---|
| | Resin No. | | | | |
| | B-11 | B-12 | B-13 | B-14 | B-15 |
| Mw | 20200 | 25100 | 61400 | 1500 | 19700 |
| Epoxy value (eq/kg) | 0.5 | 0.3 | 0.3 | 0.3 | 1.4 |
| $THF_{ins}$ (wt. %) | 0 | 0 | 0 | 0 | 0 |

<Production of Developing sleeve 3>

A resin-coated Developing sleeve 3 was prepared in the same manner as Developing sleeve 1 except for using a stainless steel-made cylindrical tube of 32 mm instead of 20 mm in outer diameter.

<Production of Developing sleeve 4>

A blasted Developing sleeve 4 was prepared in the same manner as Developing sleeve 2 except for using a stainless steel-made cylindrical tube of 32 mm instead of 20 mm in outer diameter.

Example 57

95 wt. parts of Carboxylic vinyl resin A-22 and 5 wt. parts of Glycidyl vinyl resin B-11 respectively prepared above were blended by a Henschel mixer and then melt-kneaded through a twin-screw extruder at 200° C., followed by cooling and pulverization to obtain Binder resin 1.

| | |
|---|---|
| Binder resin 1 (obtained above) | 100 wt. part(s) |
| Magnetite | 90 wt. part(s) |

-continued

| | |
|---|---|
| Polyethylene wax | 4 wt. part(s) |
| Imidazole compound (2-1) | 2 wt. part(s) |

The above ingredients were sufficiently preliminarily blended by a Henschel mixer and melt-kneaded through a twin-screw kneading extruder set at 150° C. After cooling, the kneaded product was coarsely crushed by a cutter mill, finely pulverized by a pulverizer using an air jet stream and classified by a pneumatic classifier to obtain classified powder (toner particles) having a weight-average particle size (D4) of 8.0 $\mu$m. The melt-viscosity during the kneading of the above ingredients was higher than during the kneading of identical ingredients but excluding Glycidyl vinyl resin B-11, whereby a reaction of Carboxylic vinyl resin A-22 and Glycidyl vinyl resin B-11 was confirmed. Moreover, the resultant toner particles exhibited increased $TRF_{ins}$ of 26.5 wt. %, thus showing a substantial occurrence of THF-insoluble matter 100 wt. parts of the above-prepared toner particles were blended by a Henschel miser with 0.8 wt. part of hydrophobic silica prepared by treating 100 wt. parts of dry-process silica fine powder (BET specific surface area ($S_{BET}$)=200 $m^2/g$) with 17 wt. parts of amino-modified silicone oil (amine equivalent=830, viscosity at 25° C.=70 $mm^2/s$), and the blend was sieved through a screen having a mesh opening of 150 $\mu$m to obtain Toner 37, which exhibited properties shown in Table 12 hereinafter and resulted in a viscoelasticity chart shown in FIG. 6.

Toner 37 was subjected to performance evaluation test with respect to the following items.

Anti-Offset Property

The fixing device of a commercially available copying machine ("NP6030", mid. by Canon K.K.) was taken out of the main body and remodeled so as to be able to arbitrarily set the fixing temperature and a process speed of 100 mm/sac, thereby providing an external fixing device. The anti-offset property was evaluated by passing a transfer paper sheet of 50 g/m$^2$ having yet-unfixed toner image on its smoother surface (so-called "felt surface") through the fixing device at fixing temperatures set by increments of 5° C. each in a temperature range of 200–240° C. in an environment of normal temperature/normal humidity (NT/NH=23° C./60% RH), whereby the offset behavior was observed to determine a lowest offset occurrence temperature ($T_{of}$) as a measure of anti-offset property.

Fixability

The above external fixing device was operated at a nip of 5.0 mm, at a process speed of 180 mm/sec and at fixing temperatures set by increments of 5° C. each in a temperature range of 120–250° C. Yet-unfixed toner images on a coarser surface (so-called "wire surface") of a transfer paper sheet of 80 g/m$^2$ were fixed at the respective temperatures in an environment of normal temperature/normal humidity (NT/NH=23° C./60% RH). The fixed images at the respective fixing temperatures were rubbed for 5 reciprocations with a lens cleaning paper under a loadof 4.9 kPa to determine the lowest fixing temperature giving an image density lowering of at most 10% as a fixing initiation temperature ($T_{in}$). A lower fixing initiation temperature represents a better fixability.

Anti-Blocking Property

Ca. 10 g of a sample toner was placed in a 100 ml-plastic cup and left standing for 3 days in a thermostat vessel at 50° C. The state of the toner after the standing was observed with eyes and evaluated according to the following standard.

A (excellent): No agglomerates were observed.

B (good): Agglomerates were observed but could be collapsed easily.

C (fair): Some agglomerates were observed but could be collapsed by shaking

D (poor): Agglomerates could be collapsed and could not be easily collapsed.

Sleeve Coating State

The toner coating state on the sleeve was observed and evaluated with respect to the occurrence of blotches according to the following standard in environments of (NT/NH=23° C./60% RH), normal temperature/low humidity (NT/LH=23° C./5% RH) and high temperature/high humidity (HT/HH=32 5° C./85% RH).

A (excellent); No occurred at all

B (good): Slight blotches.

C (fair): Slightly occurred but not affecting the images.

D (poor): Noticeably occurred and affecting the images.

Image Evaluation and Fixing Heating Member Durability

A commercially available copying machine ("NP6085", mfd. by Canon K.K.) was used after remodeling it into a machine suitable for reversely development mode using a positively chargeable toner by changing various conditions including developing bias voltages and exchanging the developing sleeve with Developing sleeve 4 prepared above for copying on 50000 sheets in an environment of NT/NH (=23° C./60% RH) and then on 50000 sheets each in environments of NT/LH (=23° C./5% RH) and HT/HH (=32.5° C./85% RH), and the performances of a sample toner were evaluated with respect to image density (ID), fog, cleaning failure, melt-sticking, image soiling due to leakage spots, toner soiling on a fixing roller cleaner web, sleeve soiling and back-soiling on transfer sheets.

<Image density (ID)>

Measured by using a Macbeth reflection densitometer (mfd. by Macbeth Co.).

<Fog>

Measured as a difference between a reflection density of a transfer paper before use and a density of the transfer paper after copying a blank white image thereon, respectively measured by using a reflection densitometer (mfd. by Tokyo Denshoku Gijutsu Center K.K.).

<Sleeve soiling>

A part of the developing sleeve surface after a continuous copying on 20,000 sheets in the NT/NH (23° C./6% RH) environment was cleaned by wiping with a cloth impregnated with ethanol, and by using the developing sleeve after the ethanol wiping, a solid black image was formed, to determine an image density difference ΔID between the parts subjected to and not subjected to the ethanol wiping. The sleeve soiling was evaluated based on ΔID according to the following standard.

A (excellent): ΔID<0.03

B (good): ΔID=0.03–0.10

C (fair): ΔID=0.10–0.20

D (poor): ΔID>0.20.

<Image soiling>

A (excellent): Not occurred at all.

B (good): Slight soil occurred but at a level of practically no problem.

C (fair): Spotty and streak-like soil occurred and disappeared repetitively, and did not increase D (poor): Soil occurred and not disappeared.

<Soiling of a fixing roller cleaning web>

The soiling of the cleaning web after the continuous image formation and effect thereof on images were observed with eyes A (excellent): Uniform wiping state and little toner attachment.

B (good); Somewhat large amount of toner attachment was observed but did not cause re-transfer.

C (fair): Toner re-transfer onto the fixing meter was caused to affect the images in some cases, though it was rare.

D (poor): Re-transfer of soiling toner onto front and back surfaces of transfer paper sheets occurred in some case.

<Image soiling after re-start>

Back soiling on transfer sheets after re-startup following the stopping was evaluated in the NT/NH (=23° C./60% RH environment).

A (excellent): No soiling at all.

B (good): Slightly occurred only on a first sheet after the re-startup.

C (fair); Soil observed on a first sheet after the re-startup.

D (poor): Soil observed also on second and following sleets after the re-startup.

The results of the above evaluation for Toner 37 are inclusively shown in Table 13 together with those of toners prepared in the following Examples and Comparative Examples.

Example 58

Toner 38 was prepared and evaluated in the same manner as in Example 57 except for using Imidazole compound (2-10) instead of (2-1).

Example 59

Toner 39 was prepared and evaluated in the same manner as in Example 57 except for using Imidazole compound (2-5) instead of (2-1).

Example 60

Toner 40 was prepared and evaluated in the same manner as in Example 57 except for using Imidazole compound (3-1) instead of (2-1).

Example 61

Toner 41 was prepared and evaluated in the same manner as in Example 57 except for using Carboxylic vinyl resin A-24 instead of A-22 and Imidazole compound (6-1) instead of (2-1).

Example 62

Toner 42 was prepared and evaluated in the same manner as in Example 57 except for using Carboxylic vinyl resin A-25 instead of A-22 and Imidazole compound (5-1) instead of (2-1).

Example 63

Toner 43 was prepared and evaluated in the same manner as in Example 57 except for using Carboxylic vinyl resin A-23 instead of A-22, Glycidyl vinyl resin B-12 instead of B-11 and Imidazole compound (5-23) instead of (2-1).

Example 64

Toner 44 was prepared and evaluated in the same manner as in Example 57 except for using Carboxyl vinyl resin A-24 instead of A-22, Glycidyl vinyl resin B-12 instead of B-11 and Imidazole compound (7-1) instead of (2-1).

Example 65

Toner 45 was prepared and evaluated in the same manner as in Example 57 except for using Carboxylic vinyl resin A-26 instead of A-22 and Imidazole compound (8-1) instead of (2-1)

Example 66

Toner 46 was prepared and evaluated in the same manner as in Example 57 except for using Carboxylic vinyl resin A-27 instead of A-22 and Imidazole compound (9-1) instead of (2-1).

Example 67

Toner 47 was prepared and evaluated in the same manner as in Example 57 except for using Carboxylic vinyl resin A-28 instead of A-22 and Imidazole compound (5-1) instead of (2-1).

Example 68

Toner 48 was prepared and evaluated in the same manner as in Example 57 except for using Carboxylic vinyl resin A-29 instead of A-22 and Imidazole compound (5-1) instead of (2-1).

Example 69

95 wt. parts of Carboxylic vinyl resin A-30 and 5 wt. parts of Glycidyl vinyl resin B-11 respectively prepared above were only blended by a Henschel mixer to obtain Binder resin 2.

| | |
|---|---|
| Binder resin 2 (obtained above) | 100 wt. part(s) |
| magnetite | 90 wt. part(s) |
| Polyethylene wax | 4 wt. part(s) |
| Imidazole compound (5-1) | 2 wt. part(s) |

The above ingredients were sufficiently preliminarily blended by a Henschel mixer and melt-kneaded through a twin-screw kneading extruder set at 110° C. After cooling, the kneaded product was coarsely crushed by a cutter mill, finely pulverized by a pulverizer using an air jet stream and classified by a pneumatic classifier to obtain classified powder (toner particles) having a weight-average particle size (D4) of 8.0 $\mu$m.

The toner particles were blended with hydrophobic silica similarly as in Example 57 to obtain Toner 49, which was also evaluated in the same manner as in Example 57.

Example 70

Toner 50 was prepared and evaluated in the same manner as in Example 57 except for using Carboxylic vinyl resin A-31 instead of A-22 and Imidazole compound (5-1) instead of (2-1).

Example 71

Toner 51 was prepared and evaluated in the same manner as in Example 57 except for using Carboxylic vinyl resin A-32 instead of A-22, Glycidyl vinyl resin B-13 instead of B-11 and Imidazole compound (5-1) instead of (2-1).

Example 72

Toner 52 was prepared and evaluated in the same manner as in Example 57 except for using Carboxylic vinyl resin A-33 instead of A-22, Glycidyl vinyl resin B-14 instead of B-11 and Imidazole compound (5-1) instead of (2-1).

Comparative Example 9

Toner 53 was prepared and evaluated in the same manner as in Example 57 except for using Vinyl resin A-34 containing no carboxyl group instead of Carboxylic vinyl resin A-22 and Imidazole compound (5-1) instead of (2-1).

Example 73

Toner 54 was prepared and evaluated in the same manner as in Example 57 except for using Carboxylic vinyl resin A-35 instead of A-22, Glycidyl vinyl resin B-15 instead of B-11 and Imidazole compound (5-1) instead of (2-1).

Comparative Example 10

Toner 55 was prepared and evaluated in the same manner as in Example 57 except for omitting Glycidyl vinyl resin B-11 and using Imidazole compound (5-1) instead of (2-1).

Comparative Example 11

Toner 56 was prepared and evaluated in the same manner as in Example 57 except for using nigrosine instead of Imidazole compound (2-1).

Example 74

Toner 57 was prepared and evaluated in the same manner as in Example 57 except for using Carboxylic vinyl resin A-36 instead of A-22, Glycidyl vinyl resin B-15 instead of B-11 and Imidazole compound (2-2) instead of (2-1).

Example 75

Toner 58 was prepared and evaluated in the same manner as in Example 57 except for using Carboxylic vinyl resin A-37 instead of A-22, Glycidyl vinyl resin B-15 instead of B-11 and Imidazole compound (2-15) instead of (2-1).

Example 76

Toner 59 was prepared and evaluated in the same manner as in Example 57 except for using carboxylic vinyl resin A-38 instead of A-22, Glycidyl vinyl resin B-15 instead of B-11 and Imidazole compound (2-28) instead of (2-1).

Comparative Example 12

Toner 60 was prepared and evaluated in the same manner at in Example 57 except for using 2 wt. parts of triphenylmethane lake pigment and 1 wt. part of salicylic acid aluminum compound instead of Imidazole compound (2-1).

The properties and the evaluation results of Toners 37–60 prepared in the above Examples and Comparative Examples are inclusively shown in Table 12 and Table 13, respectively.

TABLE 12-1

Toner properties

| Ex. Or Comp. Ex. | Ex.57 | Ex.58 | Ex.59 | Ex.60 | Ex.61 | Ex.62 | Ex.63 | Ex.64 | Ex.65 | Ex.68 | Ex.67 | Ex.68 |
|---|---|---|---|---|---|---|---|---|---|---|---|---|
| Toner No | 37 | 38 | 39 | 40 | 41 | 42 | 43 | 44 | 45 | 46 | 47 | 48 |
| Carboxylic Vinyl resin | A-22 | A-22 | A-22 | A-22 | A-24 | A-25 | A-23 | A-26 | A-26 | A-27 | A-28 | A-29 |
| Glycidyl vinyl resin | B-11 | B-11 | B-11 | B-11 | B-11 | B-11 | B-12 | B-12 | B-11 | B-11 | B-11 | B-12 |
| Glycidyl/ carboxyl ratio (B/A)(eg/eg) | 0.18 | 0.18 | 0.18 | 0.18 | 0.18 | 0.18 | 0.10 | 0.06 | 0.09 | 0.24 | 0.47 | 0.04 |
| Imidazole | 2-1 | 2-10 | 2-5 | 3-1 | 4-1 | 5-1 | 5-23 | 7-1 | 8-1 | 9-1 | 5-1 | 5-1 |
| Developing sleeve | 4 | 4 | 4 | 4 | 4 | 4 | 4 | 4 | 4 | 4 | 4 | 4 |
| Av (toner) (mgKOH/g) | 6.8 | 7.1 | 7.0 | 7.3 | 7.5 | 5.5 | 8.3 | 13.2 | 13.5 | 5.0 | 1.5 | 21.4 |
| Mp *1(×1) | 8800 | 9200 | 8800 | 9200 | 9100 | 8500 | 9600 | 10800 | 11000 | 10200 | 22700 | 4500 |
| Msp1 *1 (×10000) | 15.8 | 15.6 | 148 | 13.2 | 20.0 | 13.0 | 15.6 | 10.8 | 11.0 | 48 | 21.0 | 10.8 |
| Msp2 *1 (×10000) | 152 | 186 | 138 | 120 | — | 181 | 162 | 164 | 163 | 180 | — | — |
| Peak area ratio (M ≦ 30000) | 18% | 17% | 16% | 20% | 9% | 38% | 20% | 20% | 19% | 2.0% | 8% | 21% |
| Tg (toner)(° C.) | 53.4 | 54.5 | 54.8 | 55 | 54.3 | 54.2 | 53.8 | 54.3 | 55.0 | 55.0 | 57.0 | 58.8 |
| THFins (wt. %) | 26.5% | 2B.3% | 25.2% | 20.4% | 10.1% | 20.8% | 12.5% | 10.2% | 15.3% | 15.2% | 16.2% | 20.5% |
| Temp. for tan δ = 1 (° C.) | 102 | 104 | 103 | 107 | 112 | 108 | 111 | 113 | 110 | 110 | 109 | 105 |
| tan δ (80° C.) | 1.7 | 1.8 | 1.6 | 1.7 | 2.0 | 1.8 | 1.9 | 2.0 | 1.7 | 1.8 | 1.8 | 1.8 |
| tan δ (14° C.) | 0.52 | 0.54 | 0.52 | 0.58 | 0.61 | 0.57 | 0.60 | 0.62 | 0.57 | 0.53 | 0.54 | 0.71 |
| G' (80+ C.) (×10000 pa) | 2.0 | 3.1 | 2.4 | 2.1 | 1.6 | 2.3 | 1.9 | 1.8 | 2.6 | 4.3 | 5.5 | 1.4 |
| G'(140° C) (×10000 pa) | 5.8 | 6.1 | 5.6 | 5.3 | 4.8 | 5.0 | 4.9 | 5.1 | 5.4 | 5.5 | 6.3 | 4.5 |

*1: Mp represents main peak.
Msp1 and Msp2 represent sub-peaks at lower and higher molecular weights, respectively.

TABLE 12-2

Toner properties

| Ex.. Or Comp. Ex. | Ex. 69 | Ex. 70 | Ex. 71 | Ex. 72 | Comp. 9 | Ex. 73 | Comp. 10 | Comp. 11 | Ex. 74 | Ex. 75 | Ex. 76 | Comp. 12 |
|---|---|---|---|---|---|---|---|---|---|---|---|---|
| Toner No. | 49 | 50 | 51 | 52 | 53 | 54 | 55 | 56 | 57 | 58 | 59 | 60 |
| Carboxylic Vinyl resin | A-30 | A-31 | A-32 | A-33 | *2 A-34 | A-35 | A-22 | A-22 | A-36 | A-37 | A-38 | A-22 |
| Glycidyl vinyl resin | B-11 | B-11 | B-13 | B-14 | B-11 | B-15 | — | B-11 | B-15 | B-15 | B-15 | B-11 |
| Glycidyl/ carbonyl ratio (B/A)(eq/eg) | 0.17 | 0.14 | 0.10 | 0.10 | — | 0.11 | 0 | 0.18 | 3.89 | 11.67 | 3.89 | 0.18 |
| Imidazole | 5-1 | 5-1 | 5-1 | 5-1 | 5-1 | 5-1 | 5-1 | NG*3 | 2-2 | 2-15 | 2-37 | TM*3 |
| Developing sleeve | 6 | 6 | 6 | 6 | 6 | 6 | 6 | 6 | 6 | 6 | 6 | 6 |

TABLE 12-2-continued

| Ex.. Or Comp. Ex. | Ex. 69 | Ex. 70 | Ex. 71 | Ex. 72 | Comp. 9 | Ex. 73 | Comp. 10 | Comp. 11 | Ex. 74 | Ex. 75 | Ex. 76 | Comp. 12 |
|---|---|---|---|---|---|---|---|---|---|---|---|---|
| | Toner properties | | | | | | | | | | | |
| Av (toner) (mgKOH/g) | 7.9 | 9.8 | 7.2 | 7.0 | 0 | 32.3 | 7.6 | 7.8 | 0.4 | 0.1 | 0.6 | 6.6 |
| Mp *1 (×1) | 11000 | 14200 | 32400 | 2200 | 8500 | 6800 | 10200 | 10100 | 9300 | 9500 | 10000 | 8900 |
| Msp1 *1 (×10000) | — | 9.6 | 12.8 | 7.8 | 16.0 | 17.5 | 16.1 | 16.4 | 21.3 | 18.7 | 68.5 | 15.7 |
| Msp2 *1 (×10000) | — | 121 | — | — | — | — | — | — | — | — | — | — |
| Peak area ratio (M ≦ 30000) | 2% | 55% | 17% | 8% | 23% | 15% | 23% | 20% | 32% | 27% | 18% | 14% |
| Tg (toner) (° C.) | 55.3 | 56.2 | 58.2 | 54.2 | 54.0 | 54.5 | 54.0 | 55.0 | 56.8 | 56.7 | 56.9 | 54.5 |
| THFins (wt. %) | 2.1% | 31.0% | 9.8% | 5.3% | 0% | 51.3% | 0% | 8.2% | 18.7% | 20.3% | 14.8% | 27.3% |
| Temp. for tanδ = 1 (° C.) | 122 | 99 | 99 | 121 | 147 | 98 | 146 | 106 | 112 | 108 | 111 | 101 |
| tanδ (80° C.) | 22 | 1.6 | 1.8 | 1.9 | 2.1 | 1.5 | 2.0 | 1.9 | 1.7 | 1.6 | 1.7 | 1.8 |
| tanδ (140° C.) | 0.86 | 0.47 | 0.63 | 0.91 | 1.11 | 0.38 | 1.07 | 0.73 | 0.59 | 0.56 | 0.62 | 0.48 |
| G' (80° C.) (×10000 pa) | 1.6 | 8.7 | 9.2 | 1.2 | 2.5 | 8.1 | 2.6 | 2.4 | 3.5 | 3.8 | 3.2 | 2.1 |
| G' (140° C.) (×10000 pa) | 3.2 | 8.4 | 8.1 | 2.7 | 1.4 | 9.6 | 1.5 | 4.2 | 5.7 | 8.4 | 5.9 | 6.3 |

*1: Same as in Table 12-1.

*2: Vinyl resin A-34 contained no carboxyl group.

*3: NG = nigrosine, TM = triphenylmethane lake pigment.

TABLE 13-1

Evaluation results NT/NH (23° C./60% RH)

| Ex. or Comp. Ex. | Toner No. | Anti-Off-set | Fixa-bility (° C.) | Anti-block | Sleeve soil | Sleeve coat | I.D. | Fog | Image soil | Web soil | Back soil after stop |
|---|---|---|---|---|---|---|---|---|---|---|---|
| Ex. 57 | 37 | >240 | 135 | A | A | A | 1.35 | 0.40 | A | A | A |
| Ex. 58 | 38 | >240 | 135 | A | A | A | 1.34 | 0.39 | A | A | A |
| Ex. 59 | 39 | >240 | 135 | A | A | A | 1.35 | 0.44 | A | A | A |
| Ex. 60 | 40 | >240 | 135 | A | A | A | 1.31 | 0.48 | A | A | A |
| Ex. 61 | 41 | 235 | 135 | A | A | A | 1.32 | 0.42 | A | B | B |
| Ex. 62 | 42 | 240 | 140 | A | A | A | 1.30 | 0.39 | A | A | A |
| Ex. 63 | 43 | 235 | 135 | A | A | A | 1.31 | 0.45 | A | A | D |
| Ex. 64 | 44 | 235 | 135 | A | A | A | 1.29 | 0.44 | A | A | B |
| Ex. 65 | 45 | 240 | 135 | A | A | A | 1.29 | 0.42 | A | A | A |
| Ex. 66 | 46 | 240 | 135 | A | A | A | 1.30 | 0.45 | A | A | A |
| Ex. 67 | 47 | 235 | 140 | A | A | A | 1.31 | 0.45 | A | A | A |
| Ex. 68 | 48 | 235 | 130 | B | A | A | 1.29 | 0.55 | A | B | B |
| Ex. 69 | 49 | 210 | 135 | B | A | A | 1.29 | 0.90 | A | B | C |
| Ex. 70 | 50 | >240 | 155 | A | B | A | 1.28 | 0.46 | A | C | B |
| Ex. 71 | 51 | 240 | 160 | A | A | A | 1.29 | 0.56 | A | D | B |
| Ex. 72 | 52 | 210 | 135 | B | A | B | 1.25 | 0.52 | A | B | C |
| Comp. Ex. 9 | 53 | 205 | 140 | C | B | C | 1.20 | 0.53 | C | C | D |
| Ex. 73 | 54 | >240 | 150 | A | C | B | 1.21 | 1.25 | A | B | A |
| Comp. Ex. 10 | 55 | 210 | 140 | C | A | B | 1.25 | 0.46 | A | B | D |
| Comp. Ex. 11 | 56 | 230 | 140 | D | D | D | 1.16 | 0.56 | D | B | C |
| Ex. 74 | 57 | 240 | 145 | B | A | A | 1.25 | 0.51 | B | B | A |
| Ex. 75 | 58 | 240 | 145 | B | A | A | 1.26 | 0.53 | B | B | A |
| Ex. 76 | 59 | 240 | 145 | B | A | A | 1.26 | 0.58 | B | B | A |
| Comp. Ex. 12 | 60 | 240 | 140 | A | B | B | 1.21 | 0.62 | B | A | A |

TABLE 13-2

Evaluation results NT/LH (23° C./5% RH)

| Ex. or Comp Ex. | Toner No. | Sleeve coat | Sleeve soil | I.D. | Fog | Image soil | Web soil |
|---|---|---|---|---|---|---|---|
| Ex. 57 | 37 | A | A | 1.36 | 0.41 | A | A |
| Ex. 58 | 38 | A | A | 1.37 | 0.40 | A | A |
| Ex. 59 | 39 | A | A | 1.36 | 0.45 | A | A |
| Ex. 60 | 40 | A | A | 1.34 | 0.48 | A | A |
| Ex. 61 | 41 | A | A | 1.33 | 0.45 | A | B |
| Ex. 62 | 42 | A | A | 1.33 | 0.48 | A | A |
| Ex. 63 | 43 | A | A | 1.34 | 0.45 | A | A |
| Ex. 64 | 44 | A | A | 1.31 | 0.48 | A | A |
| Ex. 65 | 45 | A | A | 1.32 | 0.45 | A | A |
| Ex. 66 | 46 | A | A | 1.32 | 0.48 | A | A |
| Ex. 67 | 47 | A | A | 1.31 | 0.47 | A | A |
| Ex. 68 | 48 | A | A | 1.31 | 0.50 | A | B |
| Ex. 69 | 49 | B | A | 1.30 | 0.50 | A | B |
| Ex. 70 | 50 | B | A | 1.30 | 0.55 | A | C |
| Ex. 71 | 51 | A | A | 1.29 | 0.52 | A | D |
| Ex. 72 | 52 | A | B | 1.28 | 0.51 | A | B |
| Comp. Ex. 9 | 53 | B | B | 1.30 | 0.48 | D | C |
| Ex. 73 | 54 | D | B | 1.28 | 2.32 | A | B |
| Comp. Ex. 10 | 55 | A | B | 1.28 | 0.40 | A | B |
| Comp. Ex. 11 | 56 | C | C | 1.29 | 0.56 | D | B |
| Ex. 74 | 57 | B | A | 1.28 | 0.63 | B | B |
| Ex. 75 | 58 | B | A | 1.29 | 0.65 | B | B |
| Ex. 76 | 59 | B | A | 1.29 | 0.61 | B | B |
| Comp. Ex. 12 | 60 | C | B | 1.27 | 0.71 | B | A |

TABLE 13-3

Evaluation results HT/HH (32.5° C./85% RH)

| Ex. or Comp Ex. | Toner No. | Sleeve coat | Sleeve soil | I.D. | Fog | Image soil | Web soil |
|---|---|---|---|---|---|---|---|
| Ex. 57 | 37 | A | A | 1.32 | 0.38 | A | A |
| Ex. 58 | 38 | A | A | 1.31 | 0.34 | A | A |
| Ex. 59 | 39 | A | A | 1.30 | 0.40 | A | A |
| Ex. 60 | 40 | A | A | 1.31 | 0.44 | A | A |
| Ex. 61 | 41 | A | A | 1.28 | 0.41 | A | B |
| Ex. 62 | 42 | A | A | 1.25 | 0.40 | A | A |
| Ex. 63 | 43 | A | A | 1.27 | 0.42 | A | A |
| Ex. 64 | 44 | A | A | 1.26 | 0.40 | A | A |
| Ex. 65 | 45 | A | A | 1.25 | 0.41 | A | A |
| Ex. 66 | 46 | A | A | 1.26 | 0.38 | A | A |
| Ex. 67 | 47 | A | A | 1.27 | 0.48 | A | A |
| Ex. 68 | 48 | A | A | 1.28 | 0.40 | A | B |
| Ex. 69 | 49 | A | A | 1.25 | 0.30 | A | B |
| Ex. 70 | 50 | A | A | 1.24 | 0.46 | A | C |
| Ex. 71 | 51 | A | A | 1.25 | 0.43 | A | C |
| Ex. 72 | 52 | A | B | 1.25 | 0.40 | A | B |
| Comp. Ex. 9 | 53 | A | D | 1.24 | 0.40 | C | C |
| Ex. 73 | 54 | C | B | 1.20 | 1.66 | A | B |
| Comp. Ex. 10 | 55 | A | B | 1.25 | 0.40 | A | B |
| Comp. Ex. 11 | 56 | B | D | 1.06 | 0.39 | C | B |
| Ex. 74 | 57 | A | B | 1.21 | 0.42 | B | B |
| Ex. 75 | 58 | A | B | 1.22 | 0.45 | B | B |
| Ex. 76 | 59 | A | B | 1.22 | 0.40 | B | B |
| Comp. Ex. 12 | 60 | B | C | 1.08 | 0.51 | B | A |

Examples 77–96

Toners 37–59 were subjected to image forming tests in an environment of normal temperature/normal humidity (NT/NH=23° C./60% RH) in the same manner as in Examples 59–76, respectively, except that Developing sleeve 3 was used instead of Developing sleeve 4. The results are inclusively shown in the following Table 14.

TABLE 14

Evaluation results NT/NH (23° C./60% RH)

| Ex. or Comp. Ex. | Toner No. | Sleeve coat | Sleeve coil | I.D. | Fog |
|---|---|---|---|---|---|
| Ex. 77 | 37 | A | A | 1.45 | 0.20 |
| Ex. 78 | 38 | A | A | 1.46 | 0.28 |
| Ex. 79 | 39 | A | A | 1.42 | 0.30 |
| Ex. 80 | 40 | A | A | 1.43 | 0.27 |
| Ex. 81 | 41 | A | A | 1.38 | 0.38 |
| Ex. 82 | 42 | A | A | 1.37 | 0.39 |
| Ex. 83 | 43 | A | A | 1.35 | 0.35 |
| Ex. 84 | 44 | A | A | 1.38 | 0.35 |
| Ex. 85 | 45 | A | A | 1.36 | 0.36 |
| Ex. 86 | 46 | A | A | 1.35 | 0.38 |
| Ex. 87 | 47 | A | A | 1.36 | 0.32 |
| Ex. 88 | 48 | A | A | 1.35 | 0.33 |
| Ex. 89 | 49 | A | A | 1.34 | 0.43 |
| Ex. 90 | 50 | A | A | 1.33 | 0.45 |
| Ex. 91 | 51 | A | A | 1.33 | 0.42 |
| Ex. 92 | 52 | A | A | 1.32 | 0.44 |
| Ex. 93 | 54 | B | A | 1.29 | 0.46 |
| Ex. 94 | 57 | A | A | 1.39 | 0.32 |
| Ex. 95 | 58 | A | A | 1.38 | 0.31 |
| Ex. 96 | 59 | A | A | 1.39 | 0.34 |

What is claimed is:

1. A positively chargeable toner, comprising: a binder resin, an imidazole compound and a colorant; wherein the binder resin comprises at least one member selected from the group consisting of (i) a mixture of vinyl resin having a carboxyl group and a vinyl resin having a glycidyl group, (ii) a vinyl resin having both a carboxyl group and a glycidyl group, and (iii) a vinyl resin having a carboxyl group and a glycidyl group in a form reacted with each other, and the imidazole compound is a compound having an imidazole unit represented by formula (1) below:

(1)

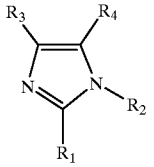

wherein $R_1$, $R_3$ and $R_4$ independently denote hydrogen, an alkyl group capable of having a substituent, an aryl group capable of having a substituent, an aralkyl group capable of having a substituent, an amino group capable of having a substituent, a heterocyclic ring capable of having a substituent, or a halogen; and $R_2$ denotes hydrogen, an alkyl group capable of having a substituent, an aryl group capable of having a substituent, an aralkyl group capable of having a substituent, or a heterocyclic group capable of having a substituent; with the proviso that two or more imidazole units can be combined with each other via two of the groups $R_1$, $R_2$, $R_3$ and $R_4$ and an intervening bonding group selected from the group consisting of phenylene group, propenylene group, vinylene group, alkenylene group and alkylene group each capable of having a substituent; and that $R_3$ and $R_4$ can be bonded to each other to form a saturated aliphatic ring, an unsaturated aliphatic ring, an aromatic ring or a heterocyclic ring.

2. The toner according to claim 1, wherein the toner contains a tetrahydrofuran (THF)-soluble content exhibiting a molecular weight distribution according to gel permeation chromatography (GPC) providing a number-average molecular weight (Mn) of $10^3$–$4\times10^4$, and a weight-average molecular weight (Mw) of $10^4$–$10^7$.

3. The toner according to claim 1, wherein the toner contains a tetrahydrofuran (THF)-soluble content providing a GPC (gel permeation chromatography) chromatogram exhibiting a main peak in a molecular weight region of $4\times10^3$–$3\times10^4$.

4. The toner according to claim 3, wherein the GPC chromatogram exhibits a peak area in a molecular weight region of at most $3\times10^4$ which occupies 60–100% of an entire peak area on the GPC chromatogram.

5. The toner according to claim 1, wherein the toner contains a tetrahydrofuran (THF)-soluble content providing a GPC (gel permeation chromatography) chromatogram exhibiting at least one peak each in a molecular weight region of $4\times10^3$–$3\times10^4$ and in a molecular weight region of $10^5$–$10^7$.

6. The toner according to claim 1, wherein the toner contains a tetrahydrofuran (THF)-soluble content providing a GPC (gel permeation chromatography) chromatogram exhibiting at least one peak each in a molecular weight region of $4\times10^3$–$3\times10^4$ and in a molecular weight region of $8\times10^5$–$10^7$.

7. The toner according to claim 1, wherein the toner contains a tetrahydrofuran (THF)-soluble content providing a GPC (gel permeation chromatography) chromatogram exhibiting at least one peak each in a molecular weight region of $4\times10^3$–$3\times10^4$, in a molecular weight region of $10^5$ to below $8\times10^5$, and in a molecular weight region of $8\times10^5$–$10^7$.

8. The toner according to claim 7, wherein the GPC chromatogram exhibits a peak area in a molecular weight region of at least $10^5$ which occupies 5–40% of an entire peak area on the GPC chromatogram.

9. The toner according to claim 1, wherein the binder resin contains a THF-insoluble content of 0.1–60 wt. %.

10. The toner according to claim 1, wherein binder resin contains a THF-insoluble content of 5–60 wt. %.

11. The toner according to claim 1, wherein the binder resin contains a THF-insoluble content of 7–55 wt. %.

12. The toner according to claim 1, wherein binder resin contains a THF-insoluble content of 9–50 wt. %.

13. The toner according to claim 1, wherein the binder resin contains a THF-insoluble content of 10–45 wt. %.

14. The toner according to claim 1, wherein the toner contains a THF-soluble content having an acid value of 0.1–50 mgKOH/g.

15. The toner according to claim 1, wherein the toner contains a THF-soluble content having an acid value of 0.5–50 mgKOH/g.

16. The toner according to claim 1, wherein the toner contains a THF-soluble content having an acid value of 0.5–40 mgKOH/g.

17. The toner according to claim 1, wherein the toner contains a THF-soluble content having an acid value of 0.5–30 mgKOH/g.

18. The toner according to claim 1, wherein the toner contains a THF-soluble content having an acid value of 0.5–25 mgKOH/g.

19. The toner according to claim 1, wherein the toner contains a THF-soluble content having an acid value of 0.5–20 mgKOH/g.

20. The toner according to claim 1, wherein the toner has a storage modulus at 80° C. (G'(80° C.)) of $1.0\times10^5$–$2.0\times10^6$ Pa, and a storage modulus at 140° C. (G'(140° C.)) of $1.0\times10^3$–$2.0\times10^4$ Pa.

21. The toner according to claim 1, wherein the toner has a temperature giving a loss tangent (tan δ) (=loss modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

22. The toner according to claim 1, wherein the toner has a storage modulus at 80° C. (G'(80° C.)) of $1.0\times10^5$–$2.0\times10^6$ Pa, a storage modulus at 140° C. (G'(140° C.)) of $1.0\times10^3$–$2.0\times10^4$ Pa, a temperature giving a loss tangent (tan δ) (=loss modulus/storage modulus) of 1 in a region of 90–130° C., a loss tangent at 80° C. (tan δ(80° C.)) of larger than 1, and a loss tangent at 140° C. (tan δ(140° C.)) of smaller than 1.

23. The toner according to claim 1, wherein the toner has been obtained through a step of melt-kneading at least the binder resin, the imidazole compound and the colorant under heating, and the toner has a storage modulus at 80° C. (G'(80° C.)) of $1.0\times10^5$–$2.0\times10^6$ Pa, and a storage modulus at 140° C. (G' (140° C.)) of $1.0\times10^3$–$2.0\times10^4$ Pa.

24. The toner according to claim 1, wherein the toner has been obtained through a step of melt-kneading at least the binder resin, the imidazole compound and the colorant under heating, and the toner has a temperature giving a loss tangent (tan δ) (=loss modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

25. The toner according to claim 1, wherein the toner has been obtained through a step of melt-kneading at least the binder resin, the imidazole compound and the colorant under heating, and the toner has a storage modulus at 80° C. (G'(80° C.)) of $1.0\times10^5$–$2.0\times10^6$ Pa, a storage modulus at 140° C. (G'(140° C.)) of $1.0\times10^3$–$2.0\times10^4$ Pa, a temperature giving a loss tangent (tan δ) (=loss modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

26. An image forming method, comprising the steps of:

forming an electrostatic latent image on an image-bearing member, and developing the electrostatic latent image with a mono-component developer comprising a positively chargeable toner carried on and conveyed by a developer-carrying member;

wherein the positively chargeable toner comprises a binder resin, an imidazole compound and a colorant; wherein the binder resin comprises at least one member selected from the group consisting of (i) a mixture of vinyl resin having a carboxyl group and a vinyl resin having a glycidyl group, (ii) a vinyl resin having both a carboxyl group and a glycidyl group, and (iii) a vinyl resin having a carboxyl group and a glycidyl group in a form reacted with each other, and the imidazole compound is a compound having an imidazole unit represented by formula (1) below:

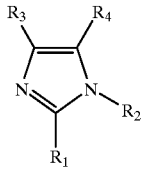

wherein $R_1$, $R_3$ and $R_4$ independently denote hydrogen, an alkyl. group capable of having a substituent, an aryl group capable of having a substituent, an aralkyl group capable of having a substituent, an amino group capable of having a substituent, a heterocyclic ring capable of having a substitutent, or a halogen and $R_2$ denotes hydrogen, an alkyl group capable of having a substituent, an aryl group capable of having a substituent, an aralkyl group capable of having a substituent, or a heterocyclic group capable of having a substituent with the proviso that two or more imidazole units can be combined with each other via two of the groups $R_1$, $R_2$, $R_3$ and $R_4$ and an intervening bonding group selected from the group consisting of phenylene group, propenylene group, vinylene group, alkenylene group and alkylene group each capable of having a substituent; and that $R_3$ and $R_4$ can be bonded to each other to form a saturated aliphatic ring, an unsaturated aliphatic ring, an aromatic ring or a heterocyclic ring.

27. The image forming method according to claim 26, wherein the toner contains a tetrahydrofuran (THP)-soluble content exhibiting a molecular weight distribution according to gel permeation chromatography (GPC) providing a number-average molecular weight (Mn) of $10^3$–$4\times10^4$, and a weight-average molecular weight (Mw) of $10^4$–$10^7$.

28. The image forming method according to claim 26, wherein the toner contains a tetrahydrofuran (THF)-soluble content providing a GPC (gel permeation chromatography) chromatogram exhibiting a main peak in a molecular weight region of $4\times10^3$–$3\times10^4$.

29. The image forming method according to claim 28, wherein the GPC chromatogram exhibits a peak area in a molecular weight region of at most $3\times10^4$ which occupies 60–100% of an entire peak area on the GPC chromatogram.

30. The image forming method according to claim 26, wherein the toner contains a tetrahydrofuran (THF)-soluble content providing a GPC (gel permeation chromatography) chromatogram exhibiting at least one peak each in a molecular weight region of $4\times10^3$–$3\times10^4$ and in a molecular weight region of $10^5$–$10^7$.

31. The image forming method according to claim 26, wherein the toner contains a tetrahydrofuran (THF)-soluble content providing a GPC (gel permeation chromatography) chromatogram exhibiting at least one peak each in a molecular weight region of $4\times10^3$–$3\times10^4$ and in a molecular weight region of $8\times10^5$–$10^7$.

32. The image forming method according to claim 26, wherein the toner contains a tetrahydrofuran (THF)-soluble content providing a GPC (gel permeation chromatography) chromatogram exhibiting at least one peak each in a molecular weight region of $4\times10^3$–$3\times10^4$, in a molecular weight region of $10^5$ to below $8\times10^5$, and in a molecular weight region of $8\times10^5$–$10^7$.

33. The image forming method according to claim 32, wherein the GPC chromatogram exhibits a peak area in a molecular weight region of at least $10^5$ which occupies 5–40% of an entire peak area on the GPC chromatogram.

34. The image forming method according to claim 26, wherein the binder resin contains a THF-insoluble content of 0.1–60 wt. %.

35. The image forming method according to claim 26, wherein binder resin contains a THF-insoluble content of 5–60 wt. %.

36. The image forming method according to claim 26, wherein the binder resin contains a THF-insoluble content of 7–55 wt. %.

37. The image forming method according to claim 26, wherein binder resin contains a THF-insoluble content of 9–50 wt. %.

38. The image forming method according to claim 26, wherein the binder resin contains a THF-insoluble content of 10–45 wt. %.

39. The image forming method according to claim 26, wherein the binder resin has an acid value of 0.1–50 mgKOH/g.

40. The image forming method according to claim 26, wherein the toner contains a THF-soluble content having an acid value of 0.5–50 mgKOH/g.

41. The image forming method according to claim 26, wherein the toner contains a THF-soluble content having an acid value of 0.5–40 mgKOH/g.

42. The image forming method according to claim 26, wherein the toner contains a THF-soluble content having an acid value of 0.5–30 mgKOH/g.

43. The image forming method according to claim 26, wherein the toner contains a THF-soluble content having as an acid value of 0.5–25 mgKOH/g.

44. The image forming method according to claim 26, wherein the toner contains a THF-soluble content having has an acid value of 0.5–20 mgKOH/g.

45. The image forming method according to claim 26, wherein the toner has a storage modulus at 80° C. (G'(80° C.)) of $1.0\times10^5$–$2.0\times10^6$ Pa, and a storage modulus at 140° C. (G'(140° C.)) of $1.0\times10^3$–$2.0\times10^4$ Pa.

46. The image forming method according to claim 26, wherein the toner has a temperature giving a loss tangent (tan δ) (=loss modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

47. The image forming method according to claim 26, wherein the toner has a storage modulus at 80° C. (G'(80° C.)) of $1.0\times10^5$–$2.0\times10^6$ Pa, a storage modulus at 140° C. (G'(140° C.)) of $2.0\times10^3$–$1.0\times10^4$ Pa, a temperature giving a loss tangent (tan δ) (=loss modulus/storage modulus) of 1 in a region of 90–130° C., a loss tangent at 80° C. (tan δ (80° C.)) of larger than 1, and a loss tangent at 140° C. (tan δ(140° C.)) of smaller than 1.

48. The image forming method according to claim 26, wherein the toner has been obtained through a step of melt-kneading at least the binder resin, the imidazole compound and the colorant under heating, and the toner has a storage modulus at 80° C. (G'(80° C.)) of $1.0\times10^5$–$2.0\times10^6$ Pa, and a storage modulus at 140° C. (G'(140° C.)) of $1.0\times10^3$–$2.0\times10^4$ Pa.

49. The image forming method according to claim 26, wherein the toner has been obtained through a step of melt-kneading at least the binder resin, the imidazole compound and the colorant under heating, and the toner has a temperature giving a loss tangent (tan δ) (=loss modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

50. The image forming method according to claim 26, wherein the toner has been obtained through a step of melt-kneading at least the binder resin, the imidazole compound and the colorant under heating, and the toner has a storage modulus at 80° C. (G'(80° C.)) of $1.0\times10^5$–$2.0\times10^6$ Pa, a storage modulus at 140° C. (G'(140° C.)) of $1.0\times10^3$–$2.0\times10^4$ Pa, a temperature giving a loss tangent (tan δ) (=loss modulus/storage modulus) of 1 in a region of 90–130° C., a loss tangent at 80° C. (tan δ (80° C.)) of larger than 1, and a lose tangent at 140° C. (tan δ (140° C.)) of smaller than 1.

51. The image forming method according to claim 26, wherein the developer-carrying member is in the form of a cylindrical sleeve formed of a material comprising a resin.

52. The image forming method according to claim 26, wherein the developer-carrying member comprises a substrate and a resin-containing coating layer formed on the substrate.

53. The image forming method according to claim 52, wherein the coating layer comprises at least one member selected from the group consisting of an electroconductive substrate, a filler and a solid lubricant, in addition to the resin.

54. The image forming method according to claim 26, wherein the image-bearing member comprises an electrophotographic photosensitive member.

55. The image forming method according to claim 26, wherein the electrostatic latent image is developed with the developer while a developing bias voltage comprising an alternating voltage is applied to the developer-carrying member.

56. The image forming method according to claim 55, wherein the developing bias voltage comprises an AC voltage superposed with a DC voltage.

57. An image forming apparatus, comprising:

an image-bearing member, a latent image forming means for forming an electrostatic latent image on the image-bearing member, and a developing means comprising a developer-carrying member for carrying and conveying thereon a monocomponent developer comprising a positively chargeable toner which comprises a binder resin, an imidazole compound and a colorant; wherein the binder resin comprises at least one member selected from the group consisting of (i) a mixture of vinyl resin having a carboxyl group and a vinyl resin having a glycidyl group, (ii) a vinyl resin having both a carboxyl group and a glycidyl group, and (iii) a vinyl resin having a carboxyl group and a glycidyl group in a form reacted with each other, and the imidazole compound is a compound having an imidazole unit represented by formula (1) below:

(1)

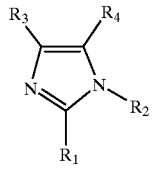

wherein $R_1$, $R_3$ and $R_4$ independently denote hydrogen, an alkyl group capable of having a substituent, an aryl group capable of having a substituent, an aralkyl group capable of having a substituent, an amino group capable of having a substituent; a heterocyclic ring capable of having a substituent, or a halogen; and $R_2$ denotes hydrogen, an alkyl group capable of having a substituent, an aryl group capable of having a substituent, an aralkyl group capable of having a substituent, or a heterocyclic group capable of having a substituent, with the proviso that two or more imidazole units can be combined with each other via two of the groups $R_1$, $R_2$, $R_3$ and $R_4$ and an intervening bonding group selected from the group consisting of phenylene group, propenylene group, vinylene group, alkenylene group and alkylene group each capable of having a substituent; and that $R_3$ and $R_4$ can be bonded to each other to form a saturated aliphatic ring, an unsaturated aliphatic ring, an aromatic ring or a heterocyclic ring.

58. The apparatus according to claim 57, wherein the toner contains a tetrahydrofuran (THF)-soluble content exhibiting a molecular weight distribution according to gel permeation chromatography (GPC) providing a number-average molecular weight (Mn) of $10^3$–$4\times10^4$, and a weight-average molecular weight (Mw) of $10^4$–$10^7$.

59. The apparatus according to claim 57, wherein the toner contains a tetrahydrofuran (THF)-soluble content providing a GPC (gel permeation chromatography) chromatogram exhibiting a main peak in a molecular weight region of $4\times10^3$–$3\times10^4$.

60. The apparatus according to claim 59, wherein the GPC chromatogram exhibits a peak area in a molecular weight region of at most $3\times10^4$ which occupies 60–100% of an entire peak area on the GPC chromatogram.

61. The apparatus according to claim 57, wherein the toner contains a tetrahydrofuran (THF)-soluble content providing a GPC (gel permeation chromatography) chromatogram exhibiting at least one peak each in a molecular weight region of $4\times10^3$–$3\times10^4$ and in a molecular weight region of $10^5$–$10^7$.

62. The apparatus according to claim 57, wherein the toner contains a tetrahydrofuran (THF)-soluble content providing a GPC (gel permeation chromatography) chromatogram exhibiting at least one peak each in a molecular weight region of $4\times10^3$–$3\times10^4$ and in a molecular weight region of $8\times10^5$–$10^7$.

63. The apparatus according to claim 57, wherein the toner contains a tetrahydrofuran (THF)-soluble content providing a GPC (gel permeation chromatography) chromatogram exhibiting at least one peak each in a molecular weight region of $4\times10^3$–$3\times10^4$, in a molecular weight region of $10^5$ to below $8\times10^5$, and in a molecular weight region of $8\times10^5$–$10^7$.

64. The apparatus according to claim 63, wherein the GPC chromatogram exhibits a peak area in a molecular weight region of at least $10^5$ which occupies 5–40% of an entire peak area on the GPC chromatogram.

65. The apparatus according to claim 57, wherein the binder resin contains a THF-insoluble content of 0.1–60 wt. %.

66. The apparatus according to claim 57, wherein binder resin contains a THF-insoluble content of 5–60 wt. %.

67. The apparatus according to claim 57, wherein the binder resin contains a THF-insoluble content of 7–55 wt. %.

68. The apparatus according to claim 57, wherein binder resin contains a THF-insoluble content of 9–50 wt. %.

69. The apparatus according to claim 57, wherein the binder resin contains a THF-insoluble content of 10–45 wt. %.

70. The apparatus according to claim 57, wherein the toner contains a THF-soluble content having an acid value of 0.1–50 mgKOH/g.

71. The apparatus according to claim 57, wherein the toner contains a THF-soluble content having an acid value of 0.5–50 mgKOH/g.

72. The apparatus according to claim 57, wherein the toner contains a THF-soluble content having an acid value of 0.5–40 mgKOH/g.

73. The apparatus according to claim 57, wherein the toner contains a THF-soluble content having an acid value of 0.5–30 mgKOH/g.

74. The apparatus according to claim 57, wherein the toner contains a THF-soluble content having an acid value of 0.5–25 mgKOH/g.

75. The apparatus according to claim 57, wherein the toner contains a THF-soluble content having an acid value of 0.5–20 mgKOH/g.

76. The apparatus according to claim 57, wherein the toner has a storage modulus at 80° C. (G'(80° C.)) of $1.0\times10^5$–$2.0\times10^6$ Pa, and a storage modulus at 140° C. (G'(140° C.)) of $1.0\times10^3$–$2.0\times10^4$ Pa.

77. The apparatus according to claim 57, wherein the toner has a temperature giving a lose tangent (tan δ) (=loss modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

78. The apparatus according to claim 57, wherein the toner has a storage modulus at 80° C. (G'(80° C.)) of $1.0\times10^5$–$2.0\times10^6$ Pa, a storage modulus at 140° C. (G'(140° C.)) of $1.0\times10^3$–$2.0\times10^4$ Pa, a temperature giving a loss tangent (tan δ) (=loss modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

79. The apparatus according to claim 57, wherein the toner has been obtained through a step of melt-kneading at least the binder resin, the imidazole compound and the colorant under heating, and the toner has a storage modulus at 80° C. (G'(80° C.)) of $1.0\times10^5$–$2.0\times10^6$ Pa, and a storage modulus at 140° C. (G'(140° C.)) of $1.0\times10^3$–$2.0\times10^4$ Pa.

80. The apparatus according to claim 57, wherein the toner has been obtained through a stop of melt-kneading at least the binder resin, the imidazole compound and the colorant under heating, and the toner has a temperature giving a loss tangent (tan δ) (=lose modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

81. The apparatus according to claim 57, wherein the toner has been obtained through a step of melt-kneading at least the binder resin, the imidazole compound and the colorant under heating, and the toner has a storage modulus at 80° C. (G'(80° C.)) of $1.0\times10^5$–$2.0\times10^6$ Pa, a storage modulus at 140° C. (G'(140 ° C.)) of $1.0\times10^3$–$2.0\times10^4$ Pa, a temperature giving a loss tangent (tan δ) (=loss modulus/storage modulus) of 1 in a region of 90–130° C., a loss tangent at 80° C. (tan δ (80° C.)) of larger than 1, and a loss tangent at 140° C. (tan δ (140° C.)) of smaller than 1.

82. The apparatus according to claim 57, wherein the developer-carrying member is in the form of a cylindrical sleeve formed of a material comprising a resin.

83. The apparatus according to claim 57, wherein the developer-carrying member comprises a substrate and a resin-containing coating layer formed on the substrate.

84. The apparatus according to claim 83, wherein the coating layer comprises at least one member selected from the group consisting of an electroconductive substrate, a filler and a solid lubricant, in addition to the resin.

85. The apparatus according to claim 57, wherein the image-bearing member comprises an electrophotographic photosensitive member.

86. The apparatus according to claim 57, further including a developing bias voltage application means for applying a developing bias voltage comprising an alternating voltage to the developer-carrying member.

87. The apparatus according to claim 86, wherein the developing bias voltage comprises an AC voltage superposed with a DC voltage.

* * * * *

UNITED STATES PATENT AND TRADEMARK OFFICE

CERTIFICATE OF CORRECTION

PATENT NO. : 6,235,441 B1
DATED : May 22, 2001
INVENTOR(S) : Hirohide Tanikawa et al.

It is certified that error appears in the above-identified patent and that said Letters Patent is hereby corrected as shown below:

Title page,
Item [57], ABSTRACT,
"imidazo" should read -- imidazole --.

Column 2,
Line 34, "the." should read -- the --;
Line 56, "stop" should read -- step --.

Column 3,
Line 3, "monoerter" should read -- monoester --;
Line 29, "JF-A" should read -- JP-A --;
Line 57, "a" should be deleted;
Line 59, "has" should read -- have --; and
Line 61, "a" should be deleted.

Column 4,
Line 50, "sleeve have" should read -- sleeve has --; and
Line 66, "a" should be deleted.

Column 7,
Line 65, "malt-" should read -- melt --.

Column 8,
Line 4, "melt kneading" should read -- melt-kneading --.

Column 9,
Line 20, "a" should read -- as --; and
Line 49, "as" should read -- so as --.

Column 10,
Line 9, "VHF-soluble" should read -- THF-soluble --;
Line 31, "occupies" should read -- occupy --;
Line 39, "is" should read -- be --; and
Line 53, "ratter," should read -- matter, --.

Column 11,
Line 19, "affective" should read -- effective --.

Column 12,
Line 6, "masher" should read -- member --.

UNITED STATES PATENT AND TRADEMARK OFFICE

CERTIFICATE OF CORRECTION

PATENT NO. : 6,235,441 B1
DATED : May 22, 2001
INVENTOR(S) : Hirohide Tanikawa et al.

It is certified that error appears in the above-identified patent and that said Letters Patent is hereby corrected as shown below:

Column 14,
Line 12, "(mgKOH/g)={(S-B)xfx561}/W" should read -- (mgKOH/g)={(S-B)xfx5.61}/W --; and
Line 67, "naleic" should read -- maleic -- and "faniaric" should read -- fumaric --.

Column 15,
Line 11, "is" should read -- are --;
Line 28, "s" should read -- as --;
Line 31, "comprises" should read -- comprise --; and
Line 57, "stitute" should read -- stitutes --.

Column 16,
Line 28, "aster," should read -- ester, --.

Column 17,
Line 20, "mettbacrylatq," should read -- methacrylate, --;
Line 50, "a" should read -- an --; and
Line 64, "equivalent," should read -- equivalents, --.

Column 18,
Line 6, "becomes" should read -- become --; and
Line 59, "henzoate;" should read -- benzoate; --.

Column 19,
Line 15, "finability" should read -- fixability --; and
Line 28, "styrene-butadlene" should read -- styrene-butadiene --.

Column 21,
Line 7, " 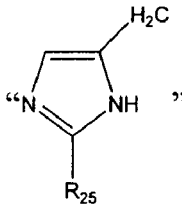

" should read -- 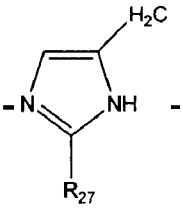

--.

Line 33, "substituant;" should read -- substituent; --; and
Line 38, "substituent" should read -- substituent. --.

UNITED STATES PATENT AND TRADEMARK OFFICE

CERTIFICATE OF CORRECTION

PATENT NO. : 6,235,441 B1 
DATED : May 22, 2001
INVENTOR(S) : Hirohide Tanikawa et al.

It is certified that error appears in the above-identified patent and that said Letters Patent is hereby corrected as shown below:

Column 22,
Line 7, "isovalerlc" should read -- isovaleric --;
Line 10, "glycerin" should read -- glyceric --;
Line 11, "dicarboaylic" should read -- dicarboxylic --;
Line 12, "acid." should read -- acid, --;
Line 16, "aromtic" should read -- aromatic --;
Line 18, "cirmamic" should read -- cinnamic -- and "toreph-" should read -- tereph- --;
Line 19, "trimnellitic" should read -- trimellitic --;
Line 27, "pyromellitlc" should read -- pyromellitic --; and
Line 29, "mathyl" should read -- methyl --.

Column 23,
Line 6, "attach int" should read -- attachment --.

Column 26,
Lines 2-16, " 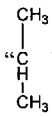 " should read -- 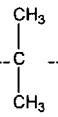 --.

Column 28,
Line 56, "suubstituents" should read -- substituents --; and
Line 57, "enuzerated." should read -- enumerated. --.

Column 33,
Line (3-27), " 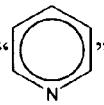 " should read -- 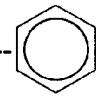 --.

Line (3-37), " 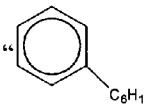 " should read -- 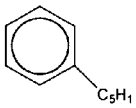 --.

Column 34,
Line (3-28), " 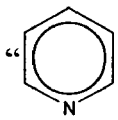 " should read -- 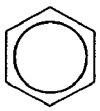 --.

Column 37,
Line (4-10), " 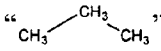 " should read -- 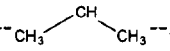 --.

UNITED STATES PATENT AND TRADEMARK OFFICE

CERTIFICATE OF CORRECTION

PATENT NO. : 6,235,441 B1
DATED : May 22, 2001
INVENTOR(S) : Hirohide Tanikawa et al.

It is certified that error appears in the above-identified patent and that said Letters Patent is hereby corrected as shown below:

Column 47,
Line (5-47), " 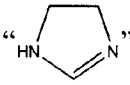 " should read -- 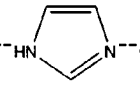 --.

Column 48,
Line (5-46), "$CoCl_3$" should read -- CoCl --.

Column 51,
Line (7-16), "$n_{av}$= 41" should read -- $n_{av}$=41 --.

Column 52,
Line (7-11), " 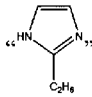 " should read -- 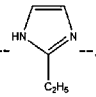 --.

Column 55,
Line (7-24), " 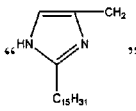 " should read ---- " 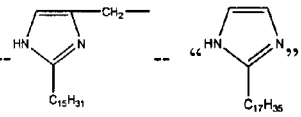 " should read -- 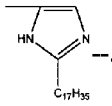 --.

Column 64,
Line (a-40), " 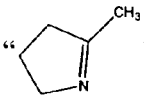 " should read -- 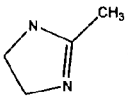 --.

Column 66,
Line (a-53), "$C_{16}H_{31}$" should read -- $C_{15}H_{31}$ --.

Column 69,
Line 2, "releasability" should read -- releasability. --; and
Line 9, "haxene-1," should read -- hexene-1, --.

Column 70,
Line 36, "flowabllty-imparting" should read -- flowability-imparting --;
Line 39, "polytetraflourouthylene," should read -- polytetrafluoroethylene, -- and "polyvinylldene" should read -- polyvinylidene --;
Line 46, "hydrophobiLzed." should read -- hydrophobilized. --;
Line 49, "to" should read -- to use --; and
Line 63, "an" should read -- a --.

UNITED STATES PATENT AND TRADEMARK OFFICE

CERTIFICATE OF CORRECTION

PATENT NO. : 6,235,441 B1
DATED : May 22, 2001
INVENTOR(S) : Hirohide Tanikawa et al.

It is certified that error appears in the above-identified patent and that said Letters Patent is hereby corrected as shown below:

Column 71,
Line 2, “bleners” should read -- blenders -- and “nay” should read -- may --;
Line 7, “Buse” should read -- Buss --;
Line 9, “Saeiko” should read -- Seiko --;
Line 14, “pulverizers.” should read -- pulverizes, --;
Line 17, “Pulberizer” should read -- Pulverizer --;
Line 26, “Kogro” should read -- Kogyo --;
Line 27, “Ultraonic” should read -- Ultrasonic --;
Line 30, “Microshifter” should read -- Microsifter --;
Line 46, “slectroconductive” should read -- electroconductive --;
Line 52, “contained.” should read -- contained, --;
Line 57, “compound.” should read -- compound, --; and
Line 62, “volum” should read -- volume --.

Column 72,
Line 38, “polyimathyl” should read -- polymethyl --; and
Line 52, “part,” should read -- parts, --.

Column 73,
Line 29, “uniformize,” should read -- made uniform, --;
Line 46, “for” should read -- to --;
Line 49, “he” should read -- be --.

Column 74,
Line 16, “region D” should read -- region D. --;
Line 34, “is” should read -- be --; and
Line 45, “is” should read -- be --.

Column 76,
Line 25, “chargeability,” should read -- chargeability, --.

Column 78,
Line 66, “ingredients” should read -- ingredients. --.

Column 79,
Line 24, “descent” should read -- descend --.

UNITED STATES PATENT AND TRADEMARK OFFICE

CERTIFICATE OF CORRECTION

PATENT NO. : 6,235,441 B1
DATED : May 22, 2001
INVENTOR(S) : Hirohide Tanikawa et al.

It is certified that error appears in the above-identified patent and that said Letters Patent is hereby corrected as shown below:

Column 80,
Line 10, “miser” should read -- mixer --;
Line 27, “yet-unflexed” should read -- yet-unfixed --;
Line 34, “property” should read -- property. --; and
Line 45, “ere” should read -- were --.

Column 81,
Line 7, “No” should read -- Not --.

Column 88,
Line 35, “refux” should read -- reflux --.

Column 90,
Line 22, “resin A19>” should read -- resin A-19> --.

Column 92,
Table 5, “18.9 80.4 19.5 79” should read -- 78.9 80.4 79.5 79
18 16 --,
Table 5, “B100” should read -- 8100 --; and
Table 5, “5 8.3” should read -- 58.3 --.

Column 93,
Line 12, “miser” should read -- mixer --;
Line 61, “standard” should read -- standard. --.

Column 94,
Line 10, “No” should read -- Not --; and
Line 44, “i” should read -- an --.

Column 96,
Line 26, “Carbozylic” should read -- Carboxylic --; and
Line 33, “Carbozylic” should read -- Carboxylic --.

Column 98,
Table 7-1, “8-1” should read -- 8-1
2 --
Table 7-1, “toner)(%)” should read -- (toner)(%) --;
Table 7-1, “41” should read -- 43 --;

CERTIFICATE OF CORRECTION

PATENT NO. : 6,235,441 B1
DATED : May 22, 2001
INVENTOR(S) : Hirohide Tanikawa et al.

It is certified that error appears in the above-identified patent and that said Letters Patent is hereby corrected as shown below:

Column 98 (continued),
Table 7-2, 2
6.1 8.8 6.4 9.8 1.9 27 10.5 16.5 7.1" should read
-- 2 2
9.9 0 31.8 6.8 7.6 9.2 6.5 6.2 6.0 --.

Column 99,
Table 7-2, "toner)(%)" should read -- (toner)(%) --;
Table 7-2, "0.554" should read -- 0.54 --;
Table 7-2, "triptienylmethame" should read -- triphenylmethane --; and
Table 8-1, " D -- B
D " should read D --.

Column 101,
Table 9, "(23 ° C./160% RH)" should read -- 23 ° C./60% RH) --.

Column 102,
Table 9 continued, "(23 ° C./160% RH)" should read -- 23 ° C./60% RH) --;
Line 26, "Cyclohexyl)" should read -- cyclohexyl) --;
Line 45, "Cyclohexyl)" should read -- cyclohexyl) --; and
Line 57, "Cyclohexyl)" should read -- cyclohexyl) --;

Column 103,
Line 5, "Cyclohexyl)" should read -- cyclohexyl) --; and
Line 17, "Cyclohexyl)" should read -- cyclohexyl) --;

Column 104,
Line 17, "acid" should read -- maleate --; and
Line 26, "acid" should read -- maleate --.

Column 106,
Line 21, "a-22except" should read -- A-22 except --; and
Line 43, "Carbozylic" should read -- Carboxylic --.

Column 108,
Line 57, "propriety" should read -- properties --; and
Table 10, "A-25" (second occurrence) should read -- A-26 --.

Column 109,
Table 10 cont., "A-38" (first occurrence) should read -- A-36 --;
Table 10 cont., "6.1" should read -- 8.1 --.

UNITED STATES PATENT AND TRADEMARK OFFICE

CERTIFICATE OF CORRECTION

PATENT NO. : 6,235,441 B1
DATED : May 22, 2001
INVENTOR(S) : Hirohide Tanikawa et al.

It is certified that error appears in the above-identified patent and that said Letters Patent is hereby corrected as shown below:

Column 110,
Line 54, “miser” should read -- mixer --.

Column 111,
Line 2, “mid.” should read -- mfd. --;
Line 27, “loadof” should read -- load of --; and
Line 54, “No” should read -- Not --.

Column 112,
Line 42, “eyes” should read -- eyes. --;
Line 45, “(good);” should read -- (good): --;
Line 52, “case.” should read -- cases. --;
Line 60, “(fair);” should read -- (fair): --; and
Line 62, “sleets” should read -- sheets --.

Column 113,
Line 39, “Carboxyl” should read -- Carboxylic --.

Column 115,
Table 12-1, “Ex. 68” (first occurrence) should read -- Ex. 66 --;
Table 12-1, “148” should read -- 14.8 --;
Table 12-1, “58.8” should read -- 56.8 --;
Table 12-1, “2B.3%” should read -- 28.3% --;
Table 12-1, “tan δ (14°C.) G’(80+ C.)” should read -- tan δ (140° C.) G’(80° C) --; and
Table 12-1, “0.54 3.1” should read -- 0.51 3.1 --.

Column 117,
Table 12-2, “22” should read -- 2.2 --;
Table 12-2, “5.7 8.4” should read -- 5.7 6.4 --;
Table 13-1, “Sleeve soil Sleeve coat” should read -- Sleeve coat Sleeve soil --;
Table 13-1, “A A A D” should read -- A A A B --;
Table 13-1, “135 B” should read -- 135 D --; and
Table 13-1, “140 D D” should read -- 140 B B --.

Column 123,
Line 11, “alkyl.” should read -- alkyl --.

UNITED STATES PATENT AND TRADEMARK OFFICE

CERTIFICATE OF CORRECTION

PATENT NO. : 6,235,441 B1
DATED : May 22, 2001
INVENTOR(S) : Hirohide Tanikawa et al.

It is certified that error appears in the above-identified patent and that said Letters Patent is hereby corrected as shown below:

Column 124,
Line 35, “as” should be deleted; and
Line 38, “has” should be deleted.

Column 125,
Line 20, “lose” should read -- loss --.

Column 128,
Line 12, “stop” should read -- step --.

Signed and Sealed this

Twenty-third Day of July, 2002

*Attest:*

*Attesting Officer*

JAMES E. ROGAN
*Director of the United States Patent and Trademark Office*